US011480377B2

(12) United States Patent
Kim et al.

(10) Patent No.: US 11,480,377 B2
(45) Date of Patent: Oct. 25, 2022

(54) REFRIGERATOR

(71) Applicant: LG Electronics Inc., Seoul (KR)

(72) Inventors: Yonghyun Kim, Seoul (KR); Jinil Hong, Seoul (KR); Hyunji Park, Seoul (KR)

(73) Assignee: LG Electronics Inc., Seoul (KR)

( * ) Notice: Subject to any disclaimer, the term of this patent is extended or adjusted under 35 U.S.C. 154(b) by 204 days.

(21) Appl. No.: 16/685,346

(22) Filed: Nov. 15, 2019

(65) Prior Publication Data

US 2020/0158412 A1 May 21, 2020

(30) Foreign Application Priority Data

Nov. 16, 2018 (KR) ..... 10-2018-0142079
Jul. 6, 2019 (KR) ..... 10-2019-0081730

(51) Int. Cl.
*F25C 1/10* (2006.01)
*F25C 5/187* (2018.01)
*F25C 5/20* (2018.01)

(52) U.S. Cl.
CPC ..... *F25C 5/187* (2013.01); *F25C 1/10* (2013.01); *F25C 5/22* (2018.01); *F25C 2400/10* (2013.01); *F25C 2700/02* (2013.01)

(58) Field of Classification Search
CPC .... F25C 1/10; F25C 2400/10; F25C 2700/02; F25C 5/182; F25C 5/187; F25C 5/22; F25D 25/025
See application file for complete search history.

(56) References Cited

U.S. PATENT DOCUMENTS 3,964,269 A 6/1976 Linstromberg
9,310,116 B2 * 4/2016 Culley ..... F25C 1/25
9,638,459 B2 * 5/2017 Choi ..... F25D 25/025
2004/0206250 A1 * 10/2004 Kondou ..... F25C 5/14 99/426
2005/0151050 A1 * 7/2005 Godfrey ..... F25C 1/24 249/127
2008/0156022 A1 * 7/2008 LeClear ..... F25C 1/04 62/344

(Continued)

FOREIGN PATENT DOCUMENTS

EP 2730865 A2 5/2014
JP H1194417 4/1999

(Continued)

OTHER PUBLICATIONS

Machine translation of WO2010066538, eSpacenet, Jun. 17, 2010, description (Year: 2010).*

(Continued)

*Primary Examiner* — Filip Zec
(74) *Attorney, Agent, or Firm* — Fish & Richardson P.C.

(57) ABSTRACT

Provided is a refrigerator including a cabinet having a freezing compartment defined therein, an ice-maker mounted in the freezing compartment, wherein the ice-maker makes spherical ice and removes the made spherical ice downwards, an ice bin disposed below the ice-maker, and retractable and extendable in a front and rear direction, wherein the removed ice is stored in the ice bin, and a cover plate extending downward from a rear face of the ice-maker, wherein the cover plate shields a space between the ice bin and the ice-maker.

20 Claims, 61 Drawing Sheets

(56) References Cited

U.S. PATENT DOCUMENTS

| | | | | |
|---|---|---|---|---|
| 2009/0178428 | A1* | 7/2009 | Cho | F25C 5/185 62/344 |
| 2013/0014536 | A1* | 1/2013 | Son | F25C 1/25 62/340 |
| 2014/0130537 | A1* | 5/2014 | Gu | F25C 5/22 62/344 |
| 2015/0135762 | A1* | 5/2015 | Eveland | F25D 29/00 62/441 |

FOREIGN PATENT DOCUMENTS

| | | |
|---|---|---|
| KR | 10-1850918 | 5/2018 |
| WO | WO 2010/066538 | 6/2010 |

OTHER PUBLICATIONS

Extended European Search Report in European Appln. No. 19209379.7, dated Apr. 1, 2020, 9 pages.

* cited by examiner

REFRIGERATOR

CROSS-REFERENCE TO RELATED APPLICATION(S)

The application claims priority under 35 U.S.C. § 119 and 35 U.S.C. § 365 to Korean Patent Application Nos. 10-2018-0142079 filed on Nov. 16, 2018, and 10-2019-0081730 filed on Jul. 6, 2019, whose entire disclosures are hereby incorporated by reference.

BACKGROUND

Field of the Disclosure

The present disclosure relates to a refrigerator.

Discussion of the Related Art

In general, a refrigerator is a home appliance for storing foods at a low temperature by low temperature air.

The refrigerator uses cold-air to cool inside of a storage space, so that the stored food may be stored in a refrigerated or frozen state.

Typically, an ice-maker for making ice is provided inside the refrigerator.

The ice-maker is configured to receive water from a water source or a water tank in a tray to make ice.

Further, the ice-maker is configured to remove the ice from the ice tray in a heating or twisting manner after the ice-making is completed.

As such, the ice-maker, which automatically receives the water and removes the ice, has an open top to scoop molded ice.

As described above, the ice made in the ice maker having a structure as described above may have at least one flat surface such as crescent or cubic shape.

When the ice has a spherical shape, it is more convenient to ice the ice, and also, it is possible to provide different feeling of use to a user. Also, even when the made ice is stored, a contact area between the ice cubes may be minimized to minimize a mat of the ice cubes.

Korean Patent Registration No. 10-1850918 as Prior Art document discloses an ice maker.

The ice maker of Prior Art document includes an upper tray in which a plurality of upper cells of a hemispherical shape are arranged and a pair of link guides extending upwardly from both sides are disposed, a lower tray in which a plurality of lower cells of a hemispherical shape are arranged and which is pivotally connected to the upper tray, a pivoting shaft connected to rear ends of the lower tray and the upper tray to allow the lower tray to pivot relative to the upper tray, a pair of links having one end thereof connected to the lower tray and the other end thereof connected to the link guide, and an ejecting pin assembly having both ends thereof respectively connected to the pair of links while being respectively inserted into the link guides, wherein the ejecting pin assembly ascends and descends together with the link.

In Prior Art, only the ice making structure of the spherical ice is disclosed, but the idea of storage of the spherical ice is not disclosed.

SUMMARY OF THE DISCLOSURE

A purpose of an embodiment of the present disclosure is to provide a refrigerator in which stored ice is easy to use.

Another purpose of an embodiment of the present disclosure is to provide a refrigerator that may minimize loss of a storage space to dispose an ice-maker therein.

Another purpose of an embodiment of the present disclosure is to provide a refrigerator that prevents ice from falling even when an ice bin in which the ice is stored is extended or retracted.

In one aspect of the present disclosure, there is provided a refrigerator including a cabinet having a freezing compartment defined therein, an ice-maker mounted in the freezing compartment, wherein the ice-maker makes spherical ice and removes the made spherical ice downwards, an ice bin disposed below the ice-maker, and retractable and extendable in a front and rear direction, wherein the removed ice is stored in the ice bin, and a cover plate extending downward from a rear face of the ice-maker, wherein the cover plate shields a space between the ice bin and the ice-maker.

In one embodiment, at least a portion of a lower portion of the ice-maker may be received in the ice bin.

In one embodiment, the ice-maker may be mounted on a top face of the freezing compartment.

In one embodiment, a top face of the freezing compartment may be recessed to define a space, and at least a portion of an upper portion of the ice-maker may be received in the recessed space.

In one embodiment, a bin opening may be defined in a rear face of the ice bin such that the ice-maker passes through the bin opening when the ice bin may be retracted or extended.

In one embodiment, the cover plate may be formed in a size corresponding to the bin opening, and the cover plate may shield the bin opening when the ice bin is retracted.

In one embodiment, the bin opening may be recessed downward from a top of the ice bin, and the bin opening may downwardly extend to a vertical level higher than a bottom of the bin by at least a diameter of the spherical ice.

In one embodiment, the ice-maker may include an ice-full state detection lever pivoting to detect an ice-full state of the ice bin, and width and height of the bin opening may be larger than a radius of pivoting of the ice-full state detection lever.

In one embodiment, the ice-maker may include an upper casing forming an outer shape of the ice-maker, and the cover plate may be mounted on a rear face of the upper casing.

In one embodiment, the upper casing may have a plate seat protruding therefrom, an upper portion and a lower portion of the upper casing may be stepped by the plate seat, and a plate bent portion may be formed on a top of the cover plate such that the cover plate is seated on the plate seat.

In one embodiment, a pair of bosses may protrude from a rear face of the upper casing, a pair of boss-receiving portions for respectively receiving the pair of bosses therein may be formed on the cover plate corresponding to the pair of bosses, and a screw may be fastened to each of the pair of boss-receiving portions.

In one embodiment, the ice-maker may include an upper casing forming an outer shape of the ice-maker, and a portion of the upper casing may extend downward to form the cover plate.

In one embodiment, a cold-air hole may be defined in a rear face of the ice-maker above the cover plate, and cold-air may flow into the ice-maker through the cold-air hole in a front direction.

In one embodiment, a ventilation hole may be defined in the cover plate, and the ventilation hole may penetrate the cover plate such that the cold-air flows into the ice bin.

In one embodiment, a plate rib may protrude along a perimeter of the cover plate to reinforce the cover plate.

In one embodiment, the freezing compartment may have a freezing compartment drawer extended and retracted in the front and rear direction, and the ice bin may be seated in the drawer and is extended and retracted together with the freezing compartment drawer.

In one embodiment, a bin opening may be defined in a rear face of the ice bin such that the ice-maker may pass through the bin opening when the ice bin may be retracted or extended, and a drawer opening may be defined in a rear face of the freezing compartment drawer at a position and in a size corresponding to the bin opening.

In one embodiment, a bin opening guide may extend rearwardly along a perimeter of the bin opening.

In one embodiment, each bin mounting guide may protrude upward from a bottom face of the freezing compartment drawer, and each bin mounting guide may receive a corner of the ice bin to guide a mounting position of the ice bin, and maintain a mounting state of the ice bin.

In one embodiment, a range of movement of the freezing compartment drawer may include a region between a front end and a rear end of the ice-maker.

The refrigerator according to the present disclosure has following effects.

According to the present embodiment, the ice-maker may be mounted on the top face of the freezing compartment, and the ice bin in which the ice made in the ice-maker is stored may be disposed below the ice-maker in an extendable and retractable manner. In this connection, at least a portion of the ice-maker is received inside the ice bin, so that the space required for arranging the ice-maker and the ice bin is minimized, thereby maximizing a storage capacity of the freezing compartment.

Further, according to the present embodiment, the ice bin may be disposed in the freezing compartment, which is extendable and retractable, or may be separately extended and retracted. In this connection, the openings may be respectively defined in the rear faces of the ice bin and the freezing compartment drawer to prevent interference with the ice-maker. Thus, even when the ice-maker is in operation or the ice-full state detection lever is pivoting, the ice bin may be extended without the interference.

Further, according to the present embodiment, the ice-maker is configured to make the spherical ice. When the ice bin is extended and retracted in a state in which the spherical ice is stored therein, the ice may roll due to inertia and fall through the opening. In the present embodiment, the cover plate is disposed at the rear end of the ice-maker to shield the opening at a moment when the ice bin is extended or when the insertion of the ice bin is completed. Thus, the ice inside the ice bin may be prevented from falling.

Further, according to the present embodiment, although the cover plate has a structure that shields the opening, a number of holes may be defined in the cover plate to allow air inside the freezing compartment to pass through the cover plate and into the ice bin.

Further, according to the present embodiment, the plate ribs are formed along the perimeter of and inside the cover plate, so that the cover plate may be reinforced, and the spherical ice cubes may be prevented from breaking when the spherical ice cubes bump with each other repeatedly.

DESCRIPTION OF SPECIFIC EMBODIMENTS

Figure 1:
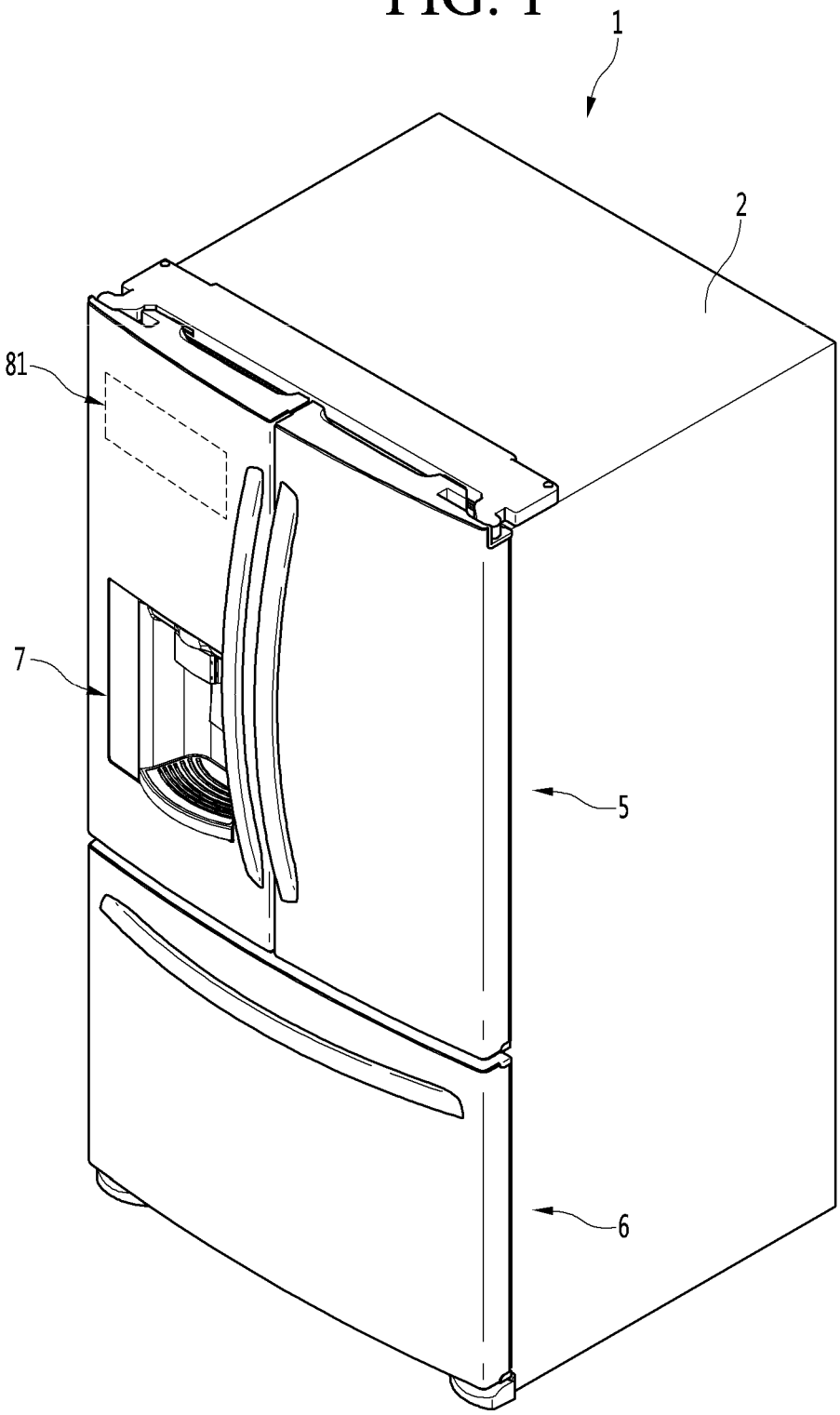
FIG. 1 is a perspective view of a refrigerator according to an embodiment of the present disclosure.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
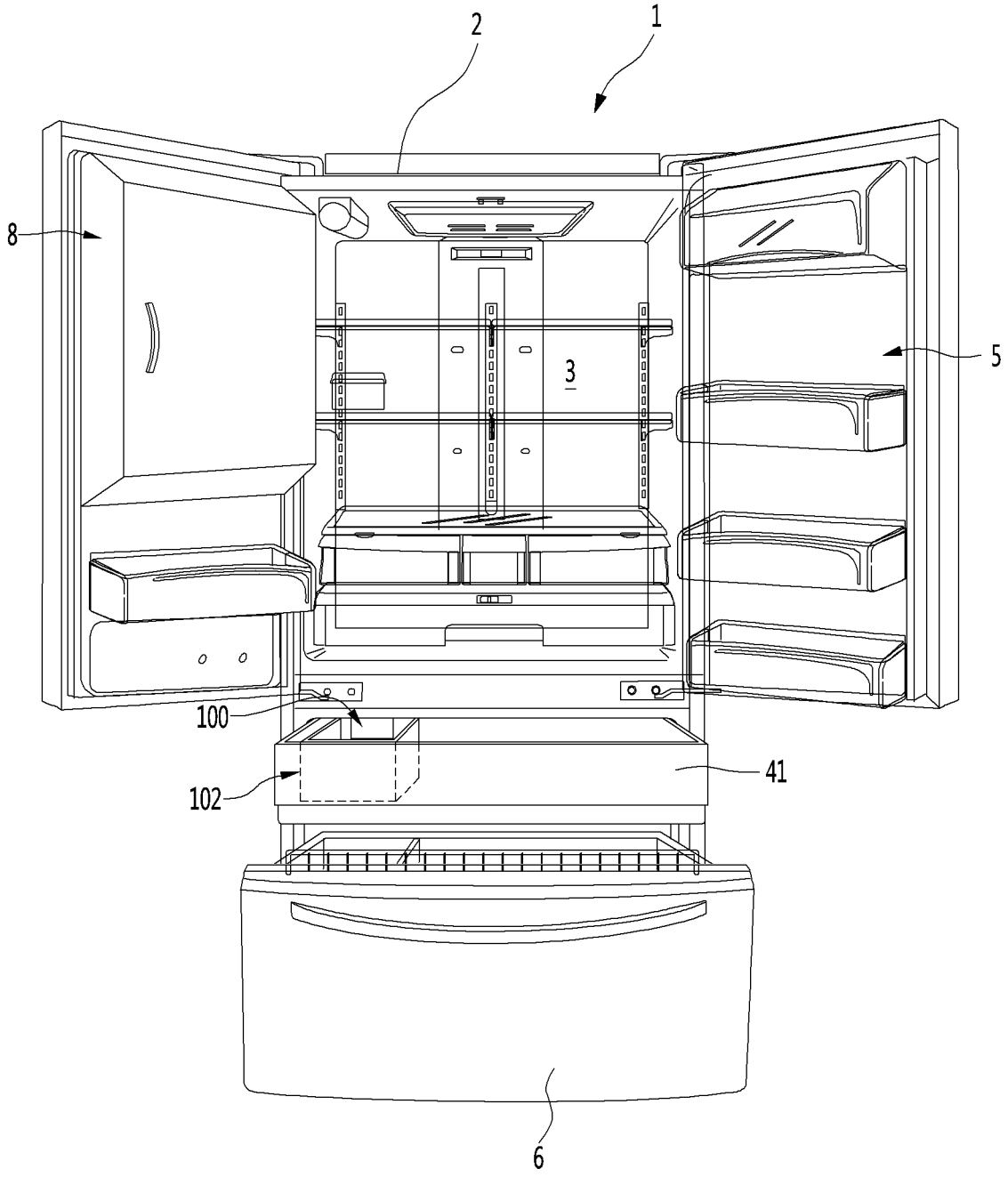
FIG. 2 is a view showing a state in which a door is opened.

FIG. 1 is a perspective view of a refrigerator according to an embodiment of the present disclosure. Further, FIG. 2 is a view showing a state in which a door is opened. Further, FIG. 3 is a partial enlarged view of an ice-maker according to an embodiment of the present disclosure.

For convenience of description and understanding, directions will be defined. Hereinafter, based on a bottom face on which the refrigerator is installed, a direction toward the bottom face may be referred to as a downward direction, and a direction toward a top face of a cabinet 2, which is opposite to the bottom face, may be referred to as an upward direction. Further, when an undefined direction is described, the direction may be described by being defined based on each drawing.

Figure 3:
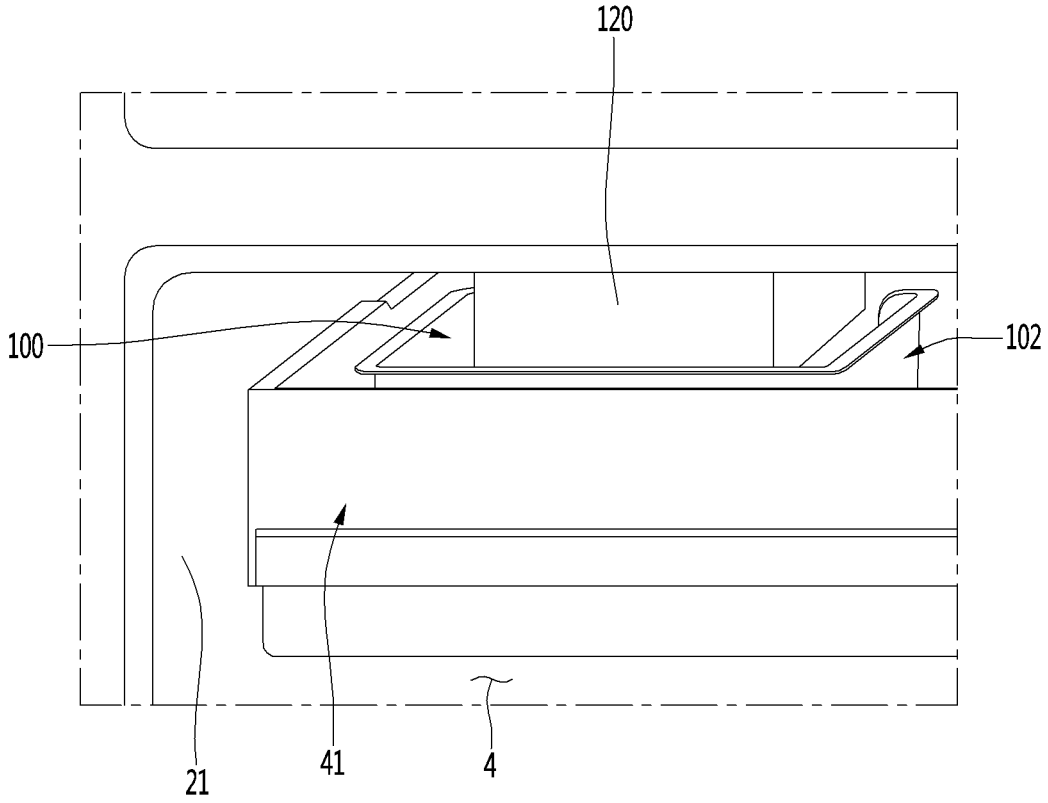
FIG. 3 is a partial enlarged view illustrating a state in which an ice-maker is mounted according to an embodiment of the present disclosure.

Referring to FIGS. 1 to 3, a refrigerator 1 according to an embodiment of the present disclosure may include a cabinet 2 for defining a storage space therein, and a door for opening and closing the storage space.

In detail, the cabinet 2 defines the storage space vertically divided by a barrier. A refrigerating compartment 3 may be defined at an upper portion of the storage space, and a freezing compartment 4 may be defined at a lower portion of the storage space.

An accommodation member such as a drawer, a shelf, a basket, and the like may be disposed in each of the refrigerating compartment 3 and the freezing compartment 4.

The door may include a refrigerating compartment door 5 shielding the refrigerating compartment 3 and a freezing compartment door 6 shielding the freezing compartment 4.

The refrigerating compartment door 5 includes a pair of left and right doors, which may be opened and closed by pivoting. Further, the freezing compartment door 6 may be disposed to be retractable or extendable like a drawer.

In another example, the arrangement of the refrigerating compartment 3 and the freezing compartment 4 and the shape of the door may be changed based on kinds of the refrigerators. However, the present disclosure may not be limited thereto, and may be applied to various kinds of refrigerators. For example, the freezing compartment 4 and the refrigerating compartment 3 may be arranged horizontally, or the freezing compartment 4 may be disposed above the refrigerating compartment 3.

In one example, one of the pair of refrigerating compartment doors 5 on both sides may have an ice-making chamber 8 defined therein for receiving a main ice-maker 81. The ice-making chamber 8 may receive cold-air from an evaporator (not shown) in the cabinet 2 to allow ice to be made in the main ice-maker 81, and may define an insulated space together with the refrigerating compartment 3. In another example, depending on a structure of the refrigerator, the ice-making chamber may be defined inside the refrigerating compartment 3 rather than the refrigerating compartment door 5, and the main ice-maker 81 may be disposed inside the ice-making chamber.

A dispenser 7 may be disposed on one side of the refrigerating compartment door 5, which corresponds to a position of the ice-making chamber 8. The dispenser 7 may be capable of dispensing water or ice, and may have a structure in communication with the ice-making chamber 8 to enable dispensing of ice made in the ice-maker 81.

In one example, the freezing compartment 4 may be equipped with an ice-maker 100. The ice-maker 100, which makes ice using water supplied, may produce ice in a spherical shape. The ice-maker 100 may be referred to as an auxiliary ice-maker because the ice-maker 100 usually generates less ice than the main ice-maker 81 or is used less than the main ice-maker 81.

The freezing compartment 4 may be equipped with a duct 44 for supplying cold-air to the freezing compartment 100. Thus, a portion of the cold-air generated in the evaporator and supplied to the freezing compartment 4 may be flowed toward the ice-maker 100 to make ice in an indirect cooling manner.

Further, an ice bin 102 in which the made ice is stored after being transferred from the ice maker 100 may be further provided below the ice maker 100. Further, the ice bin 102 may be disposed in a freezing compartment drawer 41 which is extended from the freezing compartment 4. Further, the ice bin 102 may be configured to be retracted and extended together with the freezing compartment drawer 41 to allow a user to take out the stored ice.

Thus, the ice-maker 100 and the ice bin 102 may be viewed as at least a portion of which is received in the freezing compartment drawer 41. Further, a large portion of the ice-maker 100 and the ice bin 102 may be hidden when viewed from the outside. Further, the ice stored in the ice bin 102 may be easily taken out by the retraction and extension of the freezing compartment drawer 41.

In another example, the ice made in the ice-maker 100 or the ice stored in the ice bin 102 may be transferred to the dispenser 7 by transfer means and dispensed through the dispenser 7.

In another example, the refrigerator 1 may not include the dispenser 7 and the main ice-maker 81, but include only the ice-maker 1. The ice-maker 100 may be disposed in the ice-making chamber 8 in place of the main ice-maker 81.

Hereinafter, the mounting structure of the ice-maker 100 will be described in detail with reference to the accompanying drawings.

Hereinafter, a mounting structure of the ice-maker 100 will be described in detail with reference to the accompanying drawings.

Figure 4:
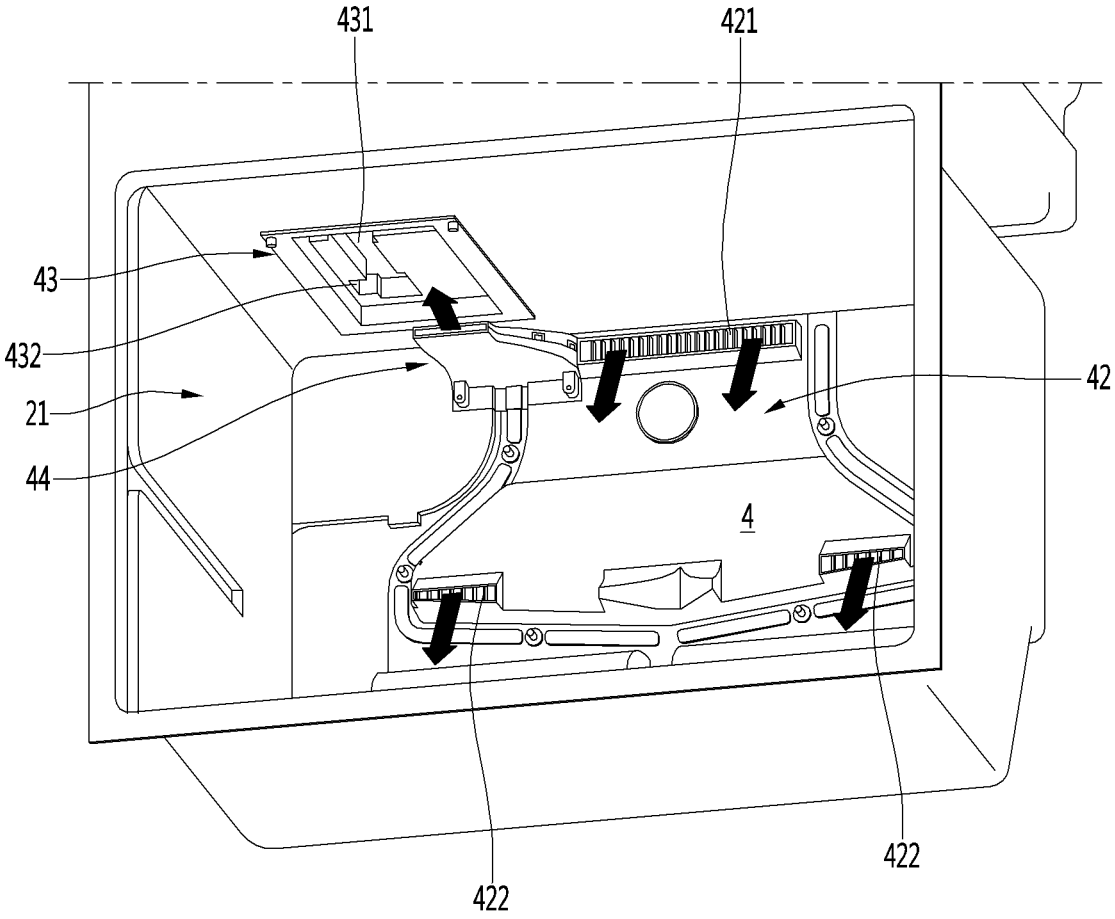
FIG. 4 is a partial perspective view illustrating an interior of a freezing compartment according to an embodiment of the present disclosure.

FIG. 4 is a partial perspective view illustrating an interior of a freezing compartment according to an embodiment of the present disclosure. Further, FIG. 5 is an exploded perspective view of a grill pan and an ice duct according to an embodiment of the present disclosure.

Figure 5:
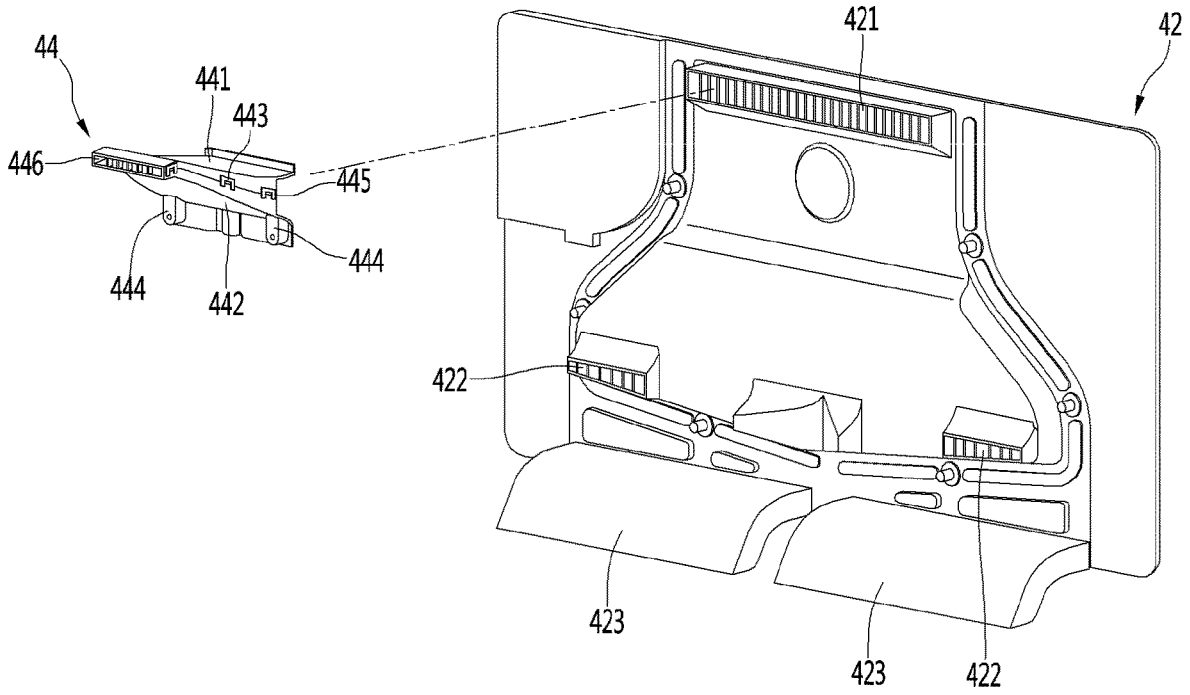
FIG. 5 is an exploded perspective view of a grill pan and an ice duct according to an embodiment of the present disclosure.

As shown in FIGS. 4 and 5, the storage space inside the cabinet 2 may be defined by an inner casing 21. Further, the inner casing 21 defines the vertically divided storage space, that is, the refrigerating compartment 3 and freezing compartment 4.

A portion of a top face of the freezing compartment 4 may be opened, and a mounting cover 43 may be formed at a position corresponding to a position where the ice-maker 100 is mounted. The mounting cover 43 may be coupled and fixed to the inner casing 21, and define a space further recessed upwardly from the top face of the freezing compartment 4 to secure a space in which the ice-maker 100 is disposed. Further, the mounting cover 43 may include a structure for fixing and mounting the ice-maker 100.

Further, the mounting cover 43 may further include a cover recess 431 defined therein, which may be further recessed upwards to receive an upper ejector 300 to be described below. Since the upper ejector 300 has a structure that protrudes upward from the top face of the ice-maker 100, the upper ejector 300 may be received in the cover recess 431 to minimize a space used by the ice-maker 100.

Further, the mounting cover 43 may have a water-supply hole 432 defined therein for supplying water to the ice-maker 100. Although not shown, a pipe for supplying the water toward the ice-maker 100 may penetrate the water-supply hole 432. Further, an electrical-wire in connection with the ice-maker 100 may pass through the mounting cover 43. Further, because of the connector connected to the electrical-wire, the ice-maker 100 may be in a state of being electrically connected and being able to be powered.

A rear wall face of the freezing compartment 4 may be formed by a grill pan 42. The grill pan 42 may divide the space in the inner casing 21 horizontally, and may define, at rearward of the freezing compartment, a space for receiving an evaporator (not shown) that generates the cold-air and a blower fan (not shown) that circulates the cold-air therein.

The grill pan 42 may include cold-air ejectors 421 and 422 and a cold-air absorber 423. Thus, the cold-air ejectors 421 and 422 and the cold-air absorber 423 may allow air circulation between the freezing compartment 4 and the space in which the evaporator is placed, and may cool the freezing compartment 4. The cold-air ejectors 421 and 422 may be formed in a grill shape. The cold-air may be evenly discharged into the freezing compartment 4 through the upper cold-air ejector 421 and the lower cold-air ejector 422.

In particular, the upper cold-air ejector 421 may be disposed at a top of the freezing compartment 4. Further, the cold-air discharged from the upper cold-air ejector 421 may be used to cool the ice-maker 100 and the ice bin 102 arranged at an upper portion of the freezing compartment 4.

In particular, the upper cold-air ejector 421 may include the cold-air duct 44 for supplying the cold-air to the ice-maker 100.

The cold-air duct 44 may connect the upper cold-air ejector 421 to the cold-air hole 134 of the ice-maker 100. That is, the cold-air duct 44 may connect the upper cold-air ejector 421 located at a center of the freezing compartment 4 in the horizontal direction and the ice-maker 100 located at an upper end of the freezing compartment 4, so that a portion of the cold-air discharged from the upper cold-air ejector 421 may be supplied directly into the ice-maker 100.

The cold-air duct 44 may be disposed at one end of the upper cold-air ejector 421 which extends in the horizontal direction. That is, the cold-air discharged from the upper cold-air ejector 421 is discharged to the freezing compartment 4, and cold-air discharged from one side close to the cold-air duct 44 of the cold-air may be directed to the ice-maker 100 through the cold-air duct 44.

Thus, a rear end of the cold-air duct 44 may be recessed to receive one end of the upper cold-air ejector 421. Further, an opened rear face of the cold-air duct 44 may be shaped in a shape corresponding to a shape of the grill pan 42, and may be in contact with the grill pan 42 to prevent the cold-air from leaking. Further, a coupled portion 444 may be formed at a rear end of the cold-air duct 44, and may be fixed to a front face of the grill pan 42 by a screw.

A cross-section of the cold-air duct 44 may decrease forwardly. Further, a duct outlet 446 on a front face of the cold-air duct 44 may be inserted into the cold-air hole 134 to concentrically supply the cold-air into the ice-maker 100.

In one example, the cold-air duct 44 may be constituted by an upper duct 443 forming an upper portion of the cold-air duct 44 and a lower duct 442 forming a lower portion of the cold-air duct 44, and may define a whole cold-air passage by coupling of the upper duct 443 and the lower duct 442. Further, the upper duct 443 and lower duct 442 may be coupled to each other by a connector 443. The connector 443, which has a hooking structure like a hook, may be formed on each of the upper duct 443 and the lower duct 442.

Figure 6:
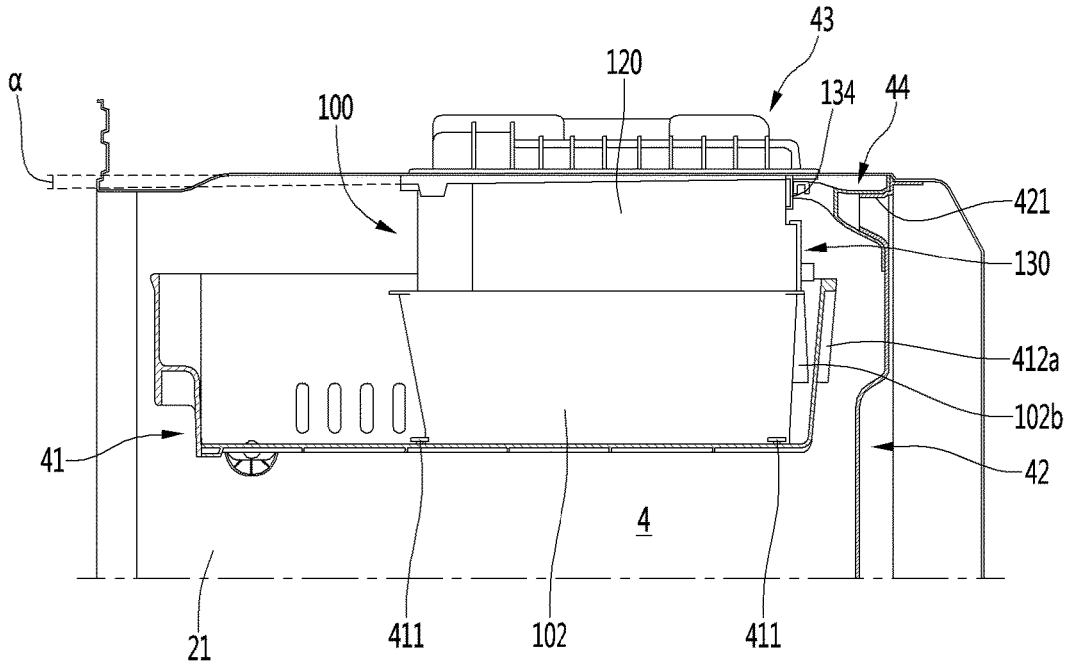
FIG. 6 is a cross-sectional side view of a freezing compartment in a state in which a freezing compartment drawer and an ice bin are retracted therein, according to an embodiment of the present disclosure.
Figure 7:
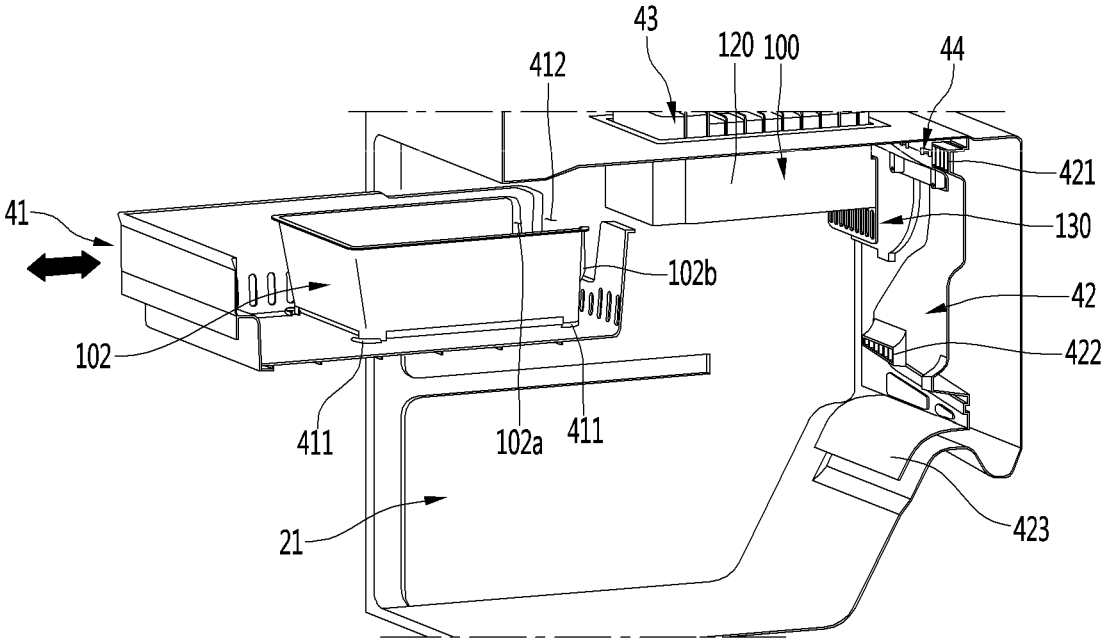
FIG. 7 is a partially-cut perspective view of a freezing compartment in a state in which a freezing compartment drawer and an ice bin are extended therefrom.

FIG. 6 is a cross-sectional side view of a freezing compartment in a state in which a freezing compartment drawer and an ice bin are retracted therein, according to an embodiment of the present disclosure. Further, FIG. 7 is a partially-cut perspective view of a freezing compartment in a state in which a freezing compartment drawer and an ice bin are extended therefrom.

As shown in the drawings, the ice-maker 100 may be mounted on the top face of the freezing compartment 4. That is, the upper casing 120, which forms an outer shape of the ice-maker 100, may be mounted on the mounting cover 43.

In one example, the refrigerator 1 is installed to be tilted such that a front end of the cabinet 2 is slightly higher than a rear end thereof, so that the door 6 may be closed by a self weight after opening. Thus, the top face of the freezing compartment 4 may also be tilted relative to a ground on which the refrigerator 1 is installed, at the same slope as the cabinet 2.

In this connection, when the ice-maker 100 is mounted flush with the top face of the freezing compartment 4, a water level of the water supplied inside the ice-maker 100 may also be tilted, which may result in a problem of a difference in a size of ice cubes respectively made in the chambers. In particular, in a case of the ice-maker 100 according to the present embodiment for making the spherical ice, when the water level is tilted, amounts of water received in the chambers are different from each other, so that a uniform spherical ice may not be made.

In order to avoid such problems, the ice-maker 100 may be mounted to be tilted relative to the top face of the freezing compartment 4, that is, based on top and bottom faces of the cabinet 2. In detail, the ice-maker 100 may be mounted to be in a state in which the top face of the upper casing 120 is pivoted counterclockwise (when viewed in FIG. 6) by a set angle $\alpha$ based on the top face of the freezing compartment 4 or the top face of the mounting cover 43. In this connection, the set angle $\alpha$ may be equal to the slope of the cabinet 2, and may be approximately 0.7° to 0.8°. Further, the front end of the upper casing 120 may be approximately 3 mm to 5 mm lower than the rear end thereof.

In a state of being mounted in the freezing compartment 4, the ice-maker 100 may be tilted by the set angle $\alpha$, so that the ice-maker 100 may be horizontal to the ground on which the refrigerator 1 is installed. Thus, the level of the water supplied into the ice-maker 100 may become level with the ground, and the same amount of water may be received in the plurality of chambers to make ice of uniform size.

Further, in a state in which the ice-maker 100 is mounted, the cold-air hole 134 at the rear end of the upper casing 120 may be connected to the upper cold-air ejector 421. Thus, the cold-air for the ice-making may be concentrically supplied to an inner upper portion of the upper casing 120 to increase an ice-making efficiency.

In one example, the ice bin 102 may be mounted inside the freezing compartment drawer 41. The ice bin 102 is positioned correctly below the ice-maker 100 in a state in which the freezing compartment drawer 41 is retracted. To this end, the freezing compartment drawer 41 may have a bin mounting guide 411 which guides a mounting position of the ice bin 102. The bin mounting guides 411 may respectively protrude upwardly from positions corresponding to four corners of the bottom face of the ice bin 102, and may be arranged to enclose the four corners of the bottom face of the ice bin 102. Thus, the ice bin 102 may remain in position in a state of being mounted in the freezing compartment drawer 41, and may be positioned vertically below the ice-maker 100 in a state in which the freezing compartment drawer 41 is retracted.

As shown in FIG. 6, a bottom of the ice-maker 100 may be received inside the ice bin 102 in a state in which the freezing compartment drawer 41 is retracted. That is, the bottom of the ice-maker 100 may be located inside the ice bin 102 and the freezing compartment drawer 41. Thus, the ice removed from the ice-maker 100 may fall and be stored in the ice bin 102. Further, a volume loss inside the freezing compartment 4 due to arrangement of the ice-maker 100 and the ice bin 102 may be minimized by minimizing the space between the ice-maker 100 and the ice bin 102. In another example, the bottom of the ice-maker 100 and the bottom face of the ice bin 102 may be spaced apart each other by an appropriate distance to ensure a distance for storing an appropriate amount of ice.

In one example, in a state in which the ice-maker 100 is mounted therein, the freezing compartment drawer 41 may be extended or retracted as shown in FIG. 7. Further, in this connection, at least a portion of rear faces of the ice bin 102 and the freezing compartment drawer 41 may be opened to prevent interference with the ice-maker 100.

In detail, a drawer opening 412 and a bin opening **102*a* may be respectively defined in the rear faces of the freezing compartment drawer 41 and the ice bin 102 corresponding to the position of the ice-maker 100. The drawer opening 412 and the bin opening 102*a* may be respectively defined at positions facing each other. Further, the drawer opening 412 and the bin opening 102***a* may be respectively defined to open from the top of the freezing compartment drawer 41 and the top of the ice bin 102 to positions lower than the bottom of the ice-maker 100.

Thus, even when the freezing compartment drawer 41 is extended in a state in which the ice-maker 100 is mounted therein, the ice-maker 100 may be prevented from interfering with the ice bin 102 and the freezing compartment drawer 41.

In particular, even in a state in which the ice-maker 100 removes the ice and the lower assembly 200 is pivoted, or in a state in which an ice-full state detection lever 700 is pivoted to detect an ice-full state, the drawer opening 412 and the bin opening 102*a* may be in a shape of being recessed further downward from the bottom of the ice-maker 100 to prevent interference with the freezing compartment drawer 41 or the ice bin 102.

A drawer opening guide 412*a* extending rearward along a perimeter of the drawer opening 412 may be formed. The drawer opening guide 412*a* may extend rearward to guide the cold-air flowing downward from the upper cold-air ejector 421 into the freezing compartment drawer 41.

Further, a bin opening guide 102*b* extending rearward along a perimeter of the bin opening 102*a* may be included. The cold-air flowing downward from the upper cold-air ejector 421 may flow into the ice bin 102 through the bin opening guide 102*b*.

In one example, a cover casing 130 in a plate shape may be disposed on a rear face of the upper casing 120 of the ice-maker 100. The cover plate 130 may be formed to cover at least a portion of the ice bin opening 102*a* such that the ice inside the ice bin 102 does not fall downward through the bin opening 102*a* and the drawer opening 412.

The cover plate 130 extends downward from a rear face of the upper casing 120 of the ice-maker 100 and may extend into the bin opening 102*a*. As shown in FIG. 6, in a state in which the freezing compartment drawer 41 is retracted, the cover plate 130 is positioned inside the bin opening 102*a* to cover at least a portion of the bin opening 102*a*. Thus, even when the ice is moved backwards by inertia at the moment the freezing compartment drawer 41 is extended or retracted, the ice may be blocked by the cover plate 130, and prevented from falling out of the ice bin 102.

Further, the cover plate 130 may have a plurality of openings defined therein to allow the cold-air to pass therethrough. Thus, in a state in which the freezing compartment drawer 41 is closed as shown in FIG. 6, the cold-air may pass through the cover plate 130 and flow into the ice bin 102.

The cover plate 130 may be formed to have a size for not interfering with the drawer opening 412 and the bin opening 102*a*. Thus, the cover plate 130 may not interfere with the freezing compartment drawer 41 or the ice bin 102 when the freezing compartment drawer 41 is extended as shown in FIG. 7.

The cover plate 130 may be molded separately and joined to the upper casing 120 of the ice-maker 100. Alternatively, the rear face of the upper casing 120 may protrude further downward to form the cover plate 130.

Hereinafter, the ice-maker 100 will be described in detail with reference to the accompanying drawings.

Figure 8:
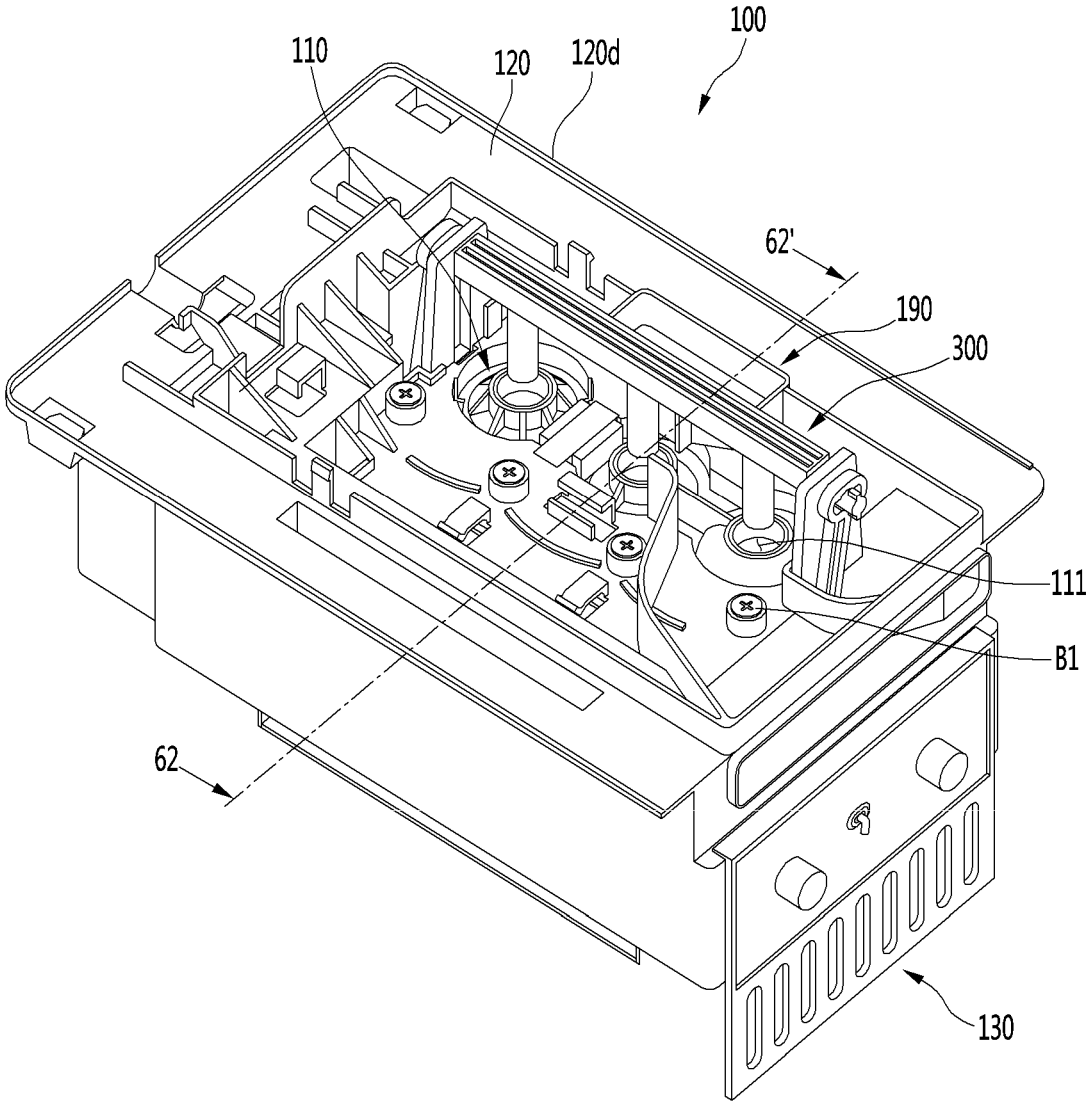
FIG. 8 is a perspective view of an ice-maker viewed from above.
Figure 9:
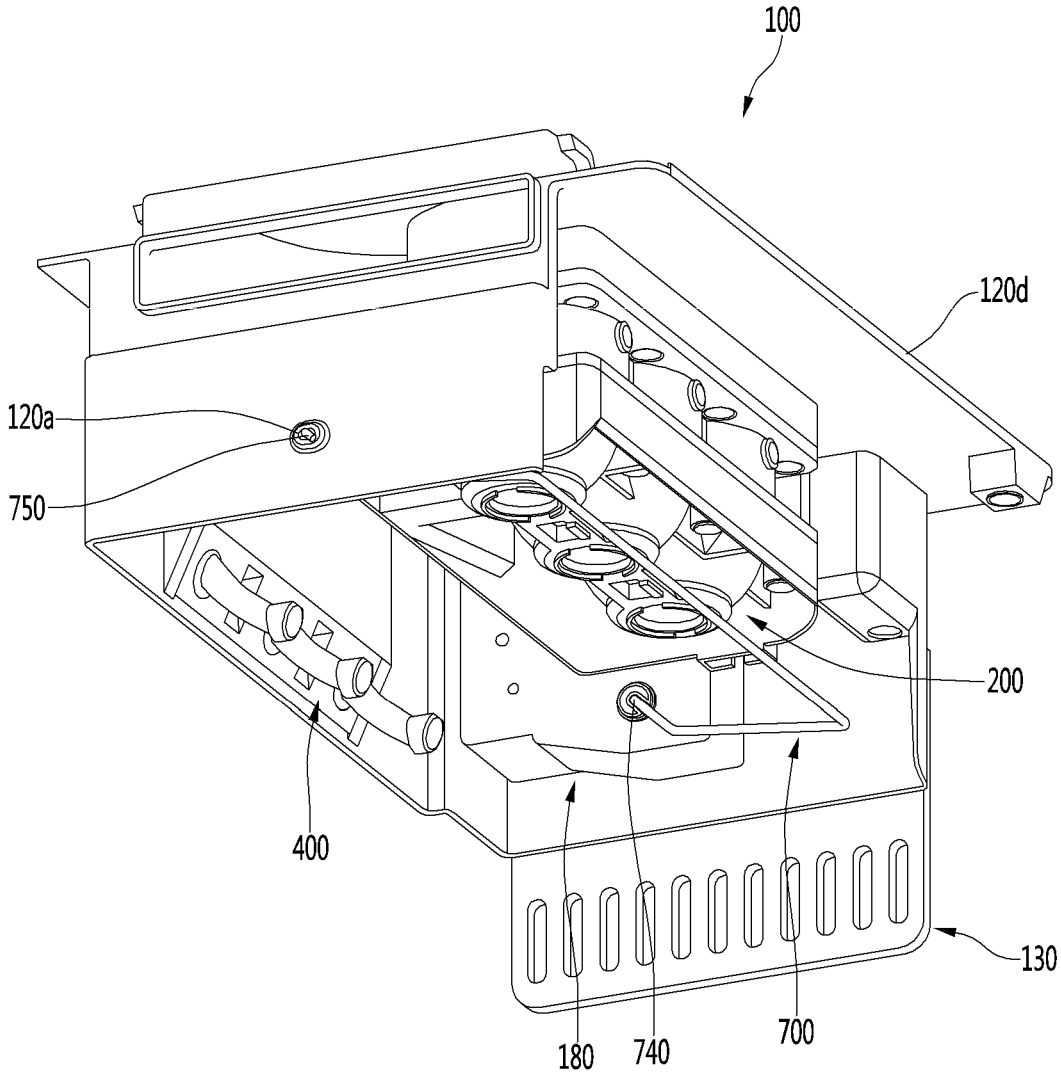
FIG. 9 is a perspective view of a lower portion of an ice-maker viewed from one side.

FIG. 8 is a perspective view of an ice-maker viewed from above. Further, FIG. 9 is a perspective view of a lower portion of an ice-maker viewed from one side. Further, FIG. 10 is an exploded perspective view of an ice-maker.

Figure 10:
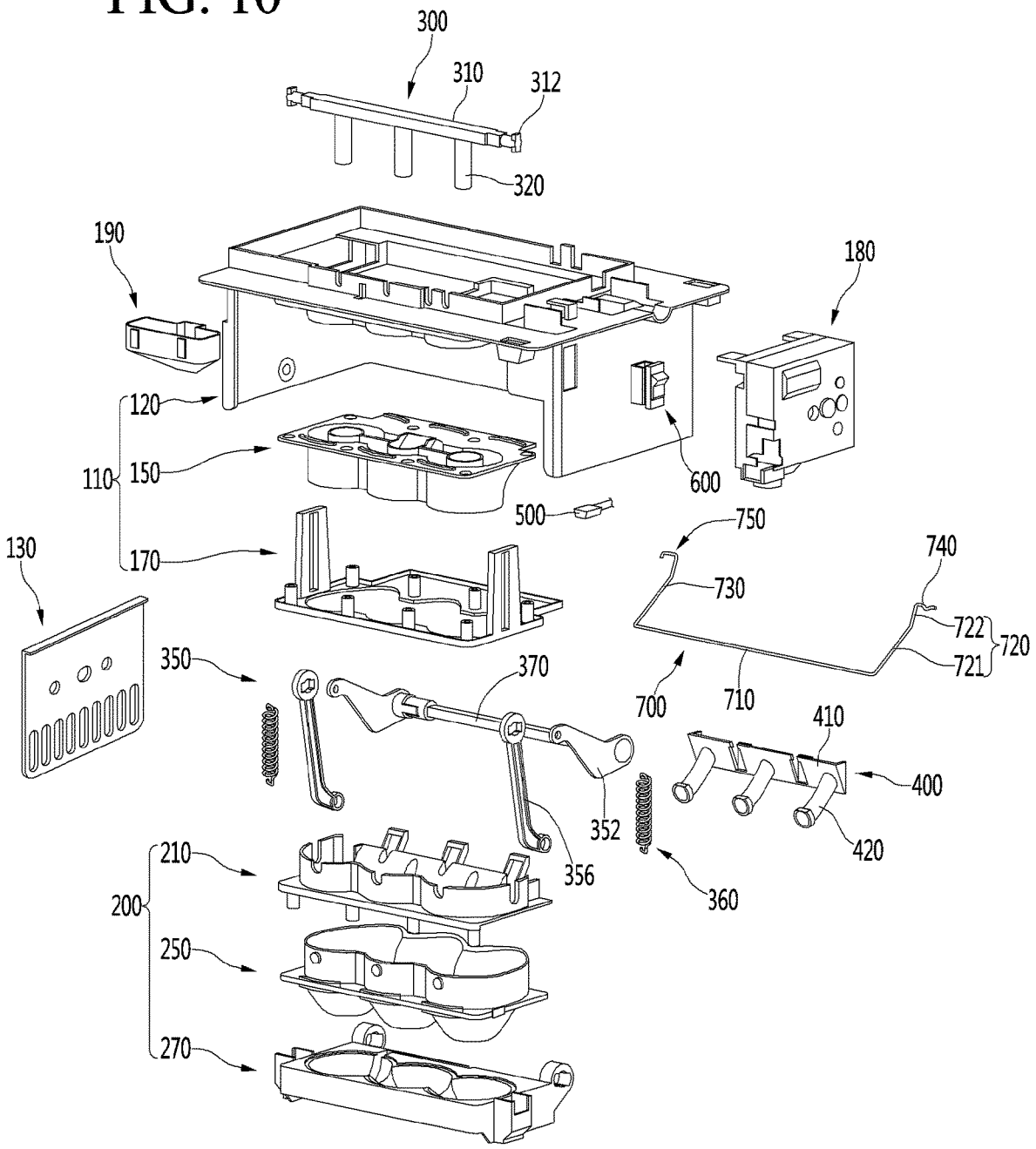
FIG. 10 is an exploded perspective view of an ice-maker.

Referring to FIGS. 8 to 10, the ice-maker 100 may include an upper assembly 110 and a lower assembly 200.

The lower assembly 200 may be fixed to the upper assembly 110 such that one end thereof is pivotable. The pivoting may open and close an inner space defined by the lower assembly 200 and the upper assembly 110.

In detail, the lower assembly 200 may make the spherical ice together with the upper assembly 110 in a state in which the lower assembly 200 is in close contact with the upper assembly 110.

That is, the upper assembly 110 and the lower assembly 200 define an ice chamber 111 for making the spherical ice. The ice chamber 111 is substantially a spherical chamber. The upper assembly 110 and the lower assembly 200 may define a plurality of divided ice chambers 111. Hereinafter, an example in which three ice chambers 111 are defined by the upper assembly 110 and the lower assembly 200 will be described. Note that there is no limit to the number of ice chambers 111.

In a state in which the upper assembly 110 and the lower assembly 200 define the ice chamber 111, the water may be supplied to the ice chamber 111 via a water supply 190. The water supply 190 is coupled to the upper assembly 110, and direct the water supplied from the outside to the ice chamber 111.

After the ice is made, the lower assembly 200 may pivot in a forward direction. Then, the spherical ice made in the space between the upper assembly 110 and the lower assembly 200 may be separated from the upper assembly 110 and the lower assembly 200, and may fall to the ice bin 102.

In one example, the ice-maker 100 may further include a driver 180 such that the lower assembly 200 is pivotable relative to the upper assembly 110.

The driver 180 may include a driving motor and a power transmission for transmitting power of the driving motor to the lower assembly 200. The power transmission may include at least one gear, and may provide a suitable torque for the pivoting of the lower assembly 200 by a combination of the plurality of gears. Further, the ice-full state detection lever 700 may be connected to the driver 180, and the ice-full state detection lever 700 may be pivoted by the power transmission.

The driving motor may be a bidirectionally rotatable motor. Thus, bidirectional pivoting of the lower assembly 200 and ice-full state detection lever 700 is achieved.

The ice-maker 100 may further include an upper ejector 300 such that the ice may be separated from the upper assembly 110. The upper ejector 300 may cause the ice in close contact with the upper assembly 110 to be separated from the upper assembly 110.

The upper ejector 300 may include an ejector body 310 and at least one ejecting pin 320 extending in a direction intersecting the ejector body 310. The ejecting pin 320 may include ejecting pins of the same number as the ice chamber 111, and each ejecting pin may remove ice made in each ice chamber 111.

The ejecting pin 320 may press the ice in the ice chamber 111 while passing through the upper assembly 110 and being inserted into the ice chamber 111. The ice pressed by the ejecting pin 320 may be separated from the upper assembly 110.

Further, the ice-maker 100 may further include a lower ejector 400 such that the ice in close contact with the lower assembly 200 may be separated therefrom. The lower ejector 400 may press the lower assembly 200 such that the ice in close contact with the lower assembly 200 is separated from the lower assembly 200.

An end of the lower ejector 400 may be located within a pivoting range of the lower assembly 200, and may press an outer side of the ice chamber 111 to remove the ice in the pivoting process of the lower assembly 200. The lower ejector 400 may be fixedly mounted to the upper casing 120.

In one example, a pivoting force of the lower assembly 200 may be transmitted to the upper ejector 300 in the pivoting process of the lower assembly 200 for ice-removal. To this end, the ice-maker 100 may further include a connector 350 connecting the lower assembly 200 and the upper ejector 300 with each other. The connector 350 may include at least one link.

In one example, the connector 350 may include pivoting arms 351 and 352 and a link 356. The pivoting arms 351 and 352 may be connected to the driver 180 together with the lower support 270 and pivoted together. Further, ends of the pivoting arms 351 and 352 may be connected to the lower support 270 by an elastic member 360 to be in close contact with the upper assembly 110 in a state in which the lower assembly 200 is closed.

The link 356 connects the lower support 270 with the upper ejector 300, so that the pivoting force of the lower support 270 may be transmitted to the upper ejector 300 when the lower support 270 pivots. The upper ejector 300 may move vertically in association with the pivoting of the lower support 270 by the link 356.

In one example, when the lower assembly 200 pivots in the forward direction, the upper ejector 300 may descend by the connector 350, so that the ejecting pin 320 may press the ice. On the other hand, during when the lower assembly 200 pivots in a reverse direction, the upper ejector 300 may ascend by the connector 350 to return to an original position thereof.

Hereinafter, the upper assembly 110 and the lower assembly 200 will be described in more detail.

The upper assembly 110 may include an upper tray 150 that forms an upper portion of the ice chamber 111 for making the ice. Further, the upper assembly 110 may further include the upper casing 120 and an upper support 170 to fix the upper tray 150.

The upper tray 150 may be positioned below the upper casing 120, and the upper support 170 may be positioned below the upper tray 150. As such, the upper casing 120, the upper tray 150, and the upper support 170 may be arranged in the vertical direction one after the other, and may be fastened by a fastener and formed as a single assembly. That is, the upper tray 150 may be fixedly mounted between the upper casing 120 and the upper support 170 by the fastener. Thus, the upper tray 150 may be maintained at a fixed position, and may be prevented from being deformed or separated from the upper assembly 110.

In one example, the water supply 190 may be disposed at an upper portion of the upper casing 120. The water supply 190 is for supplying the water into the ice chamber 111, which may be disposed to face the ice chamber 111 from above the upper casing 120.

Further, the ice-maker 100 may further include a temperature sensor 500 for sensing a temperature of the water or the ice in the ice chamber 111. The temperature sensor 500 may indirectly sense the temperature of the water or the ice in the ice chamber 111 by sensing a temperature of the upper tray 150.

The temperature sensor 500 may be mounted on the upper casing 120. Further, at least a portion of the temperature sensor 500 may be exposed through the opened side of the upper casing 120.

In one example, the lower assembly 200 may include a lower tray 250 that forms a lower portion of the ice chamber 111 for making the ice. Further, the lower assembly 200 may further include a lower support 270 supporting a lower portion of the lower tray 250 and a lower casing 210 covering an upper portion of the lower tray 250.

The lower casing 210, lower tray 250, and the lower support 270 may be arranged in the vertical direction one after the other, and may be fastened by a fastener and formed as a single assembly.

In one example, the ice-maker 100 may further include a switch 600 for turning the ice-maker 100 on or off. The switch 600 may be disposed on a front face of the upper casing 120. Further, when the user manipulates the switch 600 to be turned on, the ice may be made by the ice-maker 100. That is, when the switch 600 is turned on, operations of components, including the ice-maker, for ice-making may be started. That is, when the switch 600 is turned on, the water is supplied to the ice-maker 100, and an ice-making process in which the ice is made by the cold-air and an ice-removal process in which the lower assembly 200 is pivoted and the ice is removed may be repeatedly performed.

On the other hand, when the switch 600 is manipulated to be turned off, the components for the ice-making, including the ice-maker 100, will remain inactive and will not be able to made the ice through the ice-maker 100.

Further, the ice-maker 100 may further include the ice-full state detection lever 700. The ice-full state detection lever 700 may detect whether the ice bin 102 is in the ice-full state while receiving the power of the driver 180 and pivoting.

One side of the ice-full state detection lever 700 may be connected to the driver 180 and the other side of the ice-full state detection lever 700 may be pivotably connected to the upper casing 120, so that the ice-full state detection lever 700 may pivot based on the operation of the driver 180.

The ice-full state detection lever 700 may be positioned below an axis of pivoting of the lower assembly 200, so that the ice-full state detection lever 700 does not interfere with the lower assembly 200 during the pivoting of the lower assembly 200. Further, both ends of the ice-full state detection lever 700 may be bent many times. The ice-full state detection lever 700 may be pivoted by the driver 180, and may detect whether a space below the lower assembly 200, that is, the space inside the ice bin 102 is in the ice-full state.

In one example, an internal structure of the driver 180 is not shown in detail, but will be briefly described for the operation of the ice-full state detection lever 700. The driver 180 may further include a cam rotated by the rotational power of the motor and a moving lever moving along a cam face. A magnet may be provided on the moving lever. The driver 180 may further include a hall sensor that may detect the magnet when the moving lever moves.

A first gear to which the ice-full state detection lever 720 is engaged among a plurality of gears of the driver 180 may be selectively engaged with or disengaged from a second gear that engages with the first gear. In one example, the first gear is elastically supported by the elastic member, so that the first gear may be engaged with the second gear when no external force is applied thereto.

On the other hand, when a resistance greater than an elastic force of the elastic member is applied to the first gear, the first gear may be spaced apart from the second gear.

A case in which the resistance greater than the elastic force of the elastic member is applied to the first gear is, for example, a case in which the ice-full state detection lever 700 is caught in the ice in the ice-removal process (in the case of the ice-full state). In this case, the first gear may be spaced apart from the second gear, so that breakage of the gears may be prevented.

The ice-full state detection lever 700 may be pivoted together in association with the lower assembly 200 by the plurality of gears and the cam. In this connection, the cam may be connected to the second gear or may be linked to the second gear.

Depending on whether the hall sensor senses the magnet, the hall sensor may output first and second signals that are different outputs. One of the first signal and the second signal may be a high signal, and the other may be a low signal.

The ice-full state detection lever 700 may be pivoted from a standby position to an ice-full state detection position for the ice-full state detection. Further, the ice-full state detection lever 700 may identify whether the ice bin 102 is filled with the ice of equal to or greater than the predetermined amount while passing through an inner portion of the ice bin 102 in the pivoting process.

Hereinafter, the ice-full state detection lever 700 will be described in more detail with reference to FIG. 10.

The ice-full state detection lever 700 may be a lever in a form of a wire. That is, the ice-full state detection lever 700 may be formed by bending a wire having a predetermined diameter a plurality of times.

The ice-full state detection lever 700 may include a detection body 710. The detection body 710 may pass a position of a set vertical level inside the ice bin 102 in the pivoting process of the ice-full state detection lever 700, and may be substantially the lowest portion of the ice-full state detection lever 700.

Further, the ice-full state detection lever 700 may be positioned such that an entirety of the detection body 710 is located below the lower assembly 200 to prevent the interference between the lower assembly 220 and the detection body 710 in the pivoting process of the lower assembly 200.

The detection body 710 may be in contact with the ice in the ice bin 102 in the ice-full state of the ice bin 102. The ice-full state detection lever 700 may include the detection body 710. The detection body 710 may extend in a direction parallel to a direction of extension of the connection shaft 370. The detection body 710 may be positioned lower than a lowest point of the lower assembly 200 regardless of the position.

Further, the ice-full state detection lever 700 may include a pair of extensions 720 and 730 respectively extending upward from both ends of the detection body 710. The pair of extensions 720 and 730 may extend substantially in parallel with each other.

A distance between the pair of extensions 720 and 730, that is, a length of the detection body 710 may be larger than a horizontal length of the lower assembly 200. Thus, in the pivoting process of the ice-full state detection lever 700 and the pivoting process of the lower assembly 200, the pair of extensions 720 and 730 and the detection body 710 may be prevented from interfering with the lower assembly 200.

The pair of extensions 720 and 730 may include a first extension 720 extending to a lever receiving portion 187 of the driver 180 and a second extension 710 extending to the lever receiving hole 120*a* of the upper casing 120. The pair of extensions 720 and 730 may be bent at least once, so that the ice-full state detection lever 700 is not deformed even after repeated contact with the ice and maintains a more reliable detection state.

For example, the extensions 720 and 730 may include a first bent portion 721 extending from each of both ends of the detection body 710 and a second bent portions 722 extending from each of ends of the first bent portions 721 to the driver 180. Further, the first bent portion 721 and second bent portion 722 may be bent at a predetermined angle. The first bent portion 721 and the second bent portion 722 may intersect with each other at an angle in a range approximately from 140° to 150°. Further, a length of the first bent portion 721 may be larger than a length of the second bent portion 722. Due to such structure, the ice-full state detection lever 700 may reduce a radius of pivoting, and may detect the ice in the ice bin 102 while minimizing interference with other components.

Further, a pair of inserted portions 740 and 750, which are respectively bent outwardly, may be formed at top of the pair of extensions 720 and 730, respectively. The pair of inserted portions 740 and 750 may include a first inserted portion 740 that is bent at the end of the first extension 720 and inserted into the lever receiving portion 187 and a second inserted portion 750 that is bent at the end of the second extension 710 and inserted into the lever receiving hole 120*a*. The first inserted portion 740 and second inserted portion 750 may be formed to be respectively coupled to and pivotably inserted into the lever receiving portion 187 and the lever receiving hole 120*a*.

That is, the first inserted portion 740 may be coupled to the driver 180 and pivoted by the driver 180, and the second inserted portion 750 may be pivotably coupled to the lever receiving hole 120*a*. Thus, the ice-full state detection lever 700 may be pivoted based on the operation of the driver 180, and may detect whether the ice bin 102 is in the ice-full state.

In one example, the ice-maker 100 may be equipped with the cover plate 130.

Hereinafter, a structure of the cover plate 130 will be described in detail with reference to the accompanying drawings.

Figure 11:
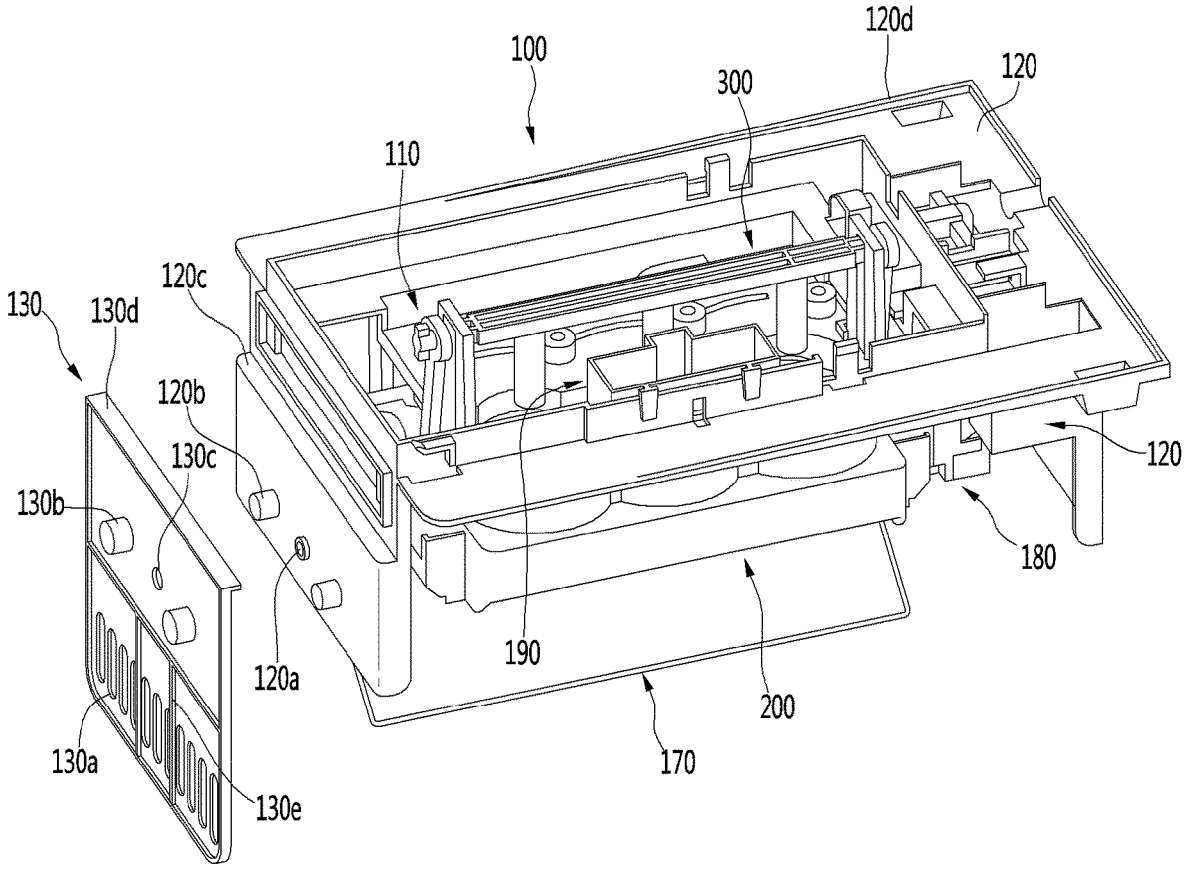
FIG. 11 is an exploded perspective view showing a coupling structure of an ice-maker and a cover plate.

FIG. 11 is an exploded perspective view showing a coupling structure of an ice-maker and a cover plate.

Referring to FIGS. 6, 7, and 11, the lever receiving hole 120*a* may be defined in one face of the upper casing 120, and a pair of bosses 120*b* may respectively protrude from both left and right sides of the lever receiving hole 120*a*. Further, a stepped plate seat 120*c* may be formed above the pair of bosses 120*b*. In this connection, one face of the upper casing 120 in which the lever receiving hole 120*a* is defined and on which the plate seat 120*c* is formed is a face adjacent to the rear face of the freezing compartment 4 as shown in FIGS. 6 and 7. Further, the cover plate 130 may be coupled to said one face of the upper casing 120.

The cover plate 130 may be formed in a rectangular plate shape, and may be formed to have a width corresponding to a width of the upper casing 120. Further, the cover plate 130 extends further below the bottom of the upper casing 120, and may extend to cover a large portion of the bin opening 102*a* when the freezing compartment drawer 41 is closed.

A plate bent portion 130*d* may be formed at a top of the cover plate 130, and the plate bent portion 130*d* may be seated on the plate seat 120*c*. Further, the cover plate 130 may be formed with an exposing opening 130*c* defined therein exposing the lever receiving hole 120*a* and the second inserted portion 750. The second inserted portion 750 is not interfered by the exposing opening 130*c* when the ice-full state detection lever 700 is pivoted, thereby ensuring the operation of the ice-full state detection lever 700.

Further, boss-receiving portions 130*b* may protrude from left and right sides of the exposing opening 130*c*, respectively. The boss-receiving portions 130*b* are shaped to respectively accommodate the pair of the bosses 120*b* protruding from the upper casing 120. Further, the boss-receiving portion 130*b* and the boss 120*b* may be coupled with each other by a fastener such as the screw fastened to the boss-receiving portion 130*b*, and the cover plate 130 may be fixed.

In one example, a plurality of ventilation holes 130*a* may be defined at a lower portion of the cover plate 130. The ventilation holes 130*a* may be defined in series, and the lower portion of the cover plate 130 may be shaped like a grill. The ventilation hole 130*a* may extend vertically, and may extend from a bottom of the upper casing 120 to a bottom of the cover plate 130. Therefore, the cold-air may be smoothly flowed into the ice bin 102 by the ventilation holes 130*a*.

Further, the cover plate 130 may be formed with a plate rib 130*e*.

The plate rib 130*e* is for reinforcing the cover plate 130, which may be formed along the perimeter of the cover plate 130. Further, the plate rib 130*e* may be formed to cross the cover plate 130 and may be formed between the ventilation holes 130*a*.

A sufficient strength of the cover plate 130 may be ensured by the plate rib 130*e*. Thus, when the freezing compartment drawer 41 is extended and retracted to be opened and closed, the cover plate 130 may prevent the ice inside the ice bin 102 from rolling and passing through the bin opening 102*a*. In this connection, the cover plate 130 may not be deformed or damaged from an impact of the ice.

The ice made in the present embodiment, which is substantially spherical or nearly spherical in shape, inevitably rolls or moves inside the ice bin 102. Accordingly, such structure of the cover plate 130 may prevent the spherical ice from falling out of the ice bin 102. Further, the cover plate 130 is formed so as not to block the flow of the cold-air into the ice bin 102.

In one example, the cover plate 130 may be molded separately and mounted on the upper casing 120. In another example, if necessary, one side of the upper casing 120 may be extended to have a shape corresponding to that of the cover plate 130.

Hereinafter, a structure of the upper casing 120 constituting the ice-maker 100 will be described in detail with reference to the accompanying drawings.

Figure 12:
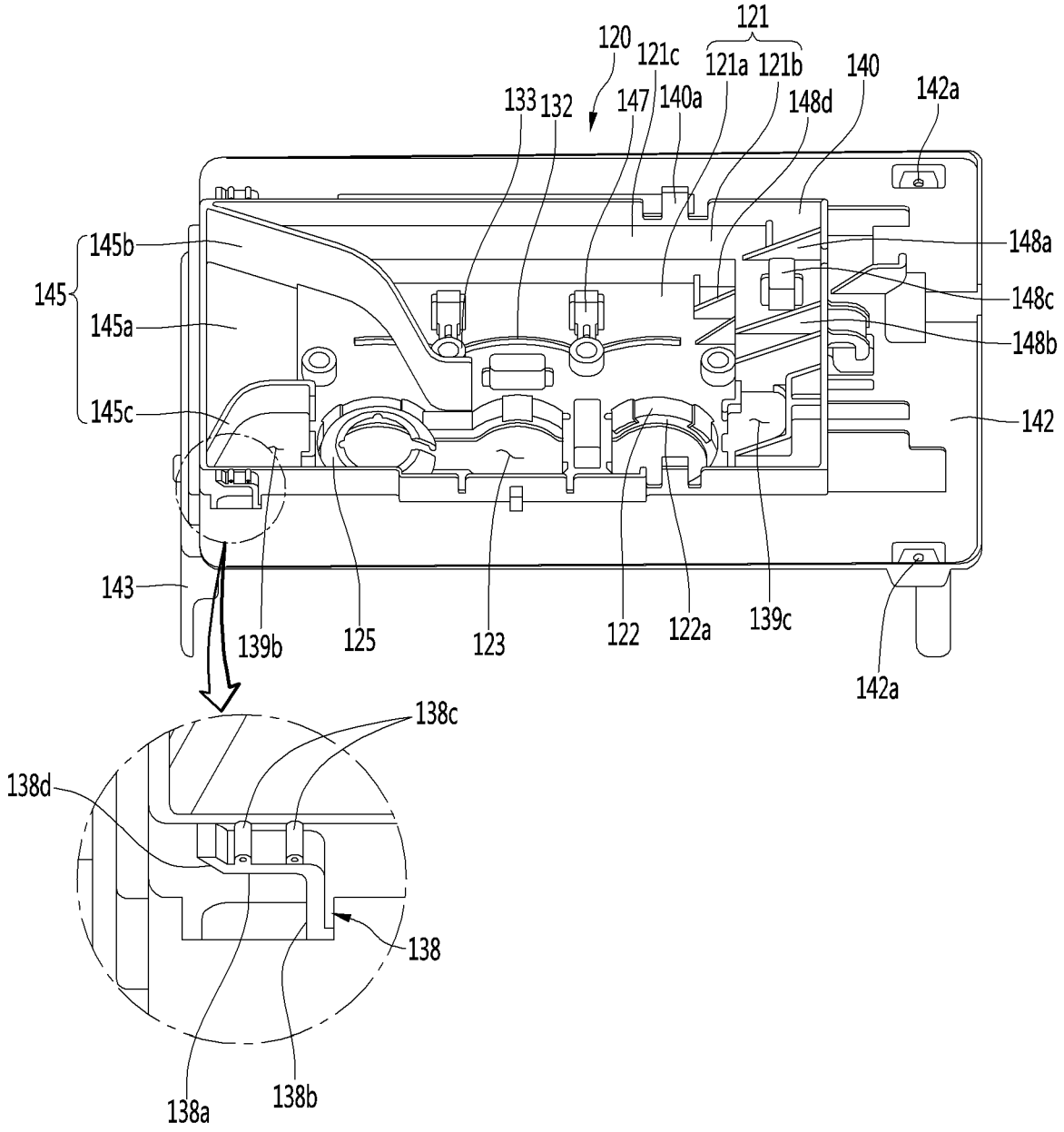
FIG. 12 is a perspective view of an upper casing according to an embodiment of the present disclosure viewed from above.
Figure 13:
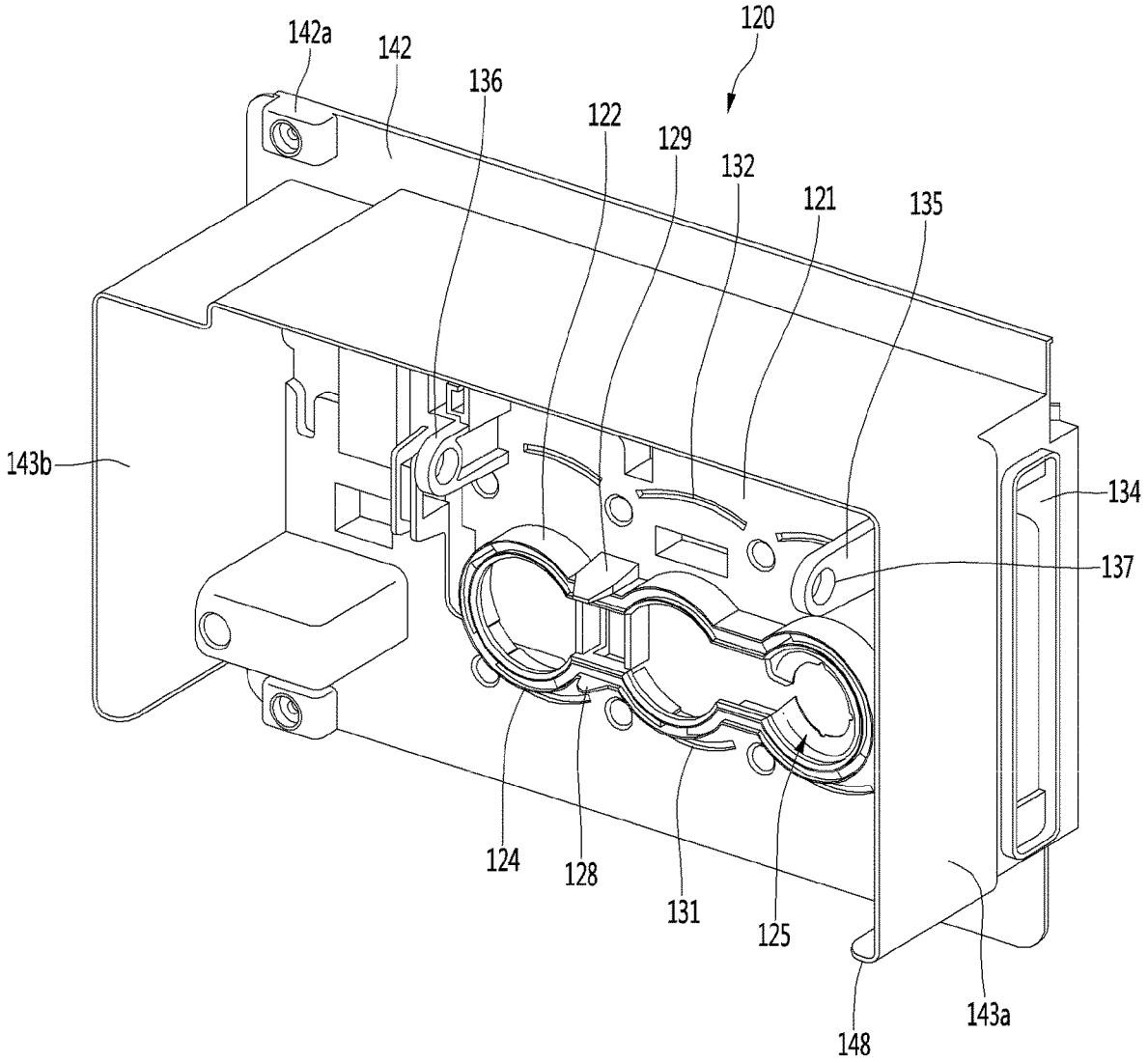
FIG. 13 is a perspective view of an upper casing viewed from below.

FIG. 12 is a perspective view of an upper casing according to an embodiment of the present disclosure viewed from above. Further, FIG. 13 is a perspective view of an upper casing viewed from below. Further, FIG. 14 is a side view of an upper casing.

Figure 14:
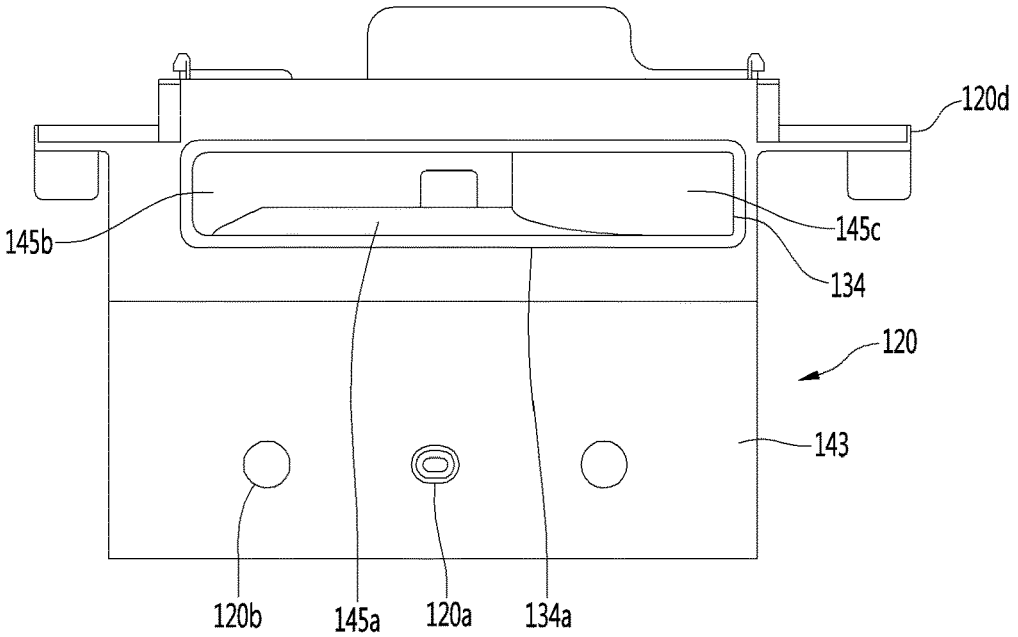
FIG. 14 is a side view of an upper casing.

Referring to FIGS. 12 to 14, the upper casing 120 may be fixedly mounted to the top face of the freezing compartment 4 in a state in which the upper tray 150 is fixed.

The upper casing 120 may include an upper plate 121 for fixing the upper tray 150. The upper tray 150 may be disposed on a bottom face of the upper plate 121, and the upper tray 150 may be fixed to the upper plate 121. The upper plate 121 may have a tray opening 123 defined therein through which a portion of the upper tray 150 passes. Further, a portion of a top face of the upper tray 150 may pass through the tray opening 123 and exposed. The tray opening 123 may be defined along an array of the plurality of ice chambers 111.

The upper plate 121 may include a cavity 122 recessed downwardly from the upper plate 121. A tray opening 123 may be defined in a bottom 122*a* of the cavity 122.

When the upper tray 150 is mounted on the upper plate 121, a portion of the top face of the upper tray 150 may be located inside the space where the cavity 122 is defined, and may pass through the tray opening 123 and protrude upward.

A heater-mounted portion 124 in which an upper heater 148 for heating the upper tray 150 for ice-removal may be defined in the upper casing 120. The heater-mounted portion may be defined in the bottom of the cavity 122.

Further, the upper casing 120 may further include a pair of sensor-fixing ribs 128 and 129 for mounting the temperature sensor 500. The pair of sensor-fixing ribs 128 and 129 may be spaced apart from each other, and the temperature sensor 500 may be located between the pair of sensor-fixing ribs 128 and 129. The pair of sensor-fixing ribs 128 and 129 may be provided on the upper plate 121.

The upper plate 121 may have a plurality of slots 131 and a plurality of slots 132 defined therein for coupling with the upper tray 150. Portions of the upper tray 150 may be inserted into the plurality of slots 131 and the plurality of slots 132. The plurality of slots 131 and the plurality of slots 132 may include a first upper slot 131 and a second upper slot 132 positioned opposite to the first upper slot 131 around the tray opening 123.

The first upper slot 131 and the second upper slot 132 may be arranged to face each other, and the tray opening 123 may be located between the first upper slot 131 and the second upper slot 132.

The first upper slot 131 and the second upper slot 132 may be spaced apart from each other with the tray opening 123 therebetween. Further, each of the plurality of the first upper slots 131 and each of the plurality of second upper slots 132 may be spaced apart from each other along a direction in which the ice chambers 111 are successively arranged.

The first upper slot 131 and the second upper slot 133 may be defined in a curved shape. Thus, the first upper slot 131 and second upper slot 132 may be defined along a periphery of the ice chamber 111. Such structure may allow the upper tray 150 to be more firmly fixed to the upper casing 120. In particular, deformation of dropout of the upper tray 150 may be prevented by fixing the periphery of the ice chamber 111 of the upper tray 150.

A distance from the first upper slot 131 to the tray opening 123 may differ from a distance from the second upper slot 132 to the tray opening 123. In one example, the distance from the second upper slot 132 to the tray opening 123 may be shorter than the distance from the first upper slot 131 to the tray opening 123.

The upper plate 121 may further include a sleeve 133 for inserting a coupling boss 175 of the upper support 170 to be described later therein. The sleeve 133 may be formed in a cylindrical shape, and may extend upward from the upper plate 121.

In one example, a plurality of sleeves 133 may be arranged on the upper plate 121. The plurality of sleeves 133 may be arranged successively in the extending direction of the tray opening, and may be spaced apart from each other at a regular interval.

Some of the plurality of sleeves 133 may be positioned between two adjacent first upper slots 131. Some of the remaining sleeves 133 may be positioned between two adjacent second upper slots 132 or may be positioned to face a region between the two second upper slots 132. Such structure may allow the coupling between the first upper slot 131 and the second upper slot 132 and the protrusions of the upper tray 150 to be very tight.

The upper casing 120 may further include a plurality of hinge supports 135 and 136 to allow the lower assembly 200 to pivot. Further, a first hinge hole 137 may be defined in each of the hinge supports 135 and 136. The plurality of hinge supports 135 and 136 may be spaced apart from each other, so that both ends of the lower assembly 200 may be pivotably coupled to the plurality of hinge supports 135 and 136.

The upper casing 120 may include through-openings 139*b* and 139*c* defined therein for a portion of the connector 350 to pass therethrough. In one example, the links 356 located on both sides of the lower assembly 200 may pass through the through-openings 139*b* and 139*c*, respectively.

In one example, the upper casing 120 may be formed with a horizontal extension 142 and a vertical extension 140. The horizontal extension 142 may form the top face of the upper casing 120, and may be brought to be in contact with the top face of the freezing compartment 4, the inner casing 21. In another example, the horizontal extension 142 may be brought to be in contact with the mounting cover 43 rather than inner casing 21.

The horizontal extension 142 may be provided with a hook 138 and a threaded portion 142*a* for fixedly mounting the upper casing 120 to the inner casing 21 or the mounting cover 43.

The hook 138 may be formed on each of both rear ends of the horizontal extension 142, and may be configured to be fastened to the inner casing 21 or the mounting cover 43. In detail, the hook 138 may include a vertical hook 138*b* protruding upward from the horizontal extension 142 and a horizontal hook 138*a* extending rearward from an end of the vertical hook 138*b*. Thus, an entirety of the hook 138 may be formed in a hook shape. Further, one side of the inner casing 21 or the mounting cover 43 may be inserted and fastened into a space defined between the vertical hook 138*b* and the horizontal hook 138*a* to be locked to each other.

In one example, the hook 138 may protrude from an outer face of the vertical extension 140. That is, a side end of the hook 138 may be coupled to and integrally formed with the vertical extension 140. Thus, the hook 138 may satisfy a strength necessary to support the ice-maker 100. Further, the hook 138 will not break during attachment and detachment process of the ice-maker 100.

Further, an extended end of the horizontal hook 138*a* may be formed with an inclined portion 138*d* inclined upward, so that the hook 138 may be guided to a restraint position more easily when the ice-maker 100 is mounted. Further, at least one protrusion 138*c* may be formed on a top face of the horizontal hook 138*a*. The protrusion 138*c* may be in contact with the inner casing 21 or the mounting cover 43, and therefore, vertical movement of the ice-maker 100 may be prevented and the ice-maker 100 may be more firmly mounted.

In one example, a threaded portion 142*a* may be formed at each of both front ends of the horizontal extension 142. The threaded portion 142*a* may protrude downward, and may be coupled with the inner casing 21 or the mounting cover 43 by the screw for fixing the upper casing 120.

Therefore, for the installation of the ice-maker 100, after placing the module-shaped ice-maker 100 inside the freezing compartment 4, the hook 138 is fastened to the inner casing 21 or the mounting cover 43, and then the ice-maker 100 is pressed upward. In this connection, a coupling hook 140*a* on the vertical extension 140 may be coupled with the mounting cover 43, so that the ice-maker 100 may be in an additional provisionally-fixed state. In this state, the screw may be fastened to the threaded portion 142*a*, so that the front end of the upper casing 120 may be coupled to the inner casing 21 or mounting cover 43, thereby completing the installation of the ice-maker 100.

In other words, the ice-maker 100 may be mounted by fastening the rear end of the ice-maker 100 and fixing the front end thereof with the screw without any complicated structure or component for mounting the ice-maker 100. The ice-maker 100 may be easily detached in a reverse order.

In one example, an edge rib 120*d* may be formed along a perimeter of the horizontal extension 142. The edge rib 120*d* may protrude vertically upward from the horizontal extension 142, and may be formed along ends except for the rear end of the horizontal extension 142.

When the ice-maker 100 is mounted, the edge rib 120*d* may be brought into close contact with the outer face of the inner casing 21 or the mounting cover 43, or may allow the ice-maker 100 to be mounted horizontally with the ground on which the refrigerator 1 is installed.

To this end, a vertical level of the edge rib 120*d* may decrease from a front end thereof to a rear end thereof. In detail, a portion of the edge rib 120*d* formed along the front end of the horizontal extension 142 may be formed to have a highest vertical level and have a uniform vertical level. Further, a portion of the edge rib 120*d*, which is formed along each of both sides of the horizontal extension 142, may have a highest vertical level at a front end thereof, and a vertical level thereof may decrease rearwardly.

The vertical level of the front end, which has the highest vertical level in the edge rib 120*d*, may be approximately 3 to 5 mm. Thus, as shown in FIG. 6, the horizontal extension 142, which forms the top face of the ice-maker 100, may be disposed to have an inclination of approximately 7 to 8° downwards relative to the outer face of the inner casing 21 or the mounting cover 43.

With such arrangement, even when the cabinet 2 is placed at an angle, the water level of the water supplied into the ice-maker 100 may be horizontal, and the same amount of water may be received in the plurality of ice chambers 111, so that the spherical ice cubes having the same size may be made.

In one example, the vertical extension 140 may be formed inward of the horizontal extension 142 and may extend vertically upward along the perimeter of the upper plate 121. The vertical extension 140 may include at least one coupling hook 140*a*. The upper casing 120 may be hooked to the mounting cover 43 by the coupling hook 140*a*. Further, the water supply 190 may be coupled to the vertical extension 140.

The upper casing 120 may further include a side wall 143. The side wall 143 may extend downward from the horizontal extension 142. The side wall 143 may be disposed to surround at least a portion of the perimeter of the lower assembly 200. In other words, the side wall 143 prevents the lower assembly 200 from being exposed to the outside.

The side wall 143 may include a first side wall 143*a* in which a cold-air hole 134 is defined, and a second side wall 143*b* facing away from the first side wall 143*a*. When the ice-maker 100 is mounted in the freezing compartment 4, the first side wall 143*a* may face a rear wall or one of both sidewalls of the freezing compartment 4.

The lower assembly 200 may be located between the first side wall 143*a* and the second side wall 143*b*. Further, since the ice-full state detection lever 700 pivots, an interference-prevention groove 148 may be defined in the side wall 143 such that interference is prevented in the pivoting operation of the ice-full state detection lever 700.

The through-openings 139*b* and 139*c* may include the first through-opening 139*b* positioned adjacent to the first side wall 143*a* and the second through-opening 139*c* positioned adjacent to the second side wall 143*b*. Further, the tray opening 123 may be defined between the through-openings 139*b* and 139*c*.

The cold-air hole 134 in the first side wall 143*a* may extend in the horizontal direction. The cold-air hole 134 may be defined in a corresponding size such that the front end of the cold-air duct 44 may be inserted therein. Therefore, an entirety of the cold-air supplied through the cold-air duct 44 may flow into the upper casing 120 through the cold-air hole 134.

The cold-air guide 145 may be formed between both ends of the cold-air hole 134, and the cold-air flowing into the cold-air hole 134 may be guided toward the tray opening 123 by the cold-air guide 145. Further, a portion of the upper tray 150 exposed through the tray opening 123 may be exposed to the cold-air and directly cooled.

In one example, in the ice-full state detection lever 700, the first inserted portion 740 is connected to the driver 180 and the second inserted portion 750 is coupled to the first side wall 143*a*.

The driver 180 is coupled to the second side wall 143*a*. In the ice-removal process, the lower assembly 200 is pivoted by the driver 180, and the lower tray 250 is pressed by the lower ejector 400. In this connection, relative movement between the driver 180 and the lower assembly 200 may occur in the process in which the lower tray 250 is pressed by the lower ejector 400.

A pressing force of the lower ejector 400 applied on the lower tray 250 may be transmitted to an entirety of the lower assembly 200 or to the driver 180. In one example, a torsional force is applied on the driver 180. The force acting on the driver 180 then acts on the second side wall 134*b* too. When the second side wall 143*b* is deformed by the force acting on the second side wall 143*b*, a relative position between the driver 180 and the connector 350 installed on the second side wall 143*b* may change. In this case, there is a possibility that the shaft of the driver 180 and the connector 350 are separated.

Therefore, a structure for minimizing the deformation of the second side wall 134*b* may be further provided on the upper casing 120. In one example, the upper casing 120 may further include at least one first rib 148*a* connecting the upper plate 121 and the vertical extension 140 with each other, and a plurality of first ribs 148*a* and 148*b* may be spaced apart from each other.

An electrical-wire guide 148*c* for guiding the electrical-wire connected to the upper heater 148 or the lower heater 296 may be disposed between two adjacent first ribs 148*a* and 148*b* among the plurality of first ribs 148*a* and 148*b*.

The upper plate 121 may include at least two portions in a stepped form. In one example, the upper plate 121 may include a first plate portion 121*a* and a second plate portion 121*b* positioned higher than the first plate portion 121*a*.

In this case, the tray opening 123 may be defined in first plate portion 121*a*.

The first plate portion 121*a* and the second plate portion 121*b* may be connected with each other by a connection wall 121*c*. The upper plate 121 may further include at least one second rib 148*d* connecting the first plate portion 121*a*, the second plate portion 121*b*, and the connection wall 121*a* with each other.

The upper plate 121 may further include the electrical-wire guide hook 147 that guides the electrical wire to be connected with the upper heater 148 or lower heater 296. In one example, the electrical-wire guide hook 147 may be provided in an elastically deformable form on the first plate portion 121*a*.

Hereinafter, a cold-air guide structure of the upper casing 120 will be described in detail with reference to the accompanying drawings.

Figure 15:
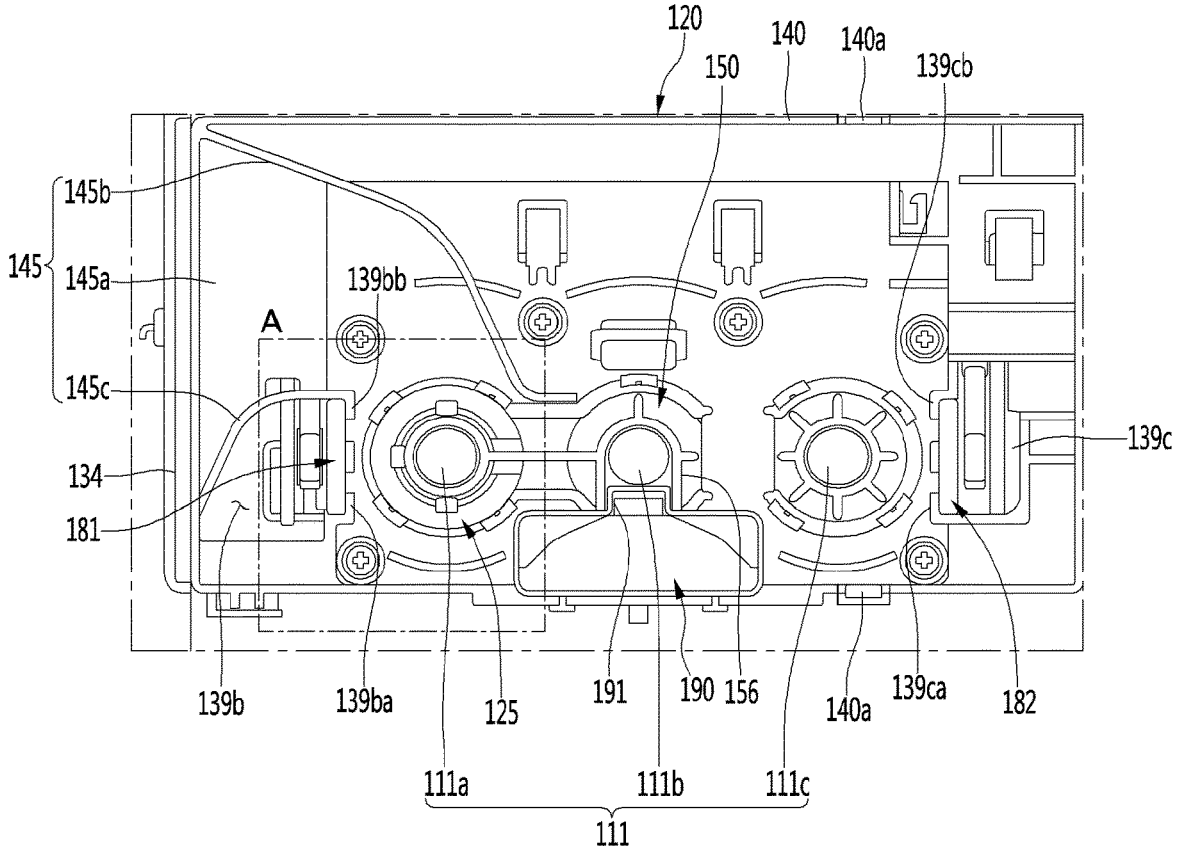
FIG. 15 is a partial plan view of an ice-maker viewed from above.
Figure 16:
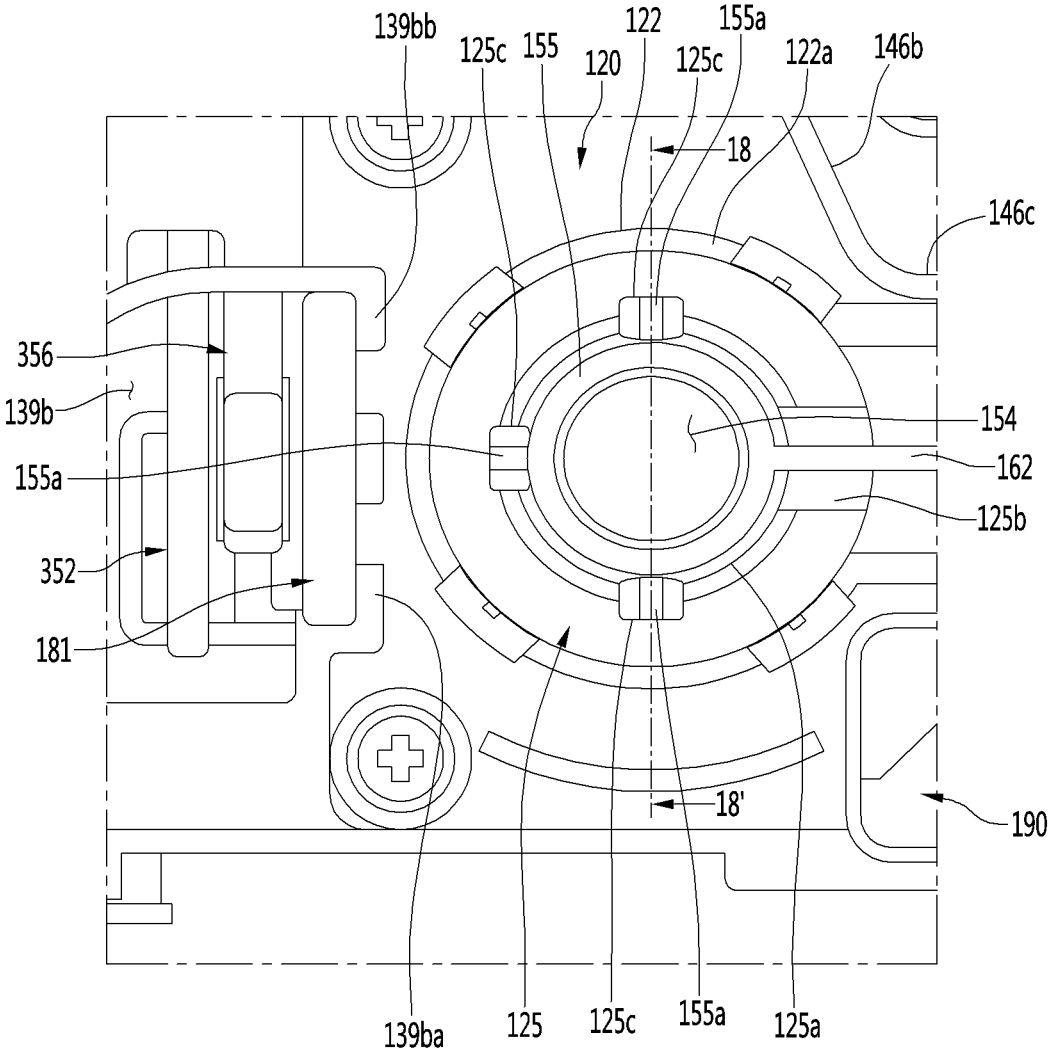
FIG. 16 is an enlarged view of a portion A of FIG. 15.
Figure 17:
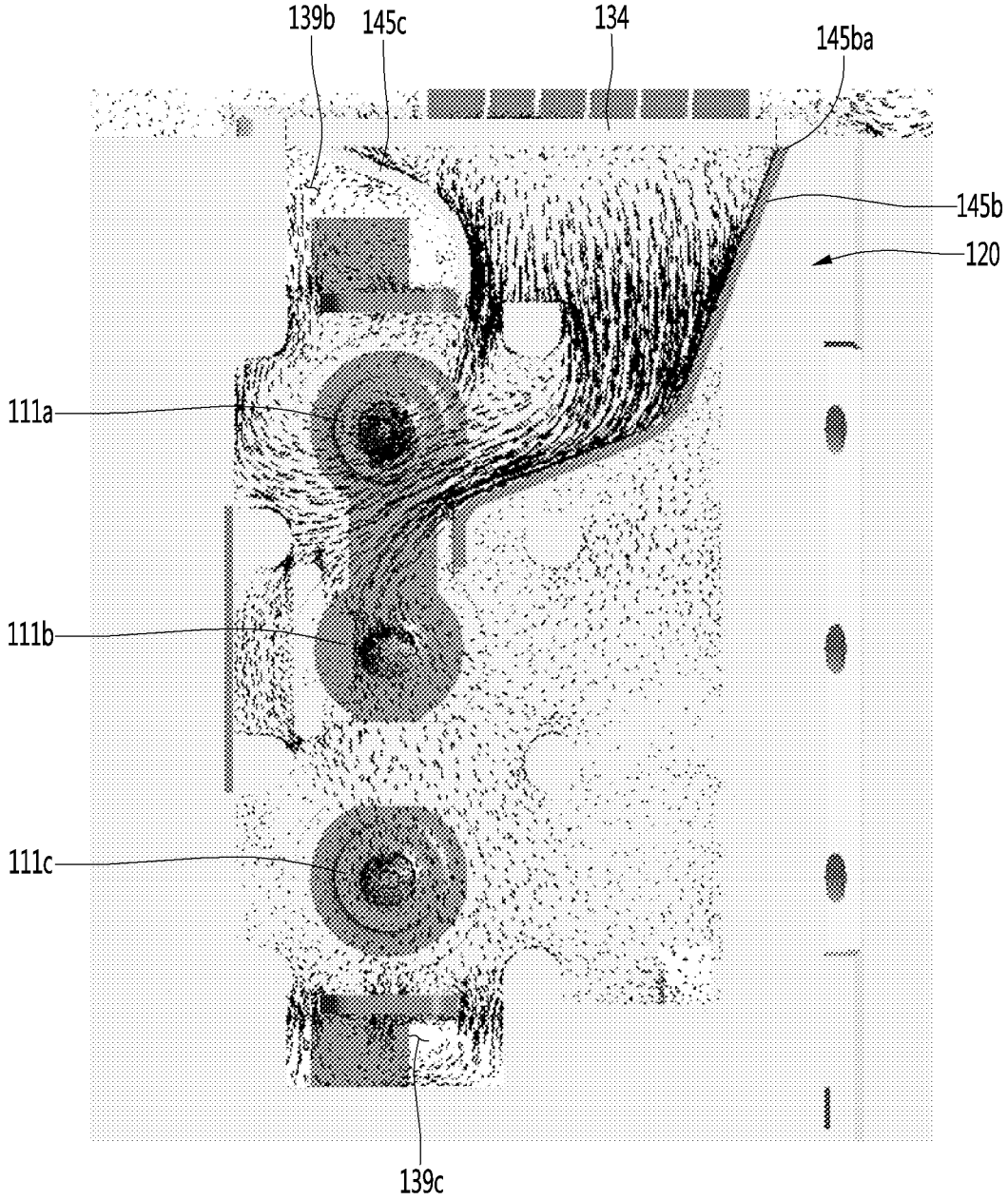
FIG. 17 shows flow of cold-air on a top face of an ice-maker.

FIG. 15 is a partial plan view of an ice-maker viewed from above. Further, FIG. 16 is an enlarged view of a portion A of FIG. 15. Further, FIG. 17 shows flow of cold-air on a top face of an ice-maker. Further, FIG. 18 is a perspective view of FIG. 16 taken along a line 18-18'.

Figure 18:
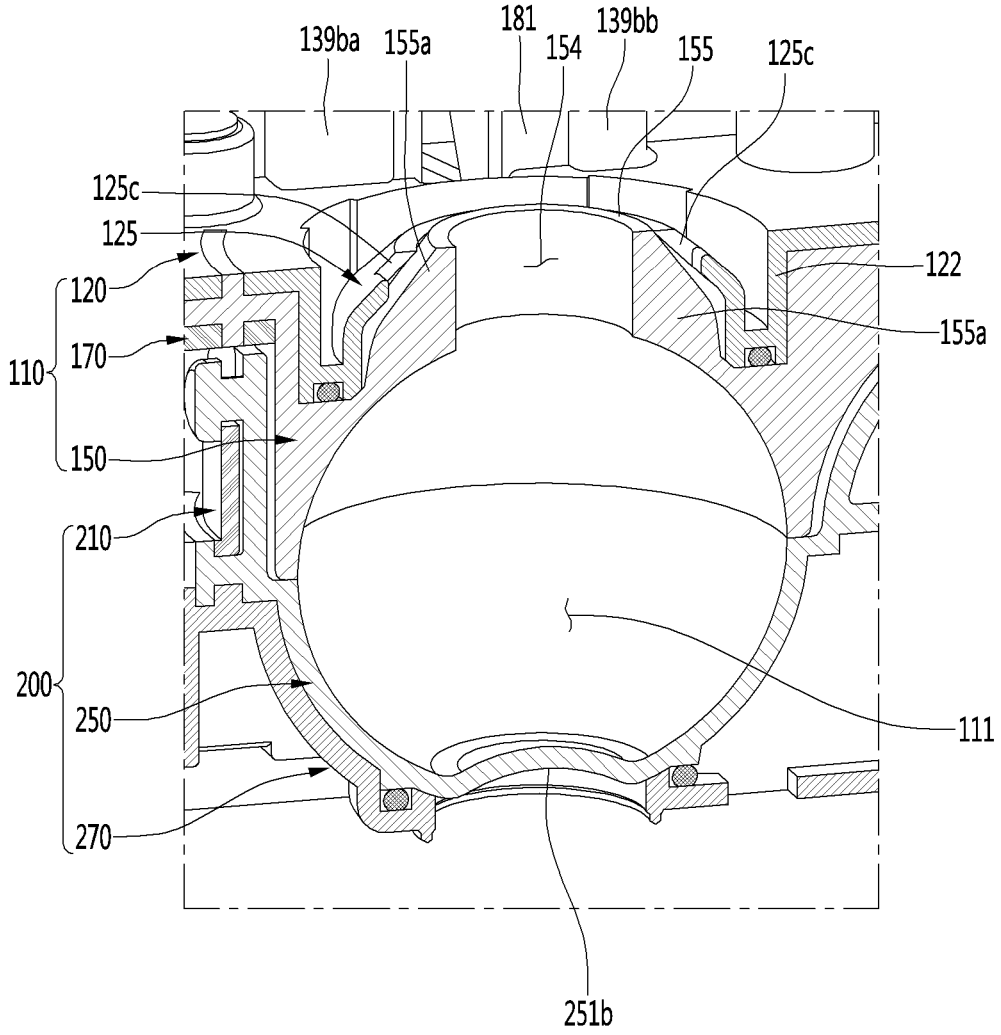
FIG. 18 is a perspective view of FIG. 16 taken along a line 18-18'.

As shown in FIGS. 15 and 18, the cold-air hole 134 is not positioned in line with the ice chamber 111 and the tray opening 123. Thus, the cold-air guide 145 may be formed to guide the cold-air flowed from the cold-air hole 134 toward the ice chamber 111 and the tray opening 123.

When there is no cold-air guide on the upper casing 120, the cold-air flowed through the cold-air hole 134 may not pass through the ice chamber 111 and the tray opening 123 or pass through only small portions thereof, which may reduce the cooling efficiency.

However, in the present embodiment, the cold-air introduced through the cold-air hole 134 may be led to sequentially pass upward of the ice chamber 111 and then through the tray opening 123 by the cold-air guide 145. Thus, effective ice-making may be achieved in the ice chamber 111, and ice-making speeds in the plurality of ice chambers 111 may be the same as or similar to each other.

The cold-air guide 145 may include a horizontal guide 145*a* and a plurality of vertical guides 145*b* and 145*c* for guiding the cold-air passed through the cold-air hole 134.

The horizontal guide 145*a* may guide the cold-air to upward of the upper plate 121 in which the tray opening 123 is defined, at a position at or below the lowest point of the cold-air hole 134. Further, the horizontal guide 145*a* may connect the first side wall 143*a* and the upper plate 121 with each other. The horizontal guide 145*a* may substantially form a portion of the bottom face of the upper plate 121.

The plurality of vertical guides 145*b* and 145*c* may be arranged to intersect or to be perpendicular to the horizontal guide 145*a*. The plurality of vertical guides 145*b* and 145*c* may include a first vertical guide 145*b* and a second vertical guide 145*c* spaced apart from the first vertical guide 145*b*.

Further, an end of each of the first vertical guide 145*b* and the second vertical guide 145*c* may extend toward an ice chamber 111 on one side closest to the cold-air hole 134 among the plurality of ice chambers 111.

The plurality of ice chambers 111 may include a first ice chamber 111*a*, a second ice chamber 111*b*, and a third ice chamber 111*c* that are sequentially arranged in a direction to be farther away from the cold-air hole 134. That is, the first ice chamber 111*a* may be located closest to the cold-air hole 134 and the third ice chamber 111*c* may be located farthest from the cold-air hole 134. The number of the ice chambers 111 may be three or more, and when the number of the ice chambers 111 is three or more, the number is not limited.

The first vertical guide 145*b* may extend from one end of the cold-air hole 134 to ends of the first ice chamber 111*a* and second ice chamber 111*b*. In this connection, the first vertical guide 145*b* may have a predetermined curvature or a bent shape, so that the cold-air flowed from the cold-air hole 134 may be directed to the first ice chamber 111*a*.

Further, the extended end of the first vertical guide 145*b* may be bent toward the second ice chamber 111*b*. Thus, a portion of the cold-air discharged by the first vertical guide 145*b* may be directed toward the second ice chamber 111*b* after passing the end of the first ice chamber 111*a*.

Further, the first vertical guide 145*b* may be formed not to extend to the second ice chamber 111*b* and formed in a bent or rounded shape, so that interference with electrical-wires provided on the upper plate 121 may not occur.

The second vertical guide 145*c* may extend toward the first ice chamber 111*a* from the other end of the cold-air hole 134, which is facing away from the end where the first vertical guide 145*b* extends.

The second vertical guide 145*c* may be spaced apart from the extended end of the first vertical guide 145*b*, and the first ice chamber 111*a* may be positioned between the ends of the first vertical guide 145*b* and the second vertical guide 145*c*, so that the discharged cold-air may be directed toward the first ice chamber 111*a* by the cold-air guide 145.

In one example, the second vertical guide 145*c* forms a portion of a perimeter of the first through-opening 139*b*. This prevents the cold-air flowing along the cold-air guide 145 from entering the first through-opening 139*b* directly.

The cold-air guided by the cold-air guide 145 may be directed towards the first ice chamber 111*a*. Further, the discharged cold-air may pass the plurality of ice chambers 111 sequentially, and finally, pass through the second through-opening 139*c* defined next to the third ice chamber 111*c*.

Thus, as shown in FIG. 17, the cold-air passed through the cold-air hole 134 may be concentrated above the upper plate 121 by the cold-air guide 145. Further, the cold-air that passed the upper plate 121 passes through the first and second through-openings 139*b* and 139*c*.

Further, the supplied cold-air may be supplied to pass the plurality of ice chambers 111 sequentially along a direction of arrangement of the plurality of ice chambers 111 by the cold-air guide 145. Further, the cold-air may be evenly supplied to all of the ice chambers 111, so that the ice-making may be performed more effectively. Further, the ice-making speeds in the plurality of ice chambers 111 may be uniform.

In one example, it may be seen that the supplied cold-air is concentrated in the first ice chamber 111*a* by the cold-air guide 145 due to the arrangement of the ice chambers 111 as shown in FIG. 17. Therefore, it will be apparent that an ice formation speed in the first ice chamber 111*a*, where the cold-air is concentratedly supplied, will be high in an early state of the ice-making.

In detail, the ice inside the ice chamber 111 may be made in an indirect cooling scheme. In particular, the supply of the cold-air is concentrated on the upper tray 150 side, and the lower tray 250 is naturally cooled by the cold-air in the refrigerator. In particular, in the present embodiment, in order to make the transparent spherical ice, the lower tray 250 is periodically heated by the lower heater 296 disposed in the lower tray 250, so that the ice formation starts from the top of the ice chamber 111 and gradually proceeds downward. Thus, bubbles generated during the ice formation inside the ice chamber 111 may be concentrated in a lower portion of the lower tray 250, so that ice transparent except for a bottom thereof where the bubbles are concentrated may be made.

Due to the nature of such cooling scheme, the ice formation occurs first in the upper tray 150. The cold-air is concentrated in the first ice chamber 111*a*, so that the ice formation may occur quickly in the first ice chamber 111*a*. Further, due to the sequential flow of the cold-air, the ice formation begins sequentially in upper portions of the second ice chamber 111*b* and the third ice chamber 111*c*.

Water expands in a process of being phase-changed into ice. When an ice making speed is high in the first ice chamber 111*a*, an expansion force of the water is applied to the second ice chamber 111*b* and the third ice chamber 111*c*. Then, the water in the first ice chamber 111*a* passes between the upper tray 150 and the lower tray 250 and flows toward the second ice chamber 111*b*, and then the water in the second ice chamber 111*b* may sequentially flows toward the third ice chamber 111*c*. As a result, water of an amount greater than the set amount may be supplied into the third ice chamber 111*c*. Thus, ice made in the third ice chamber 111*c* may not have a relatively complete spherical shape, and may have a size different from that of ice cubes made in other ice chambers 111*a* and 111*b*.

In order to prevent such a problem, the ice formation in the first ice chamber 111*a* should be prevented from being performed relatively faster, and preferably, the ice formation speed should be uniform in the ice chambers 111. Further, the ice formation may occur in the second ice chamber 111*b* first rather than in the first ice chamber 111*a* to prevent water from concentrating into one ice chamber 111.

To this end, a shield 125 may be formed in the tray opening 123 corresponding to the first ice chamber 111*a*, and may minimize an area of exposure of the upper tray 150 corresponding to the first ice chamber 111*a*.

In detail, the shield 125 may be formed in the cavity 122 corresponding to the first ice chamber 111*a*, and a bottom of the cavity 122, which defines the tray opening 123, may extend toward a center portion thereof to form the shield 125. That is, a portion of the tray opening 123 corresponding to the first ice chamber 111*a* has an area which is significantly small, and portions of the tray opening 123 respectively corresponding to the remaining second ice chamber 111*b* and third ice chamber 111*c* have larger areas.

Thus, as in a state in which the upper tray 150 is coupled to the upper casing 120 shown in FIG. 15, the top face of the upper tray 150 where the first ice chamber 111*a* is formed may be further shielded by the shield 125.

The shield 125 may be rounded or inclined in a shape corresponding to an upper portion of an outer face of a portion corresponding to the first ice chamber 111*a* of the upper tray 150. The shield 125 may extend centerward from the bottom of the cavity 122, and may extend upward in a rounded or inclined manner. Further, an extended end of the shield 125 may define a shield opening 125*a*. The shield opening 125*a* may have a size to be correspond to the ejector-receiving opening 154 in communication with the first ice chamber 111*a*. Accordingly, in a state in which the upper casing 120 and the upper tray 150 are coupled with each other, only the ejector-receiving opening 154 may be exposed through the portion of the tray opening 123 corresponding to the first ice chamber 111*a*.

Due to such structure, even when the cold-air supplied to pass the upper plate 121 is concentratedly supplied into the first ice chamber 111*a* by the cold-air guide 145, the shield 125 may reduce the cold-air transmission into the first ice chamber 111*a*. In other words, an adiabatic effect by the shield 125 may reduce the transmission of the cold-air into the first ice chamber 111*a*. As a result, the ice formation in the first ice chamber 111*a* may be delayed, and the ice formation may not proceed in the first ice chamber 111*a* faster than in other ice chambers 111*b* and 111*c*.

Further, the shield opening 125*a* may have a radially recessed rib groove 125*c* defined therein. The rib groove 125*c* may receive a portion of the first connection rib 155*a* radially disposed in the ejector-receiving opening 154. To this end, the rib groove 125*c* may be recessed from a circumference of the shield opening 125*a* at a position corresponding to the first connection rib 155*a*. A portion of the top of the first connection rib 155*a* is accommodated in the rib groove 125*c*, so that the top face of the upper tray 150 that is rounded may be effectively surrounded.

Further, the portion of the top of the first connection rib 155*a* is accommodated in the rib groove 125*c*, so that the top of the upper tray 150 may remain in place without leaving the shield 125. Further, the deformation of the upper tray 150 may be prevented and the upper tray 150 may be maintained in a fixed shape, so that the ice made in the first ice chamber 111*a* may be ensured to have the spherical shape always.

In one example, a shield cut 125*b* may be defined in one side of the shield 125. The shield cut 125*b* may be defined by being cut at a position corresponding to the second connection rib 162 to be described below, and may be define to receive the second connection rib 162 therein.

The shield 125 may be cut in a direction toward the second ice chamber 111*b*, and may shield the remaining portion except for a portion where the second connection rib 162 is formed and the ejector-receiving opening 154 in communication with the first ice chamber 111*a*.

The shield 125 may not be completely in contact with the top face of the upper tray 150 and may be spaced from the top face of the upper tray 150 by a predetermined distance. Due to such structure, an air layer may be formed between the shield 125 and the upper tray 150. Therefore, heat insulation between the first ice chamber 111*a* and the corresponding portion may be further improved.

In one example, the first through-opening 139*b* and the second through-opening 139*c* may be defined in both sides of the tray opening 123. Unit guides 181 and 182 to be described below and the first link 356 moving vertically along the unit guides 181 and 182 may pass through the first through-opening 139*b* and the second through-opening 139*c*.

In particular, a stopper in contact with each of the unit guides 181 and 182 may protrude upward from each of the first through-opening 139*b* and the second through-opening 139*c* to restrain a horizontal movement of each of the unit guides 181 and 182.

In detail, a first stopper 139*ba* and a second stopper 189*bb* may protrude from the first through-opening 139*b*. The first stopper 139*ba* and the second stopper 189*bb* may be separated from each other to support the first unit guide 181 from both sides. In this connection, the second stopper 189*bb* may be formed by bending the end of the second vertical guide 145*c*.

Further, a third stopper 189*ca* and a fourth stopper 189*cb* may protrude from the second through-opening 139*c*. The third stopper 189*ca* and fourth stopper 189*cb* may be spaced apart from each other to support the second unit guide 182 from both sides.

Because of such structure, the horizontal movement of the unit guides 181 and 182 may be prevented fundamentally. Therefore, the movement of the upper ejector 300 along the unit guides 181 and 182 may also be prevented. In the vertical movement, the upper ejector 300 may press the upper tray 150 to deform or detach the upper tray 150, so that the upper ejector 300 should be vertically moved at a fixed position. Thus, the upper ejector 300 is not interfered with the upper tray 150 by the stopper during the vertical movement process.

In one example, the fourth stopper 189*cb* among the stoppers may have a height slightly smaller than that of the other stoppers 139*ba*, 139*bb*, and 139*ca*. This is to allow the cold-air flowing along the upper tray 150 to pass the fourth stopper 189*cb* and be discharged smoothly through the second through-opening 139*c*.

Hereinafter, the upper tray 150 will be described in more detail with reference to the accompanying drawings.

Figure 19:
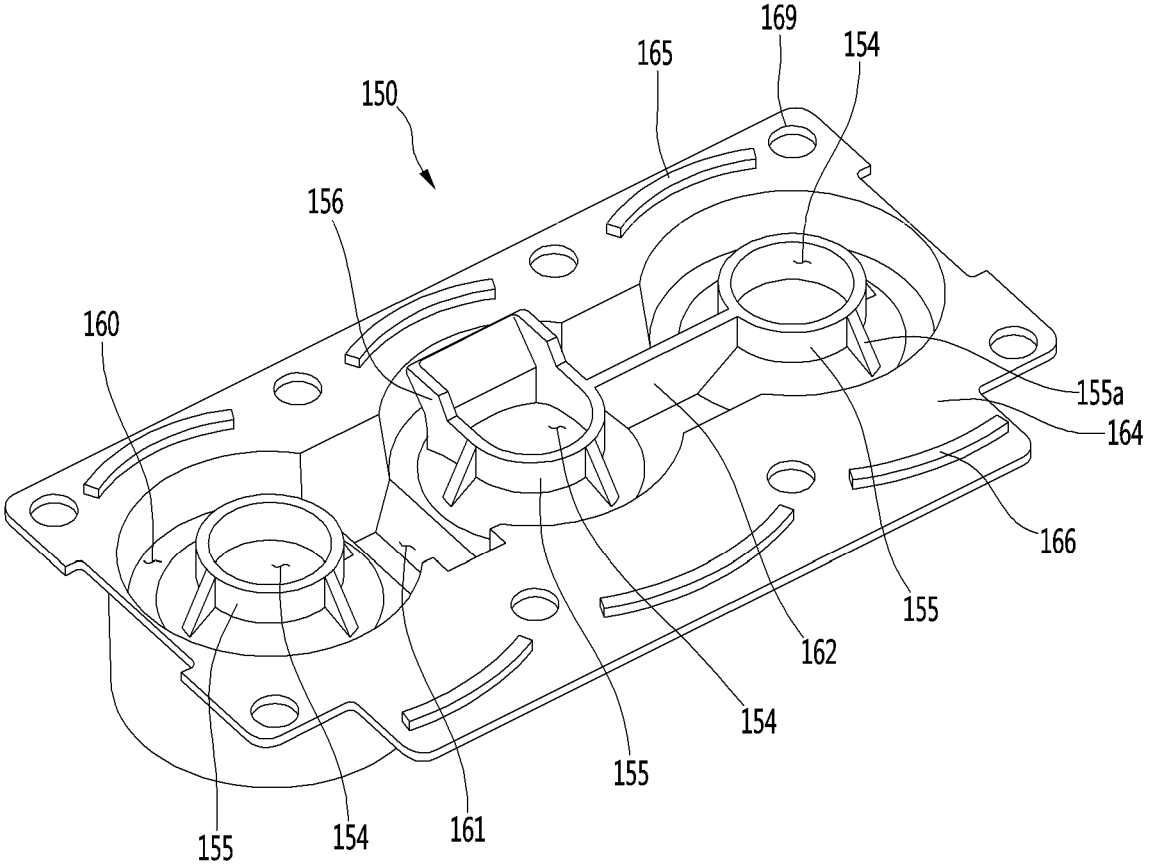
FIG. 19 is a perspective view of an upper tray according to an embodiment of the present disclosure viewed from above.
Figure 20:
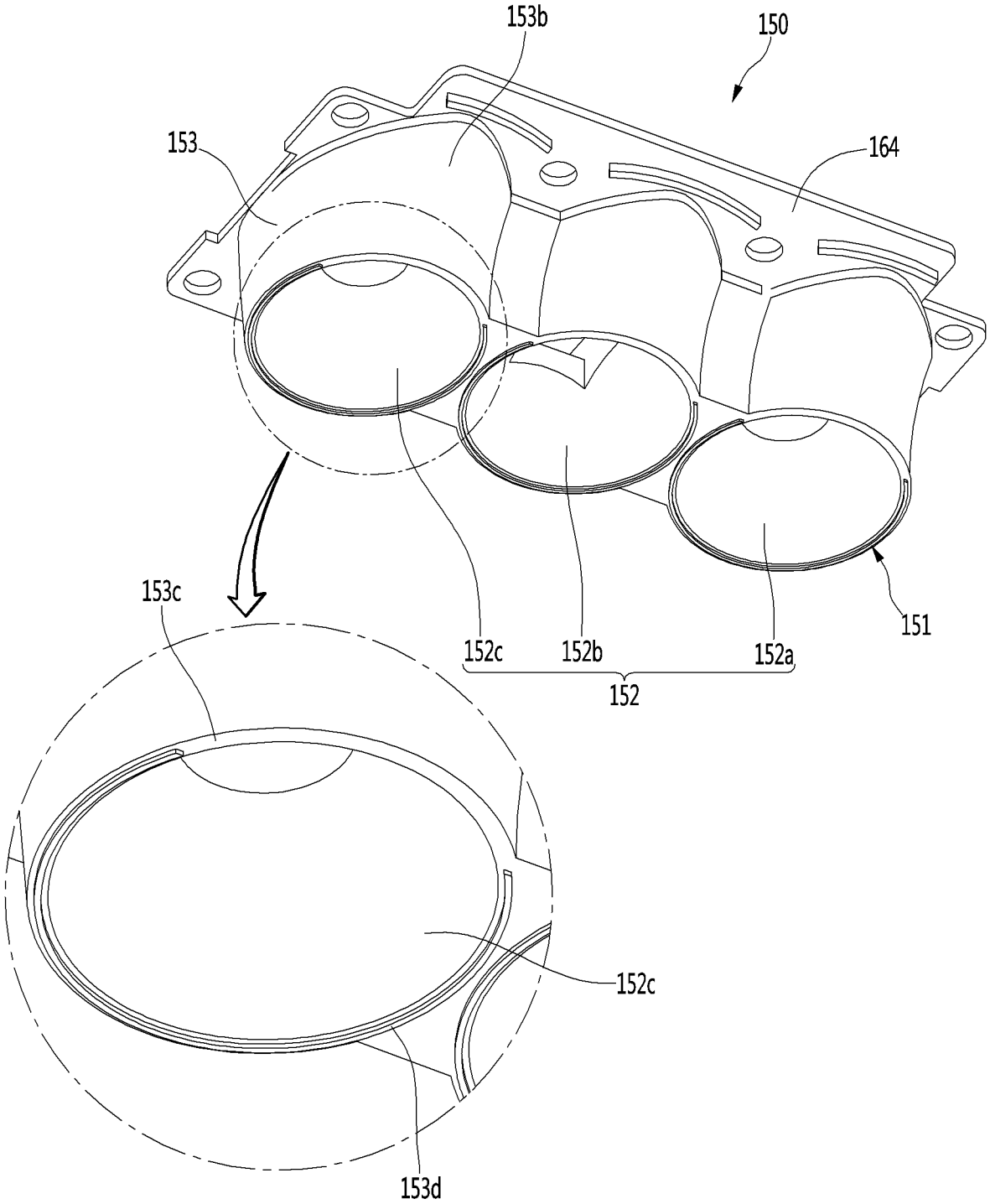
FIG. 20 is a perspective view of an upper tray viewed from below.

FIG. 19 is a perspective view of an upper tray according to an embodiment of the present disclosure viewed from above. Further, FIG. 20 is a perspective view of an upper tray viewed from below. Further, FIG. 21 is a side view of an upper tray.

Figure 21:
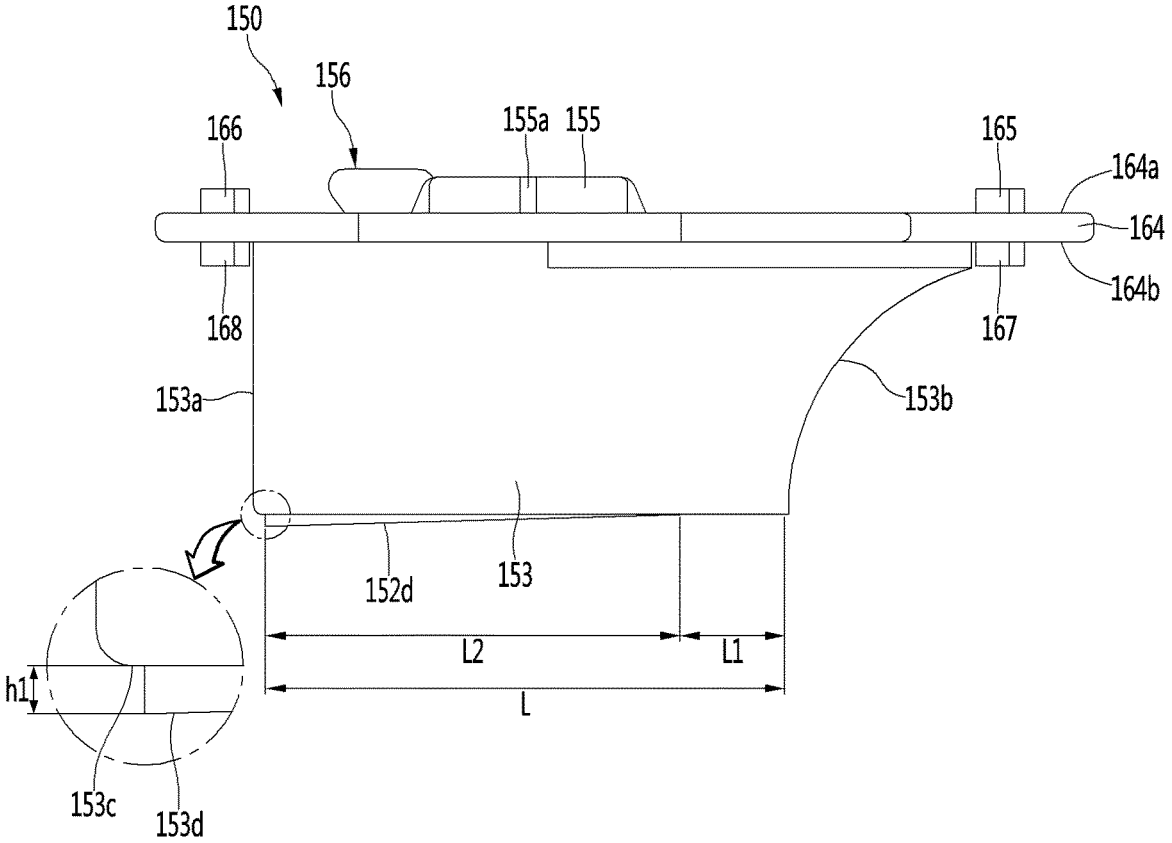
FIG. 21 is a side view of an upper tray.

Referring to FIGS. 19 to 21, the upper tray 150 may be made of a flexible or soft material that may be returned to its original shape after being deformed by an external force.

In one example, the upper tray 150 may be made of a silicone material. When the upper tray 150 is made of the silicone material as in the present embodiment, in the ice-removal process, even when the upper tray 150 is deformed by the external force, the upper tray 150 returns to its original shape, so that the spherical ice may be made despite the repetitive ice generation.

Further, when the upper tray 150 is made of the silicone material, the upper tray 150 may be prevented from melting or being thermally deformed by heat provided from the upper heater 148 to be described later.

The upper tray 150 may include the upper tray body 151 forming the upper chamber 152 that is a portion of the ice chamber 111. A plurality of upper chambers 152 may be sequentially formed on the upper tray body 151. The plurality of upper chambers 152 may include a first upper chamber 152*a*, a second upper chamber 152*b*, and a third upper chamber 152*c*, which may be sequentially arranged in series on the upper tray 151.

The upper tray body 151 may include three chamber walls 153 that form three independent upper chambers 152*a*, 152*b*, and 152*c*, and the three chamber walls 153 may be integrally formed and connected to each other.

The upper chamber 152 may be formed in a hemispherical shape. That is, an upper portion of the spherical ice may be formed by the upper chamber 152.

An ejector-receiving opening 154 through which the upper ejector 300 may enter or exit for the ice-removal may be defined in an upper portion of the upper tray body 151. The ejector-receiving opening 154 may be defined in a top of each of the upper chambers 152. Therefore, each upper ejector 300 may independently push the ice cubes in each of the ice chambers 111 to remove the ice cubes. In another example, the ejector-receiving opening 154 has a diameter sufficient for the upper ejector 300 to enter and exit, which allows the cold-air flowing along the upper plate 121 to enter and exit.

In one example, in order to minimize the deformation of the portion of the upper tray 150 near the ejector-receiving opening 154 in a process in which the upper ejector 300 is inserted through the ejector-receiving opening 154, an opening-defining wall 155 may be formed on the upper tray 150. The opening-defining wall 155 may be disposed along the circumference of the ejector-receiving opening 154, and may extend upward from the upper tray body 151.

The opening-defining wall 155 may be formed in a cylindrical shape. Thus, the upper ejector 300 may pass through an internal space of the opening-defining wall 155 and pass through the ejector-receiving opening 154.

The opening-defining wall may act as a guide for movement of the upper ejector 300, and at the same time, may define extra space to prevent the water contained in the ice chamber 111 from overflowing. Therefore, the internal space of the opening-defining wall 155, that is, the space in which the ejector-receiving opening 154 is defined, may be referred to as a buffer.

Since the buffer is formed, even when the water of the amount equal to or greater than the predefined amount is flowed into the ice chamber 111, the water will not overflow.

When the water inside the ice chamber 111 overflows, ice cubes respectively contained in adjacent ice chambers 111 may be connected with each other, so that the ice may not be easily separated from the upper tray 150. Further, when the water inside the ice chamber may overflow from the upper tray 150, serious problems, such as induction of attachment of the ice cubes in the ice chambers may occur.

In the present embodiment, the buffer is formed by the opening-defining wall 155 to prevent the water inside the ice chamber 111 from overflowing. When a height of the opening-defining wall 155 becomes excessively large to form the buffer, the buffer may interfere with the movement of the cold-air of passing the upper plate 121 and inhibit smooth movement of the cold-air. On the contrary, when the height of the opening-defining wall 155 becomes excessively small, a role of the buffer may not be expected and it may be difficult to guide the movement of the upper ejector 300.

In one example, a preferred height of the buffer may be a height corresponding to the horizontal extension 142 of the upper tray 150. Further, a capacity of the buffer may be set based on an inflow amount of ice debris that may be attached along a circumference of the upper tray body 151. Therefore, it is preferable that an internal volume of the buffer is defined to have a capacity of 2 to 4% of a volume of the ice chamber 111.

When an inner diameter of the buffer is too large, the top of the completed ice may have an excessively wide flat shape, and thus, an image of the spherical ice may not be provided to the user. Therefore, the buffer should be formed to have a proper inner diameter.

The inner diameter of the buffer may be larger than a diameter of the upper ejector 300 to facilitate entry and exit of the upper ejector 300, and may be determined to satisfy the water capacity and height of the buffer.

In one example, the first connection rib 155*a* for connecting the side of the opening-defining wall 155 and the top face of the upper tray body 151 with each other may be formed on the circumference of the opening-defining wall 155. A plurality of the first connection ribs 155*a* may be formed at regular intervals along the circumference of the opening-defining wall 155. Thus, the opening-defining wall 155 may be supported by the first connection rib 155*a* such that the opening-defining wall 155 is not deformed easily. Even when the upper ejector 300 is in contact with the opening-defining wall 155 in a process of being inserted into the ejector-receiving opening 154, the opening-defining wall 155 may maintain its shape and position without being deformed.

The first connection rib 155*a* may be formed on each of all the first upper chamber 152*a* and second upper chamber 152*b* and third upper chamber 152*c*.

In one example, two opening-defining walls 155 respectively corresponding to the second upper chamber 152*b* and the third upper chamber 152*c* may be connected with each other by a second connection rib 162. The second connection rib 162 may connect the second upper chamber 152*b* and the third upper chamber 152*c* with each other to further prevent the deformation of the opening-defining wall 155, and at the same time, to prevent deformation of top faces of the second upper chamber 152*b* and the third upper chamber 152*c*.

In one example, the second connection rib 162 may also be disposed between the first upper chamber 152*a* and the second upper chamber 152*b* to connect the first upper chamber 152*a* and the second upper chamber 152*b* with each other, but the second connection rib 162 may be omitted since the second receiving space 161 in which the temperature sensor 500 is disposed is defined between the first upper chamber 152*a* and the second upper chamber 152*b*.

The water-supply guide 156 may be formed on the opening-defining wall 155 corresponding to one of the three upper chambers 152*a*, 152*b*, and 152*c*.

Although not limited, the water-supply guide 156 may be formed on the opening-defining wall 155 corresponding to the second upper chamber 152*b*. The water-supply guide 156 may be inclined upward from the opening-defining wall 155 in a direction farther away from the second upper chamber 152*b*. Even when only one water-supply guide is formed on the upper chamber 152, the upper tray 150 and the lower tray 250 may not be closed during the water-supply, so that water may be evenly filled in all the ice chambers 111.

The upper tray 150 may further include a first receiving space 160. The first receiving space 160 may accommodate the cavity 122 of the upper casing 120 therein. The cavity 122 includes a heater-mounted portion 124, and the heater-mounted portion 124 includes the upper heater 148, so that it may be understood that the upper heater 148 is accommodated in the first receiving space 160.

The first receiving space 160 may be defined in a form surrounding the upper chambers 152*a*, 152*b*, and 152*c*. The first receiving space 160 may be defined as the top face of the upper tray body 151 is recessed downward.

The temperature sensor 500 may be accommodated in the second receiving space 161, and the temperature sensor 500 may be in contact with an outer face of the upper tray body 151 while the temperature sensor 500 is mounted.

The chamber wall 153 of the upper tray body 151 may include a vertical wall 153*a* and a curved wall 153*b*.

The curved wall 153*b* may be upwardly rounded in a direction farther away from the upper chamber 152. In this connection, a curvature of the curved wall 153*b* may be the same as a curvature of a curved wall 260*b* of the lower tray 250 to be described below. Thus, when the lower tray 250 pivots, the upper tray 150 and the lower tray 250 do not interfere with each other.

The upper tray 150 may further include a horizontal extension 164 extending in a horizontal direction from a perimeter of the upper tray body 151. The horizontal extension 164 may, for example, extend along a perimeter of a top edge of the upper tray body 151.

The horizontal extension 164 may be in contact with the upper casing 120 and the upper support 170. A bottom face 164*b* of the horizontal extension 164 may be in contact with the upper support 170, and a top face 164*a* of the horizontal extension 164 may be in contact with the upper casing 120. Thus, at least a portion of the horizontal extension 164 may be fixedly mounted between the upper casing 120 and the upper support 170.

The horizontal extension 164 may include a plurality of upper protrusions 165 respectively inserted into the plurality of upper slots 131 and a plurality of upper protrusions 166 respectively inserted into the plurality of upper slots 132.

The plurality of upper protrusions 165 and 166 may include a plurality of first upper protrusions 165 and a plurality of second upper protrusions 166 positioned opposite to the first upper protrusions 165 around the ejector-receiving opening 154.

The first upper protrusion 165 may be formed in a shape corresponding to the first upper slot 131 to be inserted into the first upper slot 131, and the second upper protrusion 166 may be formed in a shape corresponding to the second upper slot 132 to be inserted into the second upper slot 132. Further, the first upper protrusion 165 and the second upper protrusion 166 may protrude from the top face 164*a* of the horizontal extension 164.

The first upper protrusion 165 may be, for example, formed in a curved shape. Further, the second upper protrusion 166 may be, for example, formed in a curved shape. Further, the first upper protrusion 165 and the second upper protrusion 166 may be arranged to face away from each other around the ice chamber 111, so that the perimeter of the ice chamber 111 may be maintained in a firmly coupled state, in particular.

The horizontal extension 164 may further include a plurality of lower protrusions 167 and a plurality of lower protrusions 168. Each of the plurality of lower protrusions 167 and each of the plurality of lower protrusions 168 may be respectively inserted into lower slots 176 and 177 of the upper support 170 to be described later.

The plurality of lower protrusions 167 and 168 may include a first lower protrusion 167 and a second lower protrusion 168 positioned opposite to the first lower protrusion 167 around the upper chamber 152.

The first lower protrusion 167 and the second lower protrusion 168 may protrude downward from the bottom face 164*b* of the horizontal extension 164. The first lower protrusion 167 and the second lower protrusion 168 may be formed in the same shape as the first upper protrusion 165 and the second upper protrusion 166, and may be formed to protrude in a direction opposite to a protruding direction of the first upper protrusion 165 and the second upper protrusion 166.

Thus, because of the upper protrusions 165 and 166 and the lower protrusions 167 and 168, not only the upper tray 150 is coupled between the upper casing 120 and the upper support, but also deformation of the ice chamber 111 or the horizontal extension 264 adjacent to the ice chamber 111 is prevented in the ice-making or ice-removal process.

The horizontal extension 164 may have a through-hole 169 defined therein to be penetrated by a coupling boss of the upper support 170 to be described later. Some of a plurality of through-holes 169 may be located between two adjacent first upper protrusions 165 or two adjacent first lower protrusions 167. Some of the remaining through-holes 169 may be located between two adjacent second lower protrusions 168 or may be defined to face a region between the two second lower protrusions 168.

In one example, an upper rib 153*d* may be formed on the bottom face 153*c* of the upper tray body 151. The upper rib 153*d* is for hermetic sealing between the upper tray 150 and the lower tray 250, which may be formed along the perimeter of each of the ice chambers 111.

In a structure in which the ice chamber 111 is formed by the coupling of the upper tray 150 and the lower tray 250, even when the upper tray 150 and the lower tray 250 remain in close contact with each other at first, a gap is defined between the upper tray 150 and the lower tray 250 due to a volume expansion occurring in a process in which the water is phase-changed into the ice. When the ice formation occurs in a state in which the upper tray 150 and the lower tray 250 are separated from each other, a burr that protrudes in a shape of an ice strip is generated along a circumference of the completed spherical ice. Such burr generation causes a poor shape of the spherical ice itself. In particular, when the ice is connected to ice debris formed in a circumferential space between the upper tray 150 and the lower tray 250, the shape of the spherical ice becomes worse.

In order to solve such problem, in the present embodiment, the upper rib 153*d* may be formed at the bottom of the upper tray 150. The upper rib 153*d* may shield between the upper tray 150 and the lower tray 250 even when the volume expansion of the water due to the phase-change occurs. Thus the bur may be prevented from being formed along the circumference of the completed spherical ice.

In detail, the upper rib 153*d* may be formed along the perimeter of each of the upper chambers 152, and may protrude downward in a thin rib shape. Therefore, in a situation where the upper tray 150 and the lower tray 250 are completely closed, deformation of the upper rib 153*d* will not interfere with the sealing of the upper tray 150 between the lower tray 250.

Therefore, the upper rib 153*d* may not be formed excessively long. Further, it is preferable that the upper rib 153*d* is formed to have a height sufficient to cover the gap between the upper tray 150 and the lower tray 250. In one example, the upper tray 150 and the lower tray 250 may be separated from each other by about 0.5 mm to 1 mm when the ice is formed, and correspondingly the upper rib 153*d* may be formed with a height h1 of about 0.8 mm.

In one example, the lower tray 250 may be pivoted in a state in which a pivoting shaft thereof is positioned outward (rightward in FIG. 21) of the curved wall 153*b*. In such structure, when the lower tray 250 is closed by pivoting, a portion thereof close to the pivoting shaft is brought to be in contact with the upper tray 150 first, and then a portion thereof far away from the pivoting shaft is sequentially brought to be in contact with the upper tray 150 as the upper tray 150 and the lower tray 250 are compressed.

Thus, when the upper rib 153*d* is formed along an entirety of the perimeter of the bottom of the upper chamber 152, interference of the upper rib 153*d* may occur at a position near the pivoting shaft, which may cause the upper tray 150 and the lower tray 250 not to be closed completely. In particular, there is a problem that the upper tray 150 and the lower tray 250 are not closed at a position far away from the pivoting shaft.

In order to prevent such problem, the upper rib 153*d* may be formed to be inclined along the perimeter of the upper chamber 152. The upper rib 153*d* may be formed such that a height thereof increases toward the vertical wall 153*a* and decreases toward the curved wall 153*b*. One end of the upper rib 153*d* close to the vertical wall 153*b* may have a maximum height h1, the other end of the upper rib 153*d* close to the curved wall 153*b* may have a minimum height, and the minimum height may be zero.

Further, the upper rib 153*d* may not be formed on the entirety of the upper chamber 152, but may be formed on the remaining portion of the upper chamber 152 except for a portion thereof near the curved wall 153*b*. In one example, as shown in FIG. 21, based on a length L of an entire width of the bottom of the upper tray 150, the upper rib 153*d* may start to protrude from a position away from an end at which the curved wall 153*b* is formed by ⅕ length L1 and extend to an end at which the vertical wall 153*b* is formed. Therefore, a width of the upper rib 153*d* may be ⅘ length L2 based on the length L of the entire width of the bottom of the upper tray 150. In one example, when the width of the bottom of the upper tray 150 is 50 mm, the upper rib 153*d* extends downwards from a position 10 mm away from the end of the curved wall 153*b*, and may extend to the end adjacent to the vertical wall 153*a*. In this connection, the width of the upper rib 153*d* may be 40 mm.

In another example, there may be some differences, but the point where the upper rib 153*d* starts to protrude may be a point away from the curved wall 153*b* such that the interference may be minimized when the lower tray 250 is closed, and at the same time, the gap between the upper tray 150 and the lower tray 250 may be covered.

Further, the height of the upper rib 153*d* may increase from the curved wall 153*b* side to the vertical wall 153*a* side. Thus, when the lower tray 250 is opened by the freezing, the gap between the upper tray 150 and the lower tray 250 having varying height may be effectively covered.

Hereinafter, the upper support 170 will be described in more detail with reference to the accompanying drawings.

Figure 22:
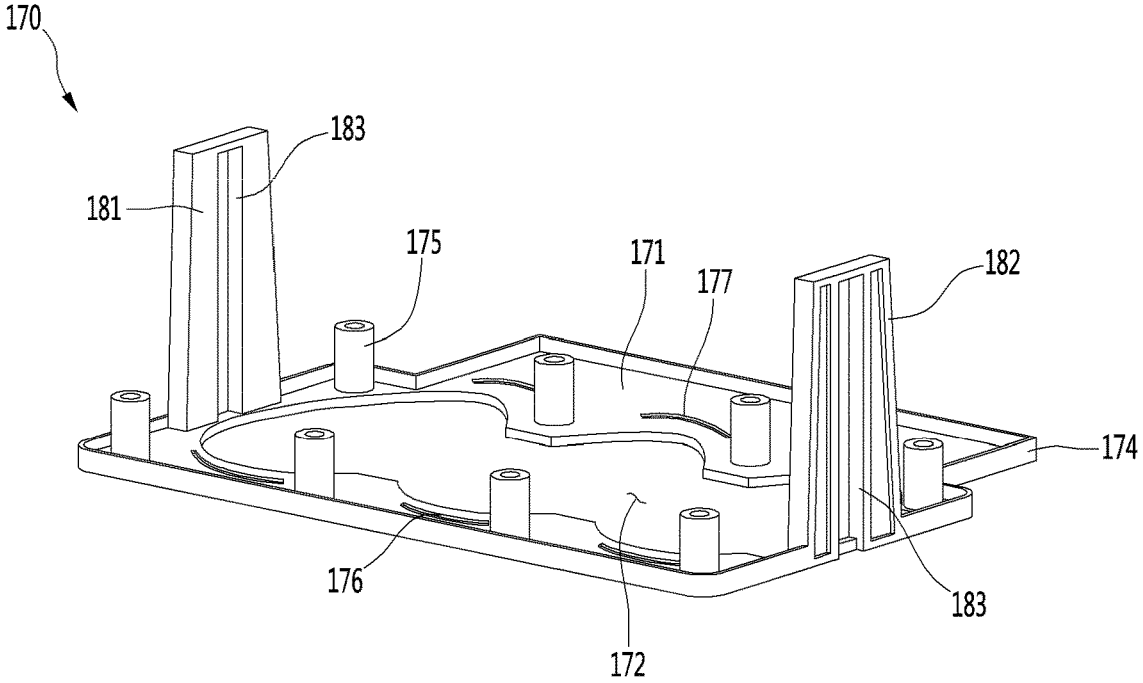
FIG. 22 is a perspective view of an upper support according to an embodiment of the present disclosure viewed from above.
Figure 23:
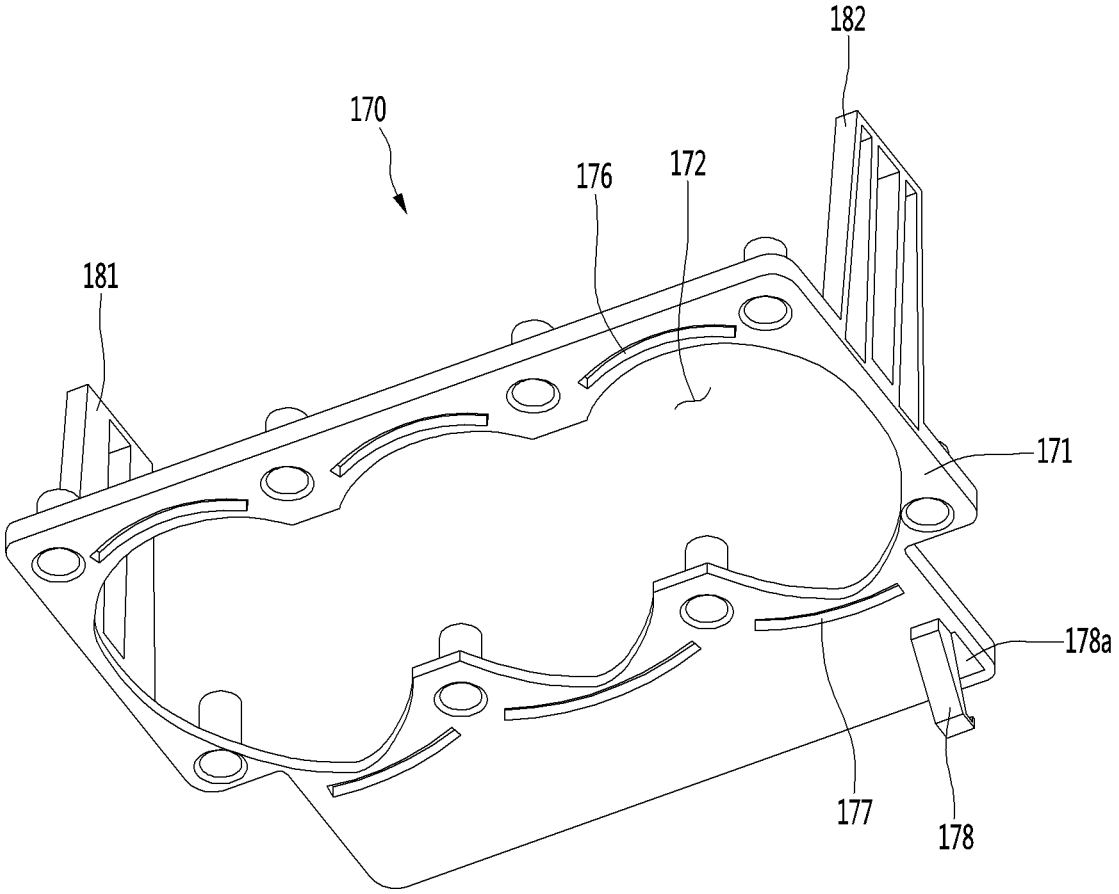
FIG. 23 is a perspective view of an upper support viewed from below.

FIG. 22 is a perspective view of an upper support according to an embodiment of the present disclosure viewed from above. Further, FIG. 23 is a perspective view of an upper support viewed from below. Further, FIG. 24 is a cross-sectional view showing a coupling structure of an upper assembly according to an embodiment of the present disclosure.

Figure 24:
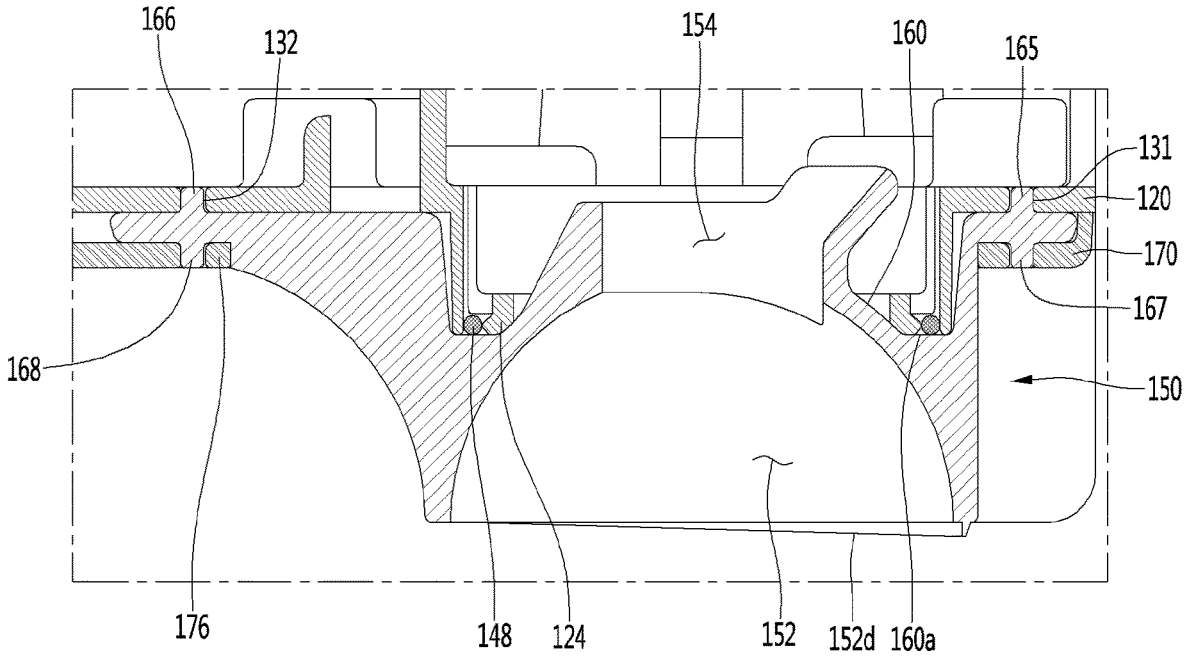
FIG. 24 is a cross-sectional view showing a coupling structure of an upper assembly according to an embodiment of the present disclosure.

Referring to FIGS. 22 to 24, the upper support 170 may include a plate shaped support plate 171 that supports the upper tray 150 from below. Further, a top face of the support plate 171 may be in contact with the bottom face 164*b* of the horizontal extension 164 of the upper tray 150.

The support plate 171 may have a plate opening 172 defined therein to be penetrated by the upper tray body 151. A side wall 174, which is bent upward, may be formed along an edge of the support plate 171. The side wall 174 may be in contact with a perimeter of the side of the horizontal extension 164 to restrain the upper tray 150.

The support plate 171 may include a plurality of lower slots 176 and a plurality of lower slots 177. The plurality of lower slots 176 and the plurality of lower slots 177 may include a plurality of first lower slots 176 into which the first lower protrusions 167 are inserted respectively and a plurality of second lower slots 177 into which the second lower protrusions 168 are inserted respectively.

The plurality of first lower slots 176 and the plurality of second lower slots 177 may be formed to be inserted into each other in a shape corresponding to a position corresponding to the first lower protrusion 167 and the second lower protrusion 168, respectively.

The first lower slot 176 may be defined to have a shape corresponding to the first lower protrusion 167 at a position corresponding to the first lower protrusion 167 such that the first lower protrusion 167 may be inserted into the first lower slot 176. Further, the second lower slot 177 may be defined to have a shape corresponding to the second lower protrusion 168 at a position corresponding to the second lower protrusion 168 such that the second lower protrusion 168 may be inserted into the second lower slot 177.

The support plate 171 may further include a plurality of coupling bosses 175. The plurality of coupling bosses 175 may protrude upward from the top face of the support plate 171. Each coupling boss 175 may be inserted into the sleeve 133 of the upper casing 120 by passing through the through-hole 169 of the horizontal extension 164.

In a state in which the coupling boss 175 is inserted into the sleeve 133, a top face of the coupling boss 175 may be located at the same vertical level or below the top face of the sleeve 133. The fastener such as a bolt may be fastened to the coupling boss 175, so that the assembly of the upper assembly 110 may be completed, and the upper casing 120, the upper tray 150, and upper support 170 may be rigidly coupled to each other.

The upper support 170 may further include a plurality of unit guides 181 and 182 for guiding the connector 350 connected to the upper ejector 300. The plurality of unit guides 181 and 182 may be respectively formed at both ends of the upper plate 170 to be spaced apart each other, and may be respectively formed at positions facing away from each other.

The unit guides 181 and 182 may respectively extend upwards from the both ends of the support plate 171. Further, a guide slot 183 extending in the vertical direction may be defined in each of the unit guides 181 and 182.

In a state in which each of both ends of the ejector body 310 of the upper ejector 300 penetrates the guide slot 183, the connector 350 is connected to the ejector body 310. Thus, in the pivoting process of the lower assembly 200, when the pivoting force is transmitted to the ejector body 310 by the connector 350, the ejector body 310 may vertically move along the guide slot 183.

In one example, a plate electrical-wire guide 178 extending downward may be formed at one side of the support plate 171. The plate electrical-wire guide 178 is for guiding the electrical wire connected to the lower heater 296, which may be formed in a hook shape extending downward. The plate electrical-wire guide 178 is formed on an edge of the support plate 171 to minimize interference of the electrical-wire with other components.

Further, an electrical-wire opening 178*a* may be defined in the support plate 171 to correspond to the plate electrical-wire guide 178. The electrical-wire opening 178*a* may direct the electrical-wire guided by the plate electrical-wire guide 178 to pass through the support plate 171 and toward the upper casing 120.

In one example, as shown in FIGS. 13 and 24, the heater-mounted portion 124 may be formed in the upper casing 120. The heater-mounted portion 124 may be formed on the bottom of the cavity 122 defined along the tray opening 123, and may include a heater-receiving groove 124*a* defined therein for accommodating the upper heater 148 therein.

The upper heater 148 may be a wire type heater. Thus, the upper heater 148 may be inserted into the heater-receiving groove 124*a*, and may be disposed along a perimeter of the tray opening 123 of the curved shape. The upper heater 148 is brought to be in contact with the upper tray 150 by the assembling the upper assembly 110, so that the heat transfer to the upper tray 150 may be achieved.

Further, the upper heater 148 may be a DC powered DC heater. When the upper heater 148 is operated for the ice-removal, heat from the upper heater 148 may be transferred to the upper tray 150, so that the ice may be separated from a surface (inner face) of the upper tray 150.

When the upper tray 150 is made of the metal material and as the heat from the upper heater 148 is strong, after the upper heater 148 is turned off, a portion of the ice heated by the upper heater 148 adheres again to the surface of the upper tray 150, so that the ice becomes opaque.

In other words, an opaque strip of a shape corresponding to the upper heater is formed along a circumference of the ice.

However, in the present embodiment, the DC heater having a low output is used, and the upper tray 150 is made of silicone, so that an amount of the heat transferred to the upper tray 150 is reduced and a thermal conductivity of the upper tray 150 itself is lowered.

Therefore, since the heat is not concentrated in a local portion of the ice, and a small amount of the heat is gradually applied to the ice, the formation of the opaque strip along the circumference of the ice may be prevented while the ice is effectively separated from the upper tray 150.

The upper heater 148 may be disposed to surround the perimeter of each of the plurality of upper chambers 152 such that the heat from the upper heater 148 may be evenly transferred to the plurality of upper chambers 152 of the upper tray 150.

In one example, as shown in FIG. 24, in a state in which the upper heater 148 is coupled to the heater-mounted portion 124 of the upper casing 120, the upper assembly may be assembled by coupling the upper casing 120, the upper tray 150, and upper support 170 with each other.

In this connection, the first upper protrusion 165 of the upper tray 150 may be inserted into the first upper slot 131 of the upper casing 120, and the second upper protrusion 166 of the upper tray 150 may be inserted into the second upper slot 132 of the upper casing 120.

Further, the first lower protrusion 167 of the upper tray 150 may be inserted into the first lower slot 176 of the upper support 170, and the second lower protrusion 168 of the upper tray may be inserted into the second lower slot 177 of the upper support 170.

Then, the coupling boss 175 of the upper support 170 passes through the through-hole 169 of the upper tray 150 and is received within the sleeve 133 of the upper casing 120. In this state, the fastener such as the bolt may be fastened to the coupling boss 175 from upward of the coupling boss 175.

When the upper assembly 110 is assembled, the heater-mounted portion 124 in combination with the upper heater 148 is received in the first receiving space 160 of the upper tray 150. In a state in which the heater-mounted portion 124 is received in the first receiving space 160, the upper heater 148 is in contact with the bottom face 160*a* of the first receiving space 160.

As in the present embodiment, when the upper heater 148 is accommodated in the heater-mounted portion 124 in the recessed form and in contact with the upper tray body 151, the transferring of the heat from the upper heater 148 to other components other than the upper tray body 151 may be minimized.

In one example, the present disclosure may also include another example of another ice-maker. In another embodiment of the present disclosure, there are differences only in a structure of the upper tray 150 and a structure of the shield 125 of the upper casing 120, and other components will be identical. The same component will not be described in detail and will be described using the same reference numerals.

Hereinafter, structures of the upper tray and the shield according to another embodiment of the present disclosure will be described with reference to the drawings.

Figure 25:
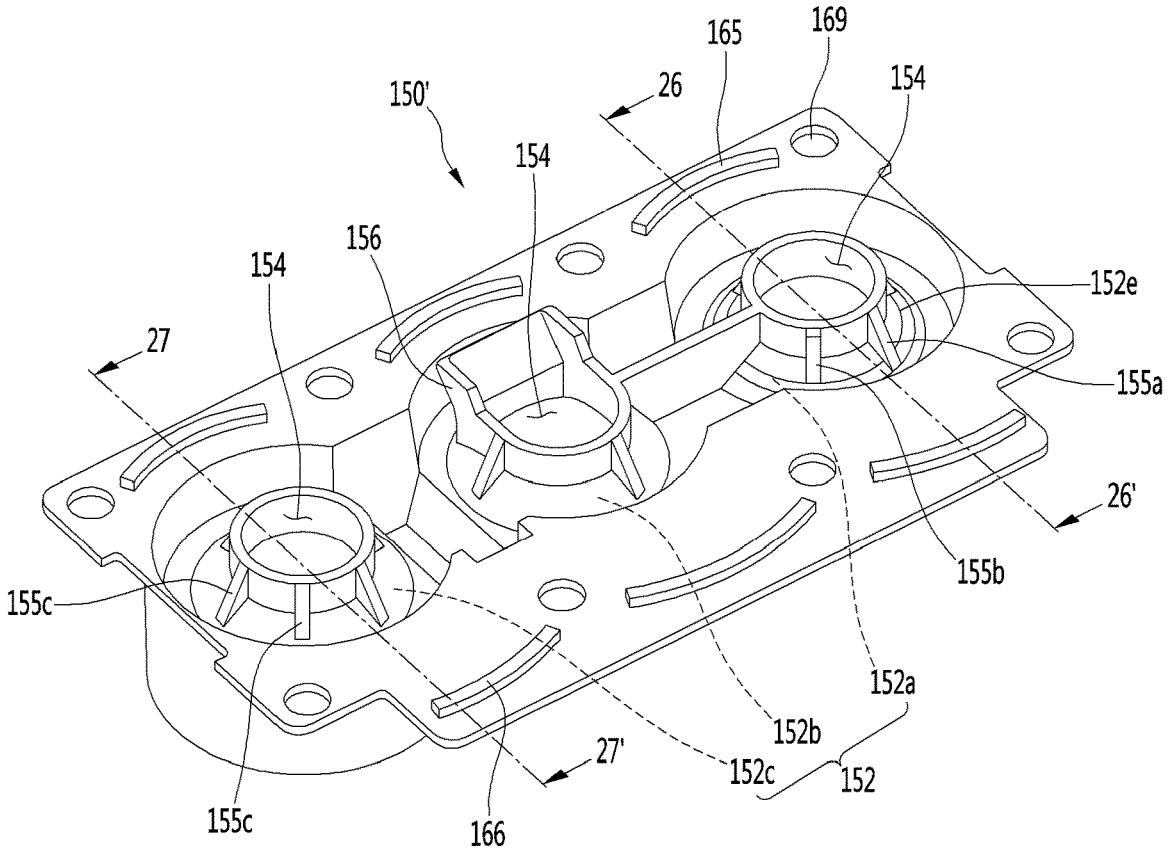
FIG. 25 is a perspective view of an upper tray according to another embodiment of the present disclosure viewed from above.
Figure 26:
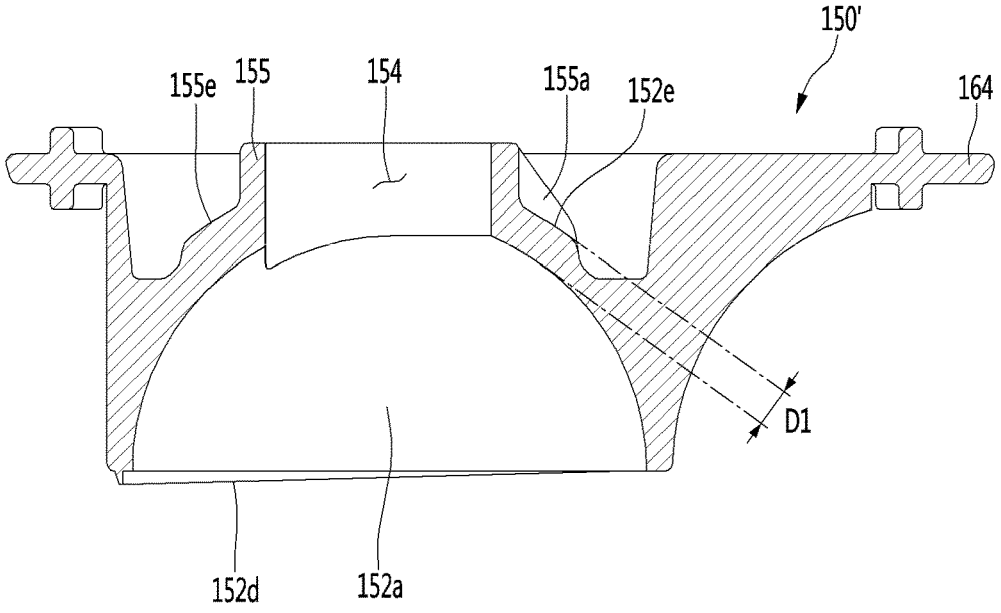
FIG. 26 is a cross-sectional view of FIG. 25 taken along a line 26-26'.
Figure 27:
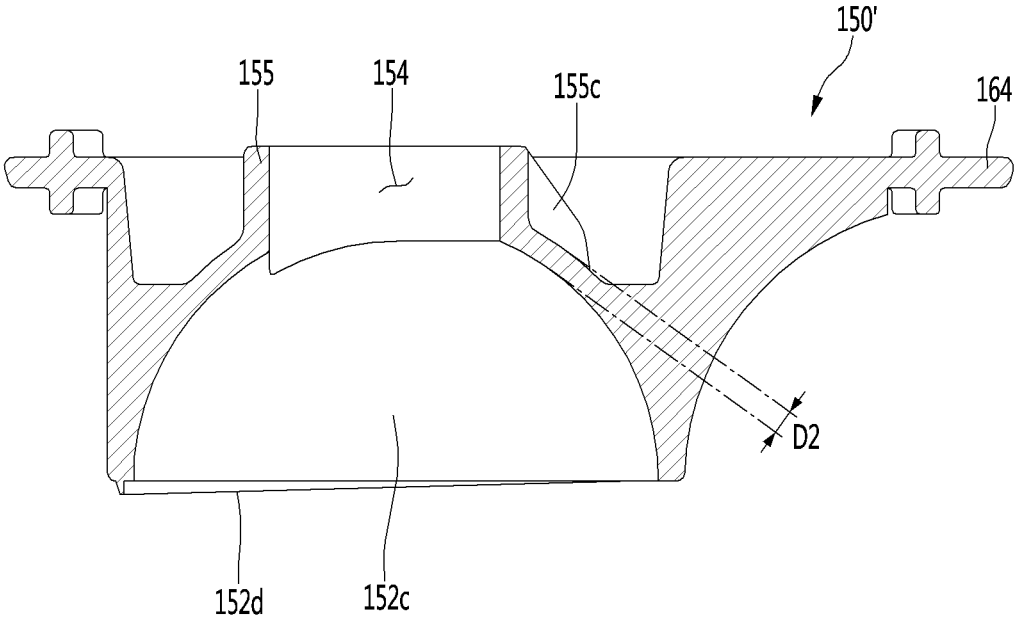
FIG. 27 is a cross-sectional view of FIG. 25 taken along a line 27-27'.
Figure 28:
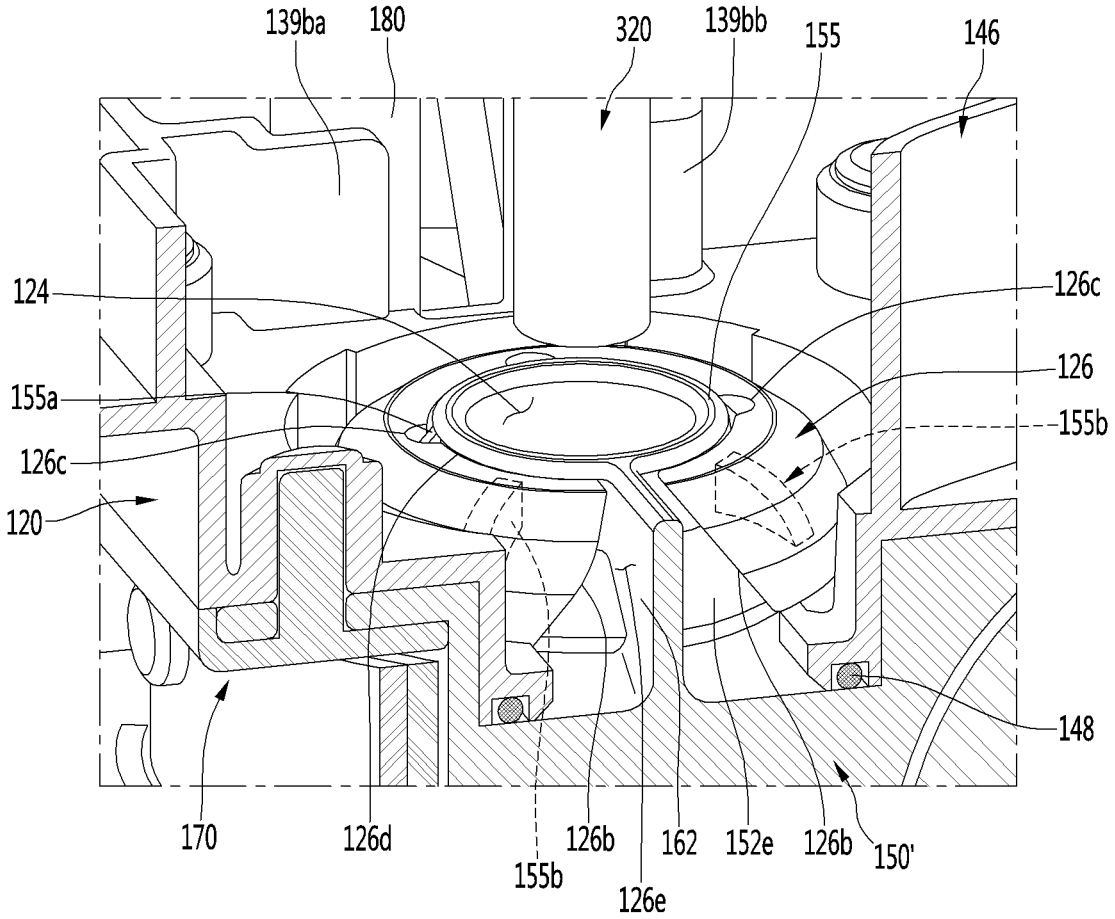
FIG. 28 is a partially-cut perspective view showing a structure of a shield of an upper casing according to another embodiment of the present disclosure.

FIG. 25 is a perspective view of an upper tray according to another embodiment of the present disclosure viewed from above. Further, FIG. 26 is a cross-sectional view of FIG. 25 taken along a line 26-26'. Further, FIG. 27 is a cross-sectional view of FIG. 25 taken along a line 27-27'. Further, FIG. 28 is a partially-cut perspective view showing a structure of a shield of an upper casing according to another embodiment of the present disclosure.

As shown in FIGS. 25 to 28, an upper tray 150' according to another embodiment of the present disclosure differs only in structures of the opening-defining wall 155 and the top face of the upper chamber 152 connected with the opening-defining wall 155, but other components thereof are the same as in the above-described embodiment.

The upper tray 150' includes the horizontal extension 142 formed thereon. Further, the horizontal extension 142 may include the first upper protrusion 165, the second upper protrusion 166, the first lower protrusion 167, and the second lower protrusion 168 formed thereon. Further, the through-hole 169 may be defined in the horizontal extension 142.

Further, the upper chamber 152 may be formed in the upper tray body 151 extending downward from the horizontal extension 142. The upper chamber 152 may include the first upper chamber 152*a*, the second upper chamber 152*b*, and the third upper chamber 152*c* arranged successively from a side close to the cold-air guide 145.

The opening-defining wall 155 that defines the ejector-receiving opening 154 may be formed on each of the upper chambers 152. Further, the water-supply guide 156 may be formed on the opening-defining wall 155 of the second upper chamber 152*b*. In one example, a plurality of ribs that connect the outer face of the opening-defining wall 155 and the top face of the upper chamber 152 may be arranged on the opening-defining wall 155 of each the upper chambers 152.

In detail, the plurality of radially arranged first connection ribs 155*a* may be formed on the first upper chamber 152*a* and the second upper chamber 152*b*. The first connection rib 155*a* may prevent the deformation of the opening-defining wall 155. Further, the first upper chamber 152*a* and the second upper chamber 152*b* may be connected with each other by a second connection rib 162, and the deformation of the first upper chamber 152*a*, the second upper chamber 152*b*, and the opening-defining wall 155 may be further prevented.

Further, the third upper chamber 152*c* may be spaced apart for mounting the temperature sensor 500. Thus, a plurality of third connection ribs 155*c* may be formed to prevent deformation of the opening-defining wall 155 formed upward of the third upper chamber 152*c*. The plurality of third connection ribs 155*c* may be formed in the same shape as the first connection rib 155*a*, and may be arranged at an interval narrower than in the first upper chamber 152*a* or the second upper chamber 152*b*. That is, the third upper chamber 152*c* will have more ribs than the other chambers 152*a* and 152*b*. Thus, even when the third upper chamber 152*c* is placed separately, a shape the third upper chamber 152*c* may be maintained, and the third upper chamber 152*c* may be prevented from deforming easily.

In one example, a thermally-insulating portion 152*e* may be formed on the top face of the first upper chamber 152*a*. The thermally-insulating portion 152*e* is for further blocking the cold-air passing through the upper tray 150' and upper casing 120, which further protrudes along the perimeter of the first upper chamber 152*a*. The thermally-insulating portion 152*e* is a face exposed through the top face of the first upper chamber 152*a*, that is, exposed upwardly of the upper tray 150', which is formed along the perimeter of the bottom of the opening-defining wall 155.

In detail, as shown in FIGS. 26 and 27, a thickness D1 of the upper face of the first upper chamber 152*a* may be larger than a thickness D2 of the upper faces of the second upper chamber 152*b* and of the third upper chamber 152*c* by the thermally-insulating portion 152*e*.

When the thickness of the first upper chamber 152*a* is larger by the thermally-insulating portion 152*e*, even in a state in which the supplied cold-air is concentrated on the first upper chamber 152*a* side by the cold-air guide 145, the amount of the cold-air transferred to the first upper chamber 152*a* may be reduced. As a result, the thermally-insulating portion 152*e* may reduce the ice formation speed in the first upper chamber 152*a*. Thus, the ice formation may occur first in the second upper chamber 152*b* or the ice formation may occur at a uniform speed in the upper chambers 152.

In one example, the shield 126 that extends from the cavity 122 of the upper casing 120 may be formed upward of the first upper chamber 152*a*. The shield 126 protrudes upward to cover the top face of the first upper chamber 152*a*, and may be formed round or inclined.

A shield opening 126*a* is defined at a top of the shield 126, and the shield opening 126*a* is in contact with the top of the ejector-receiving opening 154. Therefore, when the upper tray 150' is viewed from above, the remaining portion of the first upper chamber 152*a* except for the ejector-receiving opening 154 is covered by the shield 126. That is, a region of the thermally-insulating portion 152*e* is covered by the shield 126.

Further, a rib groove 126*c* to be inserted into the top of the first connection rib 155*a* may be defined along a circumference of the shield opening 126*a*, so that positions of the top of the first upper chamber 152*a* and the opening-defining wall 155 may be maintained in place.

With such structure, the first upper chamber 152*a* may be thermally-insulated further, and the ice formation speed in the first upper chamber 152*a* may be reduced despite the cold-air concentratedly supplied by the cold-air guide 145.

In one example, a cut 126*e* may be defined in the shield 126 corresponding to the second connection rib 162. The cut 126*e* is formed by cutting a portion of the shield 125, which may be opened to allow the second connection rib 162 to pass therethrough completely.

When the cut 126*e* is too narrow, in a process in which the upper tray 150' is deformed during the ice-removal process by the upper ejector 300, the second connection rib 162 may be deviated from the cut 126*e* and jammed. In this case, the second connection rib 162 is unable to return to its original position after the ice-removal, causing defects during the ice-making. On the contrary, when the cut 126*e* is too wide, the thermal insulation effect may be significantly reduced due to the inflow of the cold-air.

Thus, in the present embodiment, a width of the cut 126*e* may decrease upwardly. That is, both ends 126*b* of the cut 126*e* may be formed in an inclined or rounded shape, so that a width of a bottom of the cut 126*e* may be the widest and a width of a top of the cut 126*e* may be the narrowest. Further, the width of the top of the cut 126*e* may correspond to or be somewhat larger than the thickness of the second connection rib 162.

Therefore, when the upper tray 150' is deformed and then restored during the ice-removal by the upper ejector 300, the second connection rib 162 may be easily inserted into the cut 126*e* and moved along both ends of the cut 126*e*, so that the upper tray 150' may be restored at a correct position.

In one example, when the opening of the bottom of the cut 126*e* becomes large, the cold-air may be introduced through the bottom of the cut 126*e*. In order to prevent this, fourth connection ribs 155*b* may be formed along the perimeter of the first upper chamber 152*a*.

Like the first connection rib 155*a*, the fourth connection rib 155*b* may be formed to connect the outer face of the opening-defining wall 155 and the upper face of the first upper chamber 152*a* with each other, and an outer end thereof may be inclined. Further, a height of the fourth connection rib 155*b* may be smaller than that of the first connection rib 155*a*, so that the fourth connection rib 155*b* may be in contact with the bottom face of the shield without interfering with the top of the shield 126.

The fourth connection ribs 155*b* may be respectively located at both left and right sides around the second connection rib 162. Further, the fourth connection ribs 155*b* may be respectively located at positions corresponding to the both ends of the cut 126*e* or slightly outward of the both ends of the cut 126*e*. The fourth connection ribs 155*b* may be in close contact with the inner face of the shield 126. Thus, a space between the shield 126 and the top face of the first upper chamber 152*a* may be shielded to prevent the cold-air from entering through the cut 126*e*.

The shield 126 and the top face of the first upper chamber 152*a* may be somewhat spaced apart from each other, and an air layer may be formed therebetween. The inflow of the cold-air from the air layer may be blocked by the fourth connection rib 155*b*. Therefore, the top face of the first upper chamber 152*a* may be further thermally insulated to further reduce the ice formation speed in the first upper chamber 152*a*.

Hereinafter, the lower assembly 200 will be described in more detail with reference to the accompanying drawings.

Figure 29:
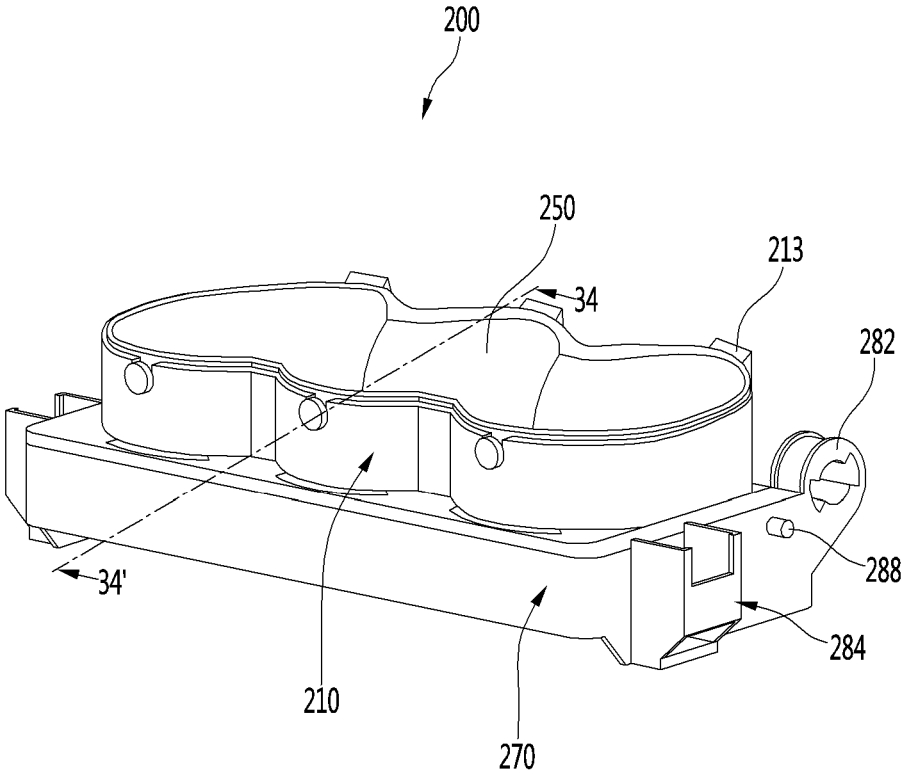
FIG. 29 is a perspective view of a lower assembly according to an embodiment of the present disclosure.
Figure 30:
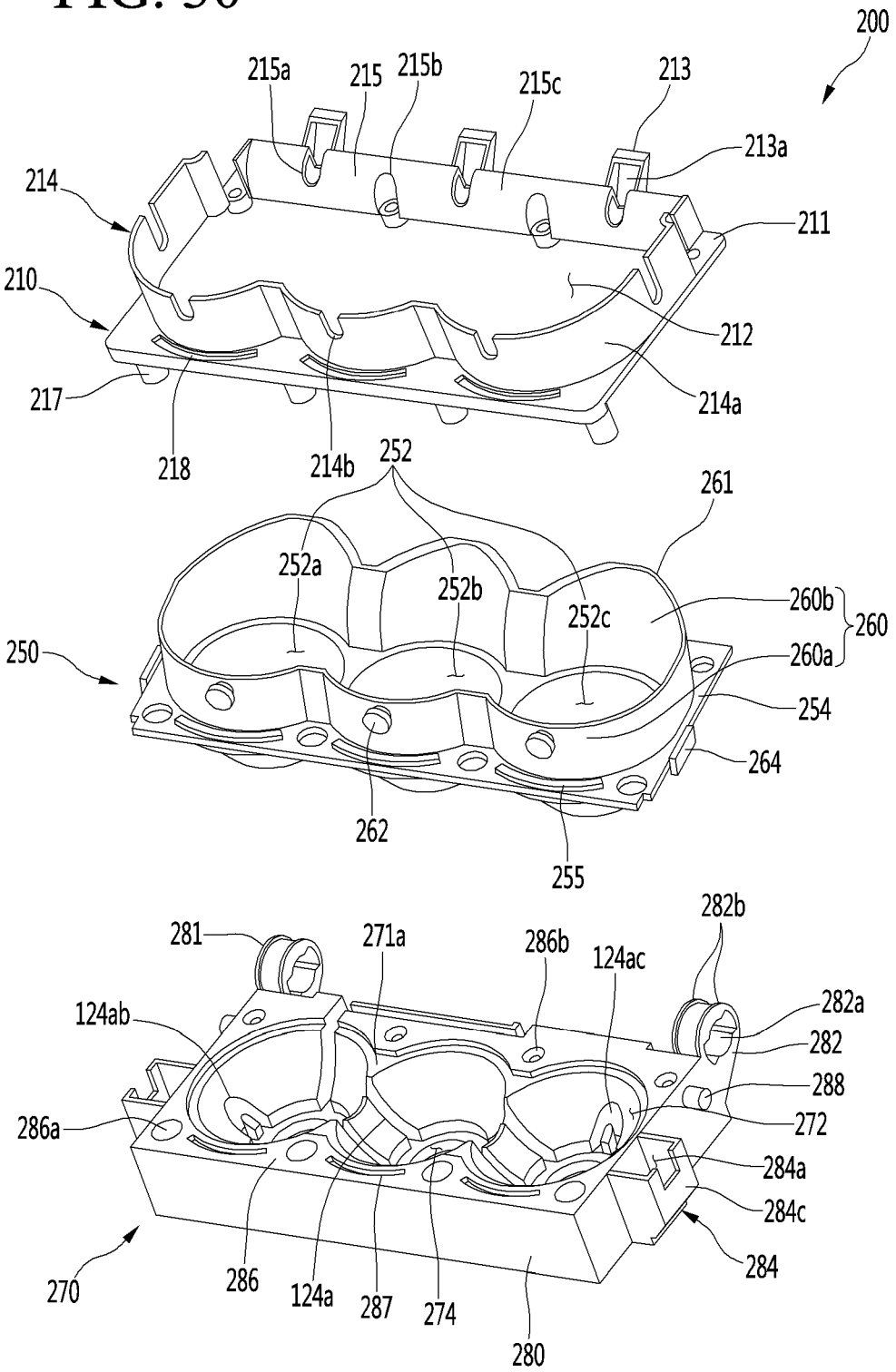
FIG. 30 is an exploded perspective view of a lower assembly viewed from above.

FIG. 29 is a perspective view of a lower assembly according to an embodiment of the present disclosure. Further, FIG. 30 is an exploded perspective view of a lower assembly viewed from above. Further, FIG. 31 is an exploded perspective view of a lower assembly viewed from below.

Figure 31:
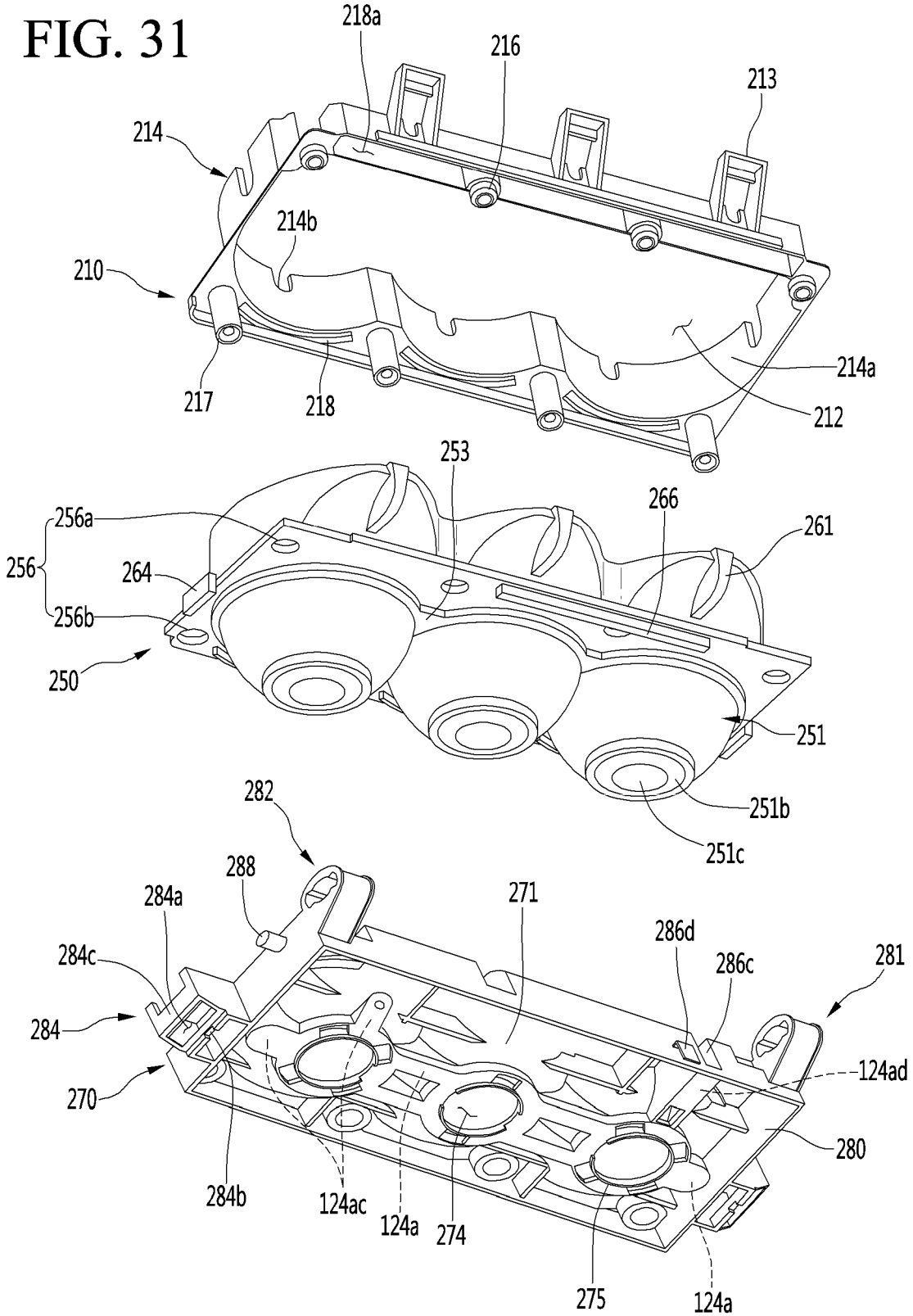
FIG. 31 is an exploded perspective view of a lower assembly viewed from below.

As shown in FIGS. 29 to 31, the lower assembly 200 may include a lower tray 250, a lower support 270 and a lower casing 210.

The lower casing 210 may surround a portion of a perimeter of the lower tray 250, and the lower support 270 may support the lower tray 250. Further, the connector 350 may be coupled to both sides of the lower support 270.

The lower casing 210 may include a lower plate 211 for fixing the lower tray 250. A portion of the lower tray 250 may be fixed in contact with a bottom face of the lower plate 211. The lower plate 211 may be provided with an opening 212 defined therein through which a portion of the lower tray 250 penetrates.

In one example, when the lower tray 250 is fixed to the lower plate 211 in a state of being positioned below the lower plate 211, a portion of the lower tray 250 may protrude upward of the lower plate 211 through the opening 212.

The lower casing 210 may further include a side wall 214 surrounding the the portion of the lower tray 250 passed through the lower plate 211. The side wall 214 may include a vertical portion 214*a* and a curved portion 215.

The vertical portion 214*a* is a wall extending vertically upward from the lower plate 211. The curved portion 215 is a wall that is rounded upwardly in a direction farther away from the opening 212 upwards from the lower plate 211.

The vertical portion 214*a* may include a first coupling slit 214*b* defined therein to be coupled with the lower tray 250. The first coupling slit 214*b* may be defined as a top of the vertical portion 214*a* is recessed downward.

The curved portion 215 may include a second coupling slit 215*a* defined therein to be coupled with the lower tray 250. The second coupling slit 215*a* may be defined as a top of the curved portion 215 is recessed downward. The second coupling slit 215*a* may restrain a lower portion of the second coupling protrusion 261 protruding from the lower tray 250.

Further, a protruding confiner 213 protruding upward may be formed on a rear face of the curved portion 215. The protruding confiner 213 may be formed at a position corresponding to the second coupling slit 215*a*, and may protrude outward from a face in which the second coupling slit 215*a* is defined to restrain an upper portion of the second coupling protrusion 261.

That is, both top and bottom of the second coupling protrusion 261 may be restrained by the second coupling slit 215*a* and the protruding confiner 213, respectively. Thus, the lower tray 250 may be firmly fixed to the lower casing 210.

Structure of the second coupling protrusion 261, the second coupling slit 215*a*, and the protruding confiner 213 will be described in more detail below.

In one example, the lower casing 210 may further include a first coupling boss 216 and a second coupling boss 217. The first coupling boss 216 may protrude downward from the bottom face of the lower plate 211. In one example, a plurality of first coupling bosses 216 may protrude downward from the lower plate 211.

The second coupling boss 217 may protrude downward from the bottom face of the lower plate 211. In one example, a plurality of second coupling bosses 217 may protrude from the lower plate 211.

In the present embodiment, a length of the first coupling boss 216 and a length of the second coupling boss 217 may be different. In one example, the length of the second coupling boss 217 may be larger than the length of the first coupling boss 216.

A first fastener may be fastened to the first coupling boss 216 from upward of the first coupling boss 216. On the other hand, a second fastener may be fastened to the second coupling boss 217 from below of the second coupling boss 217.

A groove 215*b* for a movement of the fastener may be defined in the curved portion 215 such that the first fastener does not interfere with the curved portion 215 in a process in which the first fastener is fastened to the first coupling boss 216.

The lower casing 210 may further include a slot 218 for coupling with the lower tray 250 defined therein. A portion of the lower tray 250 may be inserted into the slot 218. The slot 218 may be located adjacent to the vertical portion 214*a*.

The lower casing 210 may further include a receiving groove 218*a* defined therein for insertion of a portion of the lower tray 250. The receiving groove 218*a* may be defined as a portion of the lower plate 211 is recessed toward the curved portion 215.

The lower casing 210 may further include an extension wall 219 in contact with a portion of a perimeter of a side of the lower plate 212 in a state in which the lower casing 210 is coupled with the lower tray 250.

In one example, the lower tray 250 may be made of a flexible material or a flexible material such that the lower tray 250 may be deformed by an external force and then returned to its original form.

In one example, the lower tray 250 may be made of a silicone material. When the lower tray 250 is made of the silicone material as in the present embodiment, even when the external force is applied to the lower tray 250 and the shape of the lower tray 250 is deformed in the ice-removal process, the lower tray 250 may be returned to its original shape. Thus, the spherical ice may be generated despite the repeated ice generation.

Further, when the lower tray 250 is made of the silicone material, the lower tray 250 may be prevented from being melted or thermally deformed by heat provided from a lower heater to be described later.

In one example, the lower tray 250 may be made of the same material as the upper tray 150, or may be made of a material softer than the material of the upper tray 150. That is, when the lower tray 250 and the upper tray 150 come into contact with each other for the ice-making, since the lower tray 250 has a lower hardness, while the top of the lower tray 250 is deformed, the upper tray 150 and the lower tray 250 may be pressed and sealed with each.

Further, since the lower tray 250 has a structure that is repeatedly deformed by direct contact with the lower ejector 400, the lower tray 250 may be made of a material having a low hardness to facilitate the deformation.

However, when the hardness of the lower tray 250 is too low, another portion of the lower chamber 252 may be deformed too. Thus, it is preferable that the lower tray 250 is formed to have an appropriate hardness to maintain the shape.

The lower tray 250 may include a lower tray body 251 that forms a lower chamber 252 that is a portion of the ice chamber 111. The lower tray body 251 may form a plurality of lower chambers 252.

In one example, the plurality of lower chambers 252 may include a first lower chamber 252*a*, a second lower chamber 252*b*, and a third lower chamber 252*c*.

The lower tray body 251 may include three chamber walls 252*d* forming the three independent lower chambers 252*a*, 252*b*, and 252*c*. The three chamber walls 252*d* may be formed integrally to form the lower tray body 251. Further, the first lower chamber 252*a*, the second lower chamber 252*b*, and the third lower chamber 152*c* may be arranged in series.

The lower chamber 252 may be formed in a hemispherical form or a form similar to the hemisphere. That is, a lower portion of the spherical ice may be formed by the lower chamber 252. Herein, the form similar to the hemisphere means a form that is not a complete hemisphere but is almost close to the hemisphere.

The lower tray 250 may further include a lower tray mounting face 253 extending horizontally from a top edge of the lower tray body 251. The lower tray mounting face 253 may be formed continuously along a circumference of the top of the lower tray body 251. Further, in coupling with the upper tray 150, the lower tray mounting face 253 may be in close contact with the top face 153*c* of the upper tray 150.

The lower tray 250 may further include a side wall 260 extending upwardly from an outer end of the lower tray mounting face 253. Further, the side wall 260 may surround the upper tray body 151 seated on the top face of the lower tray body 251 in a state in which the upper tray 150 and the lower tray 250 are coupled together.

The side wall 260 may include a first wall 260*a* surrounding the vertical wall 153*a* of the upper tray body 151 and a second wall 260*b* surrounding the curved wall 153*b* of the upper tray body 151.

The first wall 260*a* is a vertical wall extending vertically from the top face of the lower tray mounting face 253. The second wall 260*b* is a curved wall formed in a shape corresponding to the upper tray body 151. That is, the second wall 260*b* may be rounded upwardly from the lower tray mounting face 253 in a direction farther away from the lower chamber 252. Further, the second wall 206*b* is formed to have a curvature corresponding to the curved wall 153*b* of the upper tray body 151, so that the lower assembly 200 may maintain a predetermined distance from the upper assembly 110 and may not interfere with the upper assembly 110 in a process of being pivoted.

The lower tray 250 may further include a tray horizontal extension 254 extending in the horizontal direction from the side wall 260. The tray horizontal extension 254 may be positioned higher than the lower tray mounting face 253. Thus, the lower tray mounting face 253 and the tray horizontal extension 254 form a step.

The tray horizontal extension 254 may include a first upper protrusion 255 formed thereon to be inserted into the slot 218 of the lower casing 210. The first upper protrusion 255 may be spaced apart from the side wall 260 in the horizontal direction.

In one example, the first upper protrusion 255 may protrude upward from the top face of the tray horizontal extension 254 at a location adjacent to the first wall 260*a*. The plurality of first upper protrusions 255 may be spaced apart from each other. The first upper protrusion 255 may extend, for example, in a curved form.

The tray horizontal extension 254 may further include a first lower protrusion 257 formed thereon to be inserted into a protrusion groove of the lower support 270 to be described later. The first lower protrusion 257 may protrude downward from a bottom face of the tray horizontal extension 254. A plurality of first lower protrusions 257 may be spaced apart from each other.

The first upper protrusion 255 and the first lower protrusion 257 may be located on opposite sides of the tray horizontal extension 254 in the vertical direction. At least a portion of the first upper protrusion 255 may overlap the second lower protrusion 257 in the vertical direction.

In one example, the tray horizontal extension 254 may include a plurality of through-holes 256 defined therein. The plurality of through-holes 256 may include a first through-hole 256*a* through which the first coupling boss 216 of the lower casing 210 penetrates, and a second through-hole 256*b* through which the second coupling boss 217 of the lower casing 210 penetrates.

A plurality of first through-holes 256*a* and a plurality of second through-holes 256*b* may be located opposite to each other around the lower chamber 252. Some of the plurality of second through-holes 256*b* may be located between two adjacent first upper protrusions 255. Further, some of the remaining second through-holes 256*b* may be located between two adjacent first lower protrusions 257.

The tray horizontal extension 254 may further include a second upper protrusion 258. The second upper protrusion 258 may be located opposite to the first upper protrusion 255 around the lower chamber 252.

The second upper protrusion 258 may be spaced apart from the side wall 260 in the horizontal direction. In one example, the second upper protrusion 258 may protrude upward from the top face of the tray horizontal extension 254 at a location adjacent to the second wall 260*b*.

The second upper protrusion 258 may be received in the receiving groove 218*a* of the lower casing 210. The second upper protrusion 258 may be in contact with the curved portion 215 of the lower casing 210 in a state in which the second upper protrusion 258 is received in the receiving groove 218*a*.

The side wall 260 of the lower tray 250 may include a first coupling protrusion 262 for coupling with the lower casing 210 formed thereon.

The first coupling protrusion 262 may protrude in the horizontal direction from the first wall 260*a* of the side wall 260. The first coupling protrusion 262 may be located on an upper portion of a side of the first wall 260*a*.

The first coupling protrusion 262 may include neck portion 262*a* which is reduced in diameter compared to other portions. The neck portion 262*a* may be inserted into the first coupling slit 214*b* which is defined in the side wall 214 of the lower casing 210.

The side wall 260 of the lower tray 250 may further include a second coupling protrusion 261. The second coupling protrusion 261 may be coupled with the lower casing 210.

The second coupling protrusion 261 may protrude from the second wall 260*b* of the side wall 260 and may be formed in a direction opposite to the first coupling protrusion 262. Further, the first coupling protrusion 262 and the second coupling protrusion 261 may be arranged to face away from each other around a center of the lower chamber 252. Thus, the lower tray 250 may be firmly fixed to the lower casing 210, and in particular, deviation and deformation of the lower chamber 252 may be prevented.

The tray horizontal extension 254 may further include a second lower protrusion 266. The second lower protrusion 266 may be positioned opposite the second lower protrusion 257 around the lower chamber 252.

The second lower protrusion 266 may protrude downward from the bottom face of the tray horizontal extension 254. The second lower protrusion 266 may extend, for example, in a straight line form. Some of the plurality of first through-holes 256*a* may be located between the second lower protrusion 266 and the lower chamber 252. The second lower protrusion 266 may be received in a guide groove defined in the lower support 270 to be described later.

The tray horizontal extension 254 may further include a lateral stopper 264. The lateral stopper 264 restricts a horizontal movement of the lower tray 250 in a state in which the lower casing 210 and the lower support 270 are coupled with each other.

The lateral stopper 264 protrudes laterally from the side of the tray horizontal extension 254, and a vertical length of the lateral stopper 264 is larger than a thickness of the tray horizontal extension 254. In one example, a portion of the lateral stopper 264 is positioned higher than the top face of the tray horizontal extension 254, and another portion thereof is positioned lower than the bottom face of the tray horizontal extension 254.

Thus, a portion of the lateral stopper 264 may be in contact with a side of the lower casing 210 and another portion thereof may be in contact with a side of the lower support 270. The lower tray body 251 may further include a convex portion 251*b* having an upwardly convex lower portion. That is, the convex portion 251*b* may be disposed to be convex inwardly of the ice chamber 111.

In one example, the lower support 270 may include a support body 271 for supporting the lower tray 250.

The support body 271 may include three chamber-receiving portions 272 defined therein for respectively accommodating the three chamber walls 252*d* of the lower tray 250 therein. The chamber-receiving portion 272 may be defined in a hemispherical shape.

The support body 271 may include a lower opening 274 defined therein to be penetrated by the lower ejector 400 in the ice-removal process. In one example, three lower openings 274 may be defined in the support body 271 to respectively correspond to the three chamber-receiving portions 272. A reinforcing rib 275 for strength reinforcement may be formed along a circumference of the lower opening 274.

A lower support step 271*a* for supporting the lower tray mounting face 253 may be formed on a top of the support body 271. Further, the lower support step 271*a* may be formed to be stepped downward from a lower support top face 286. Further, the lower support step 271*a* may be formed in a shape corresponding to the lower tray mounting face 253, and may be formed along a circumference of a top of the chamber-receiving portion 272.

The lower tray mounting face 253 of the lower tray 250 may be seated in the lower support step 271*a* of the support body 271, and the lower support top face 286 may surround the side of the lower tray mounting face 253 of the lower tray 250. In this connection, a face connecting the lower support top face 286 with the lower support step 271*a* may be in contact with the side of the lower tray mounting face 253 of the lower tray 250.

The lower support 270 may further include a protrusion groove 287 defined therein for accommodating the first lower protrusion 257 of the lower tray 250. The protrusion groove 287 may extend in a curved shape. The protrusion groove 287 may be formed, for example, in the lower support top face 286.

The lower support 270 may further include a first fastener groove 286*a* into which a first fastener B1 passed through the first coupling boss 216 of the upper casing 210 is fastened. The first fastener groove 286*a* may be defined, for example, in the lower support top face 286. Some of a plurality of first fastener grooves 286*a* may be located between two adjacent protrusion grooves 287*a*.

The lower support 270 may further include an outer wall 280 disposed to surround the lower tray body 251 while being spaced apart from the outer face of the lower tray body 251. The outer wall 280 may, for example, extend downwardly along an edge of the lower support top face 286.

The lower support 270 may further include a plurality of hinge bodies 281 and 282 to be respectively connected to hinge supports 135 and 136 of the upper casing 210. The plurality of hinge bodies 281 and 282 may be spaced apart from each other. Since the hinge bodies 281 and 282 differ only in mounting positions thereof, and structures and shapes thereof are identical, only a hinge body 292 at one side will be described.

Each of the hinge bodies 281 and 282 may further include a second hinge hole 282*a* defined therein. The second hinge hole 282*a* may be penetrated by a shaft connector 352*b* of the pivoting arms 351 and 352. The connection shaft 370 may be connected to the shaft connector 352*b*.

Further, each of the hinge bodies 281 and 282 may include a pair of hinge ribs 282*b* protruding along a circumference of each of the hinge bodies 281 and 282. The hinge rib 282*b* may reinforce the hinge bodies 281 and 282 and prevent the hinge bodies 281 and 282 from breaking.

The lower support 270 may further include a coupling shaft 283 to which the link 356 is pivotably connected. A pair of coupling shafts 383 may be provided on both faces of the outer wall 280, respectively.

Further, the lower support 270 may further include an elastic member receiving portion 284 to which the elastic member 360 is coupled. The elastic member receiving portion 284 may define a space 284*a* in which a portion of the elastic member 360 may be accommodated. As the elastic member 360 is received in the elastic member receiving portion 284, the elastic member 360 may be prevented from interfering with a surrounding structure.

Further, the elastic member receiving portion 284 may include a stopper 284*a* to which a bottom of the elastic member 370 is hooked. Further, the elastic member receiving portion 284 may include an elastic member shield 284*c* that covers the elastic member 360 to prevent insertion of a foreign material or fall of the elastic member 360.

In one example, a link shaft 288 to which one end of the link 356 is pivotably coupled may protrude at a position between the elastic member receiving portion 284 and each of the hinge bodies 281 and 282. The link shaft 288 may be provided forward and downward from a center of pivoting of each of the hinge bodies 281 and 282. With such arrangement, a vertical stroke of the upper ejector 300 may be secured, and the link 356 may be prevented from interfering with other components.

Hereinafter, the coupling structure of the lower tray 250 and the lower casing 210 will be described in more detail with reference to the accompanying drawings.

Figure 32:
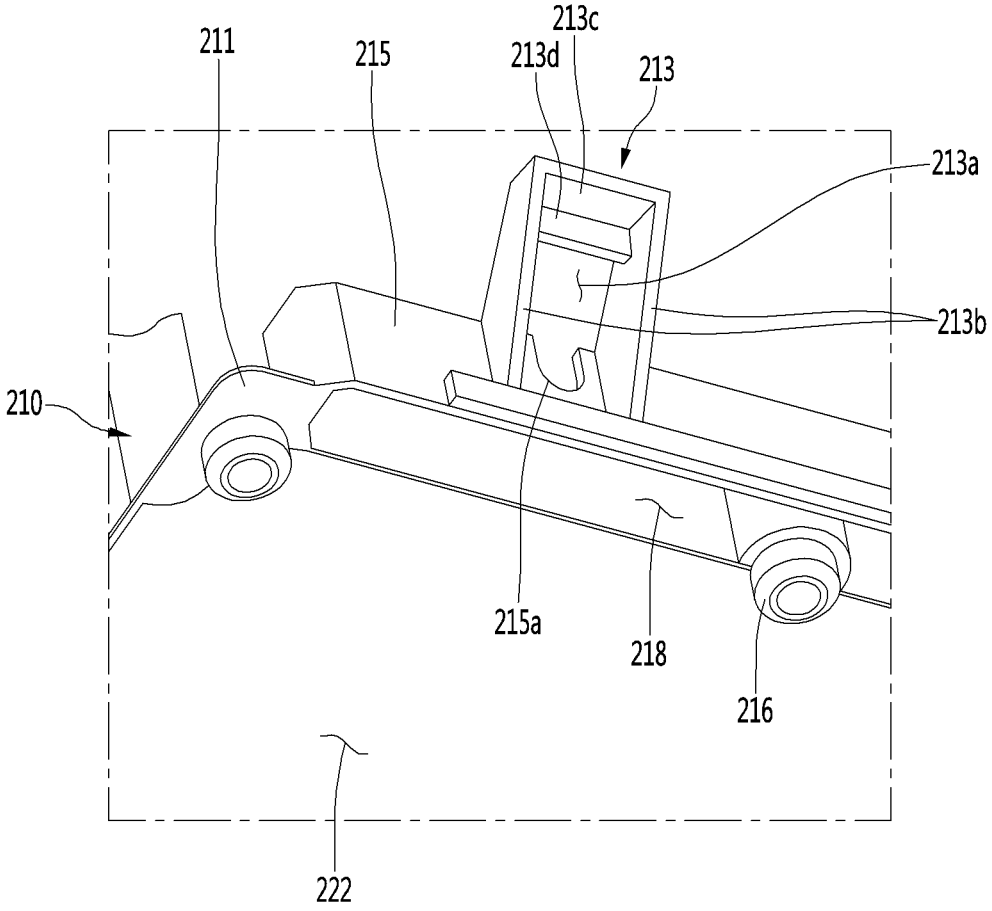
FIG. 32 is a partial perspective view illustrating a protruding confiner of a lower casing according to an embodiment of the present disclosure.
Figure 33:
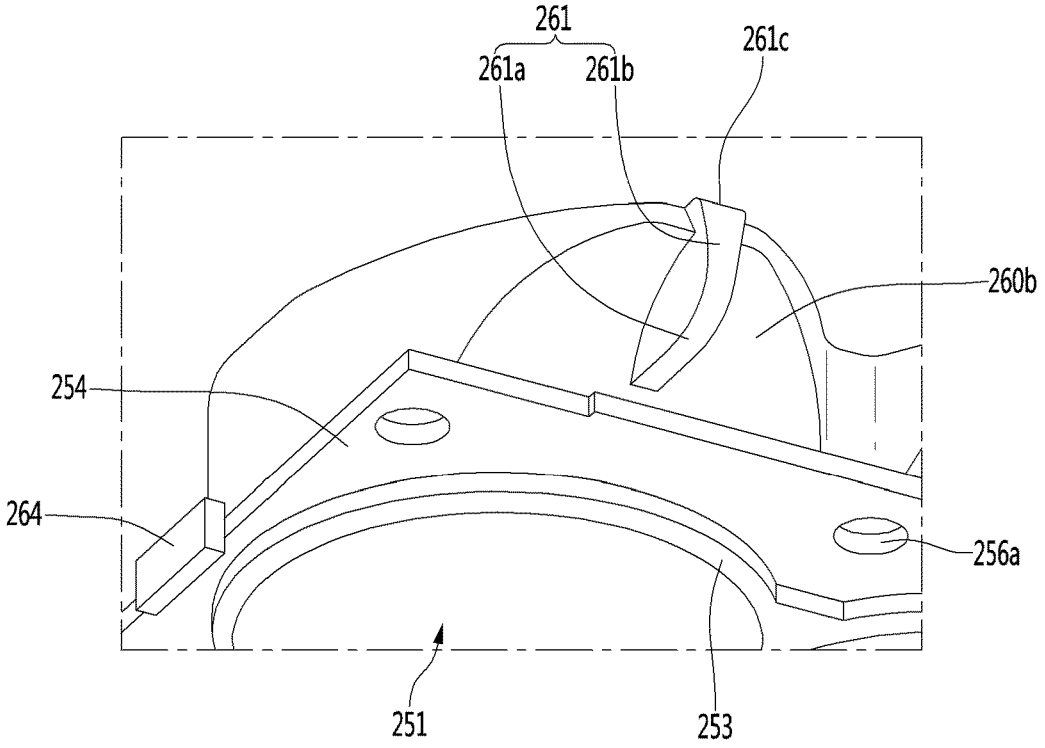
FIG. 33 is a partial perspective view illustrating a coupling protrusion of a lower tray according to an embodiment of the present disclosure.
Figure 34:
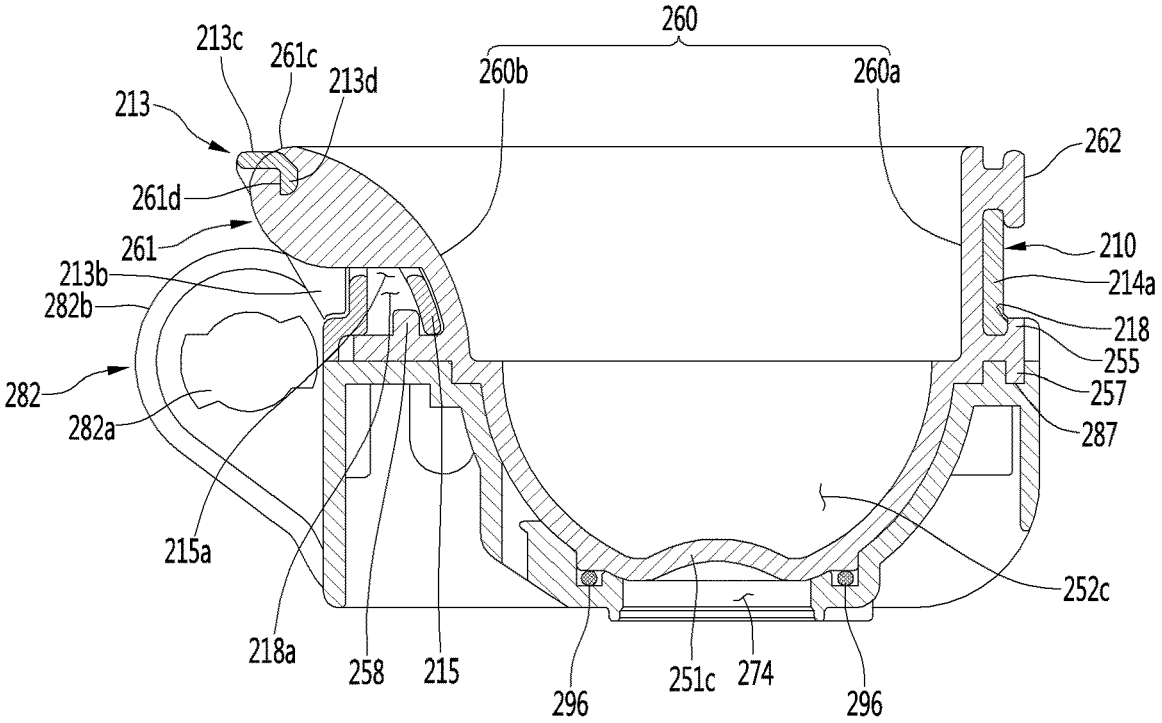
FIG. 34 is a cross-sectional view of a lower assembly.
Figure 35:
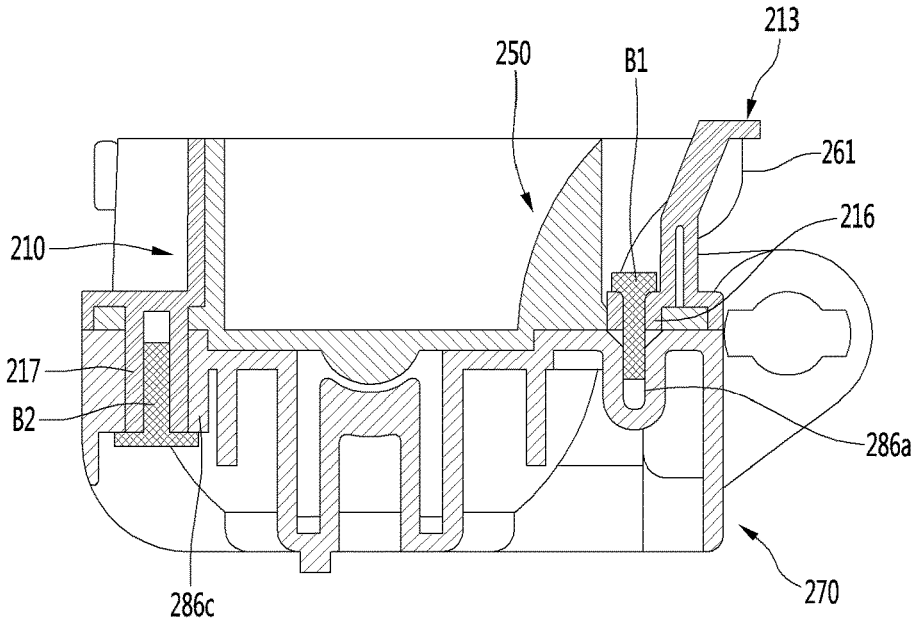
FIG. 35 is a cross-sectional view of FIG. 27 taken along a line 35-35'.

FIG. 32 is a partial perspective view illustrating a protruding confiner of a lower casing according to an embodiment of the present disclosure. Further, FIG. 33 is a partial perspective view illustrating a coupling protrusion of a lower tray according to an embodiment of the present disclosure. Further, FIG. 34 is a cross-sectional view of a lower assembly. Further, FIG. 35 is a cross-sectional view of FIG. 27 taken along a line 35-35'.

As shown in FIGS. 32 to 35, a protruding confiner 213 may protrude from the curved wall 215 of the upper casing 120. The protruding confiner 213 may be formed at a location corresponding to the second coupling slit 215*a* and the second coupling protrusion 261.

In detail, the protruding confiner 213 may include a pair of lateral portions 213*b* and a connector 213*c* connecting tops of the lateral portions 213*b* with each other. The pair of lateral portions 213*b* may be located on both sides around the second coupling slit 215*a*. Thus, the second coupling slit 215*a* may be located in an insertion space 213*a* defined by the pair of lateral portions 213*b* and the connector 213*c*. Further, the second coupling protrusion 261 may be inserted into the insertion space 213*a*. Thus, the lower portion of the second coupling protrusion 261 may be press-fitted into the second coupling slit 215*a*.

The pair of lateral portions 213*b* may extend to a vertical level corresponding to the top of the second coupling protrusion 261. Further, a confining rib 213*d* extending downwards may be formed inside the connector 213*c*.

The confining rib 213*d* may be inserted into the protrusion groove 261*d* defined in the top of the second coupling protrusion 261, and may restrain the second coupling protrusion 261 from falling. As such, both the upper and lower portions of the second coupling protrusion 261 may be fixed, and the lower tray 250 may be firmly fixed to the lower casing 210.

The second coupling protrusion 261 may protrude outwardly of the second wall 260*b*, and a thickness thereof may increase upwardly. That is, due to a self-load of the second coupling protrusion 261, the second wall 260*b* does not roll inward or deform, and the top of the second wall 260*b* is pulled outward.

Thus, in a process in which the lower tray 250 pivots in a reverse direction, the second coupling protrusion 261 prevents an end of the second wall 260*b* of the lower tray 250 from deforming in contact with the upper tray 150.

When the end of the second wall 260*b* of the lower tray 250 is deformed in contact with the upper tray 150, the lower tray 250 may be moved to a water-supply position while being inserted into the upper chamber 152 of the upper tray 150. In this state, when the ice-making is completed after the water supply is performed, the ice is not produced in the spherical form.

Thus, when the second coupling protrusion 261 protrudes from the second wall 260*a*, the deformation of the second wall 260*a* may be prevented. Thus, the second coupling protrusion 261 may be referred to as a deformation preventing protrusion.

The second coupling protrusion 261 may protrude in the horizontal direction from the second wall 260*a*. The second coupling protrusion may extend upward from a lower portion of the outer face of the second wall 260*b*, and a top of the second coupling protrusion 261 may extend to the same vertical level as the top of the second wall 260*a*.

Further, the second coupling protrusion 261 may include a protrusion lower portion 261*a* forming a lower portion thereof and a protrusion upper portion 261*b* forming an upper portion thereof.

The protrusion lower portion 261*a* may be formed to have a corresponding width to be inserted into the second coupling slit 215*a*. Thus, when the second coupling protrusion 261 is inserted into the insertion space of the protruding confiner 213, the protrusion lower portion 261*a* may be press-fitted into the second coupling slit 215*a*.

The protrusion upper portion 261*b* extends upward from a top of the protrusion lower portion 261*a*. The protrusion upper portion 261*b* may extend upward from a top of the second coupling slit 215*a*, and may extend to the connector 213*c*. In this connection, the protrusion upper portion 261*b* may protrude further rearward than the protrusion lower portion 261*a*, and may have a width larger than that of the protrusion lower portion 261*a*. Thus, the second wall 260*b* may be directed further outwards by a self-load of the protrusion upper portion 261*b*. That is, the protrusion upper portion 261*b* may pull the top of the second wall 260*b* outward to maintain the outer face of the second wall 260*b* and the curved wall 153*b* to be in close contact with each other.

Further, a protrusion groove 261*d* may be defined in a top face of the protrusion upper portion 261*b*, that is, a top face of the second coupling protrusion 261. The protrusion groove 261*d* is defined such that the confining rib 213*d* extending downward from the connector 213*c* may be inserted therein.

Thus, a bottom of the second coupling protrusion 261 may be pressed into the second coupling slit 215*a* and a top thereof may be restrained by the connector 213*c* and the confining rib 213*d* in a state of being received inside the insertion space 213*a*. Thus, the second coupling protrusion 261 may be in a state of being completely in close contact with and fixed to the lower casing 210 so as not to be in contact with the upper tray 150 during the pivoting process of the lower tray 250.

A round face 260*e* may be formed on the top of the second coupling protrusion 261 to prevent the second coupling protrusion 261 from interfering with the upper tray 150 in the pivoting process of the lower tray 250.

A lower portion 260*d* of the second coupling protrusion 261 may be spaced apart from the tray horizontal extension 254 of the lower tray 250 such that the lower portion 260*d* of the second coupling protrusion 261 may be inserted into the second coupling slit 215*a*.

In one example, as shown in FIG. 35, the lower support 270 may further include a boss through-hole 286*b* to be penetrated by the second coupling boss 217 of the upper casing 210. The boss through-hole 286*b* may be, for example, defined in the lower support top face 286. The lower support top face 286 may include a sleeve 286*c* surrounding the second coupling boss 217 passed through the boss through-hole 286*b*. The sleeve 286*c* may be formed in a cylindrical shape with an open bottom.

The first fastener B1 may be fastened into the first fastener groove 286*a* after passing through the first coupling boss 216 from upward of the lower casing 210. Further, the second fastener B2 may be fastened to the second coupling boss 217 from downward of the lower support 270.

A bottom of the sleeve 286*c* may be positioned flush with the bottom of the second coupling boss 217 or lower than the bottom of the second coupling boss 217.

Thus, in the fastening process of the second fastener B2, a head of the second fastener B2 may be in contact with the second coupling boss 217 and a bottom face of the sleeve 286*c* or in contact with the bottom face of the sleeve 286*c*.

The lower casing 210 and the lower support 270 may be firmly coupled to each other by the fastening of the first fastener B1 and the second fastener B2. Further, the lower tray 250 may be fixed between the lower casing 210 and the lower support 270.

In one example, the lower tray 250 comes into contact with the upper tray 150 by the pivoting, and the upper tray 150 and the lower tray may always be sealed with each other during the ice-making. Hereinafter, a sealing structure based on the pivoting of the lower tray 250 will be described in detail with reference to the accompanying drawings.

Figure 36:
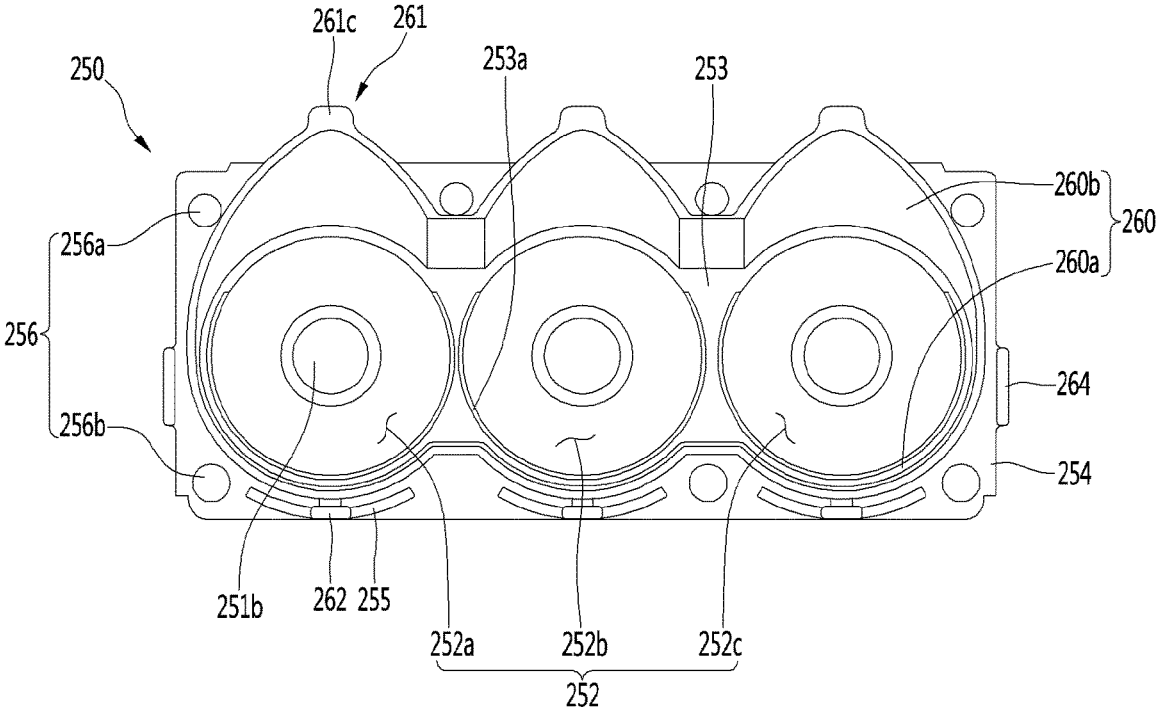
FIG. 36 is a plan view of a lower tray.
Figure 37:
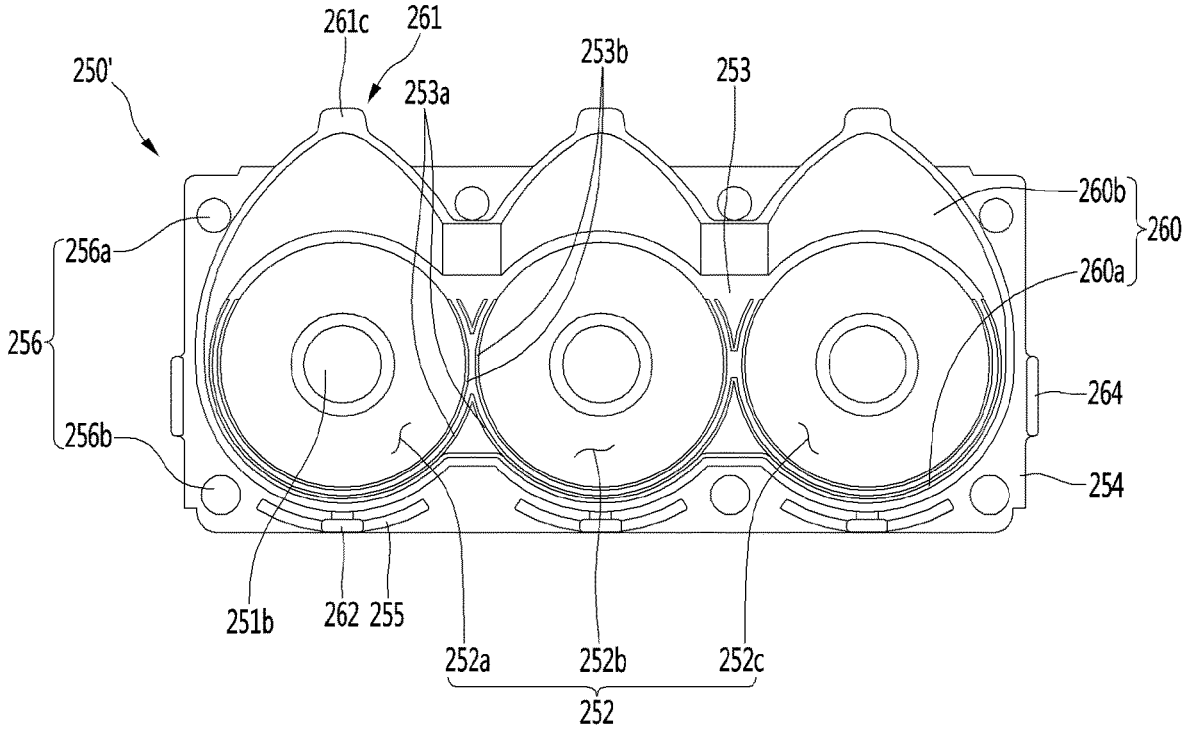
FIG. 37 is a perspective view of a lower tray according to another embodiment of the present disclosure.
Figure 38:
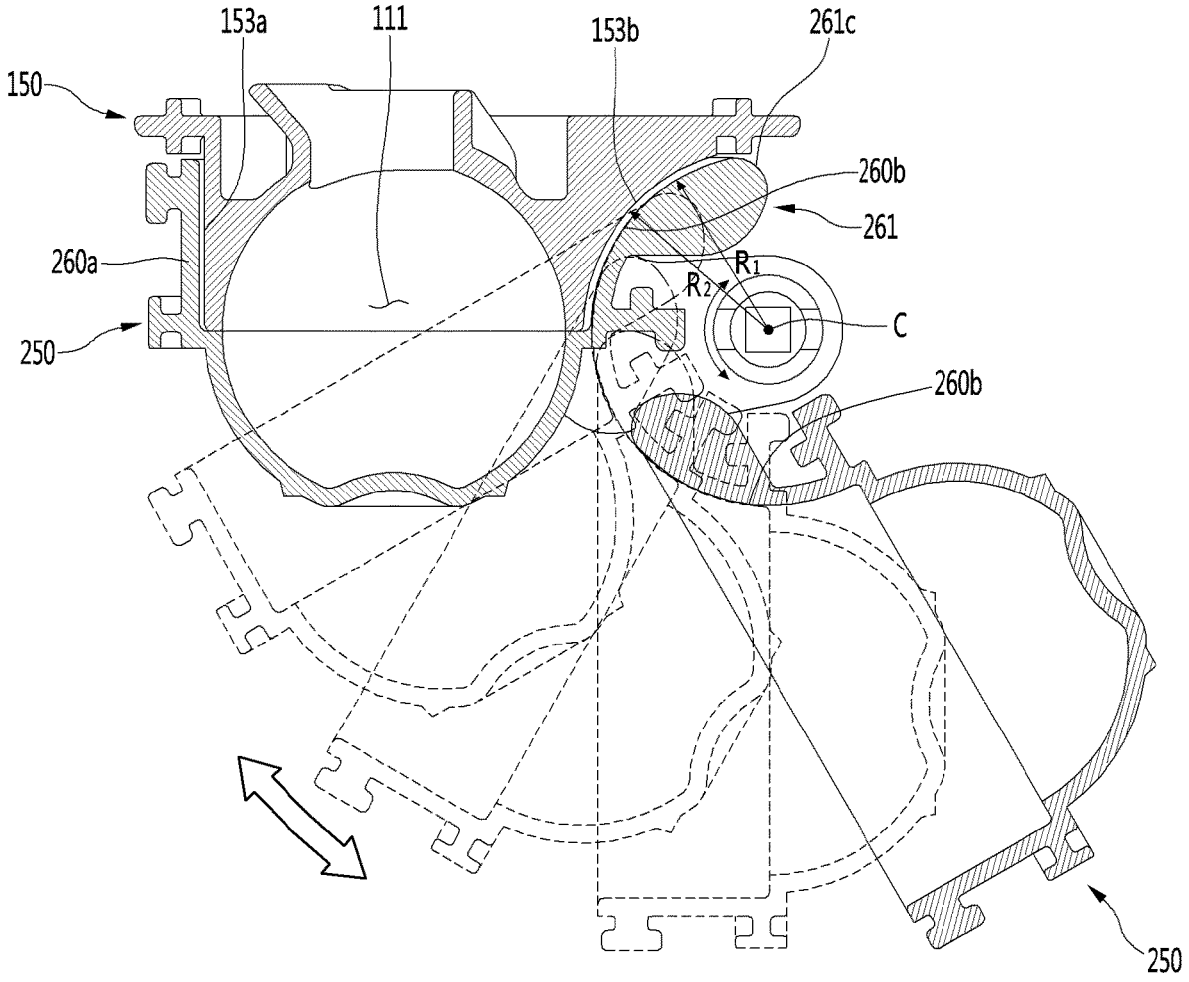
FIG. 38 is a cross-sectional view that sequentially illustrates a pivoting state of a lower tray.
Figure 39:
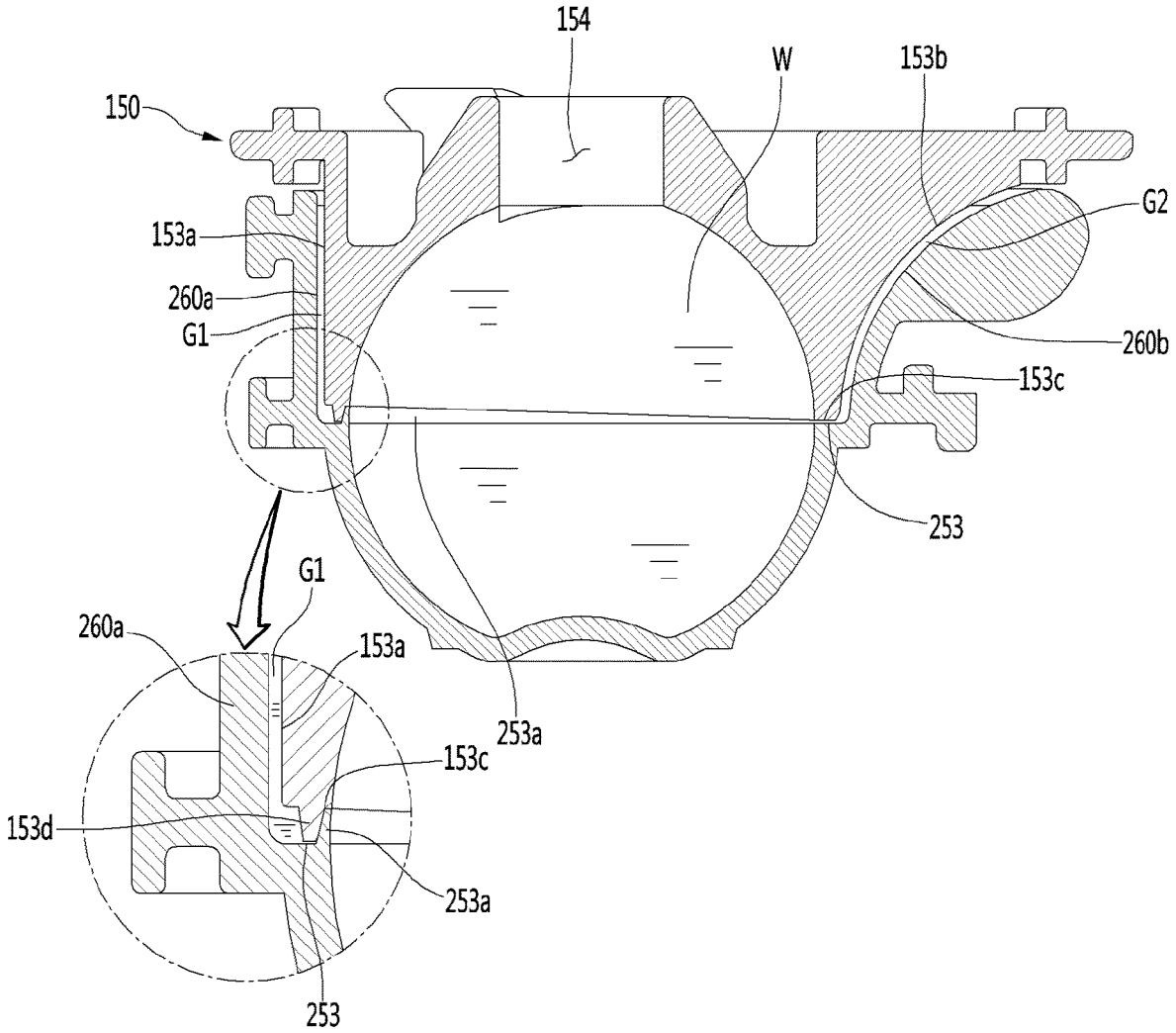
FIG. 39 is a cross-sectional view showing states of an upper tray and a lower tray immediately before or during ice-making.
Figure 40:
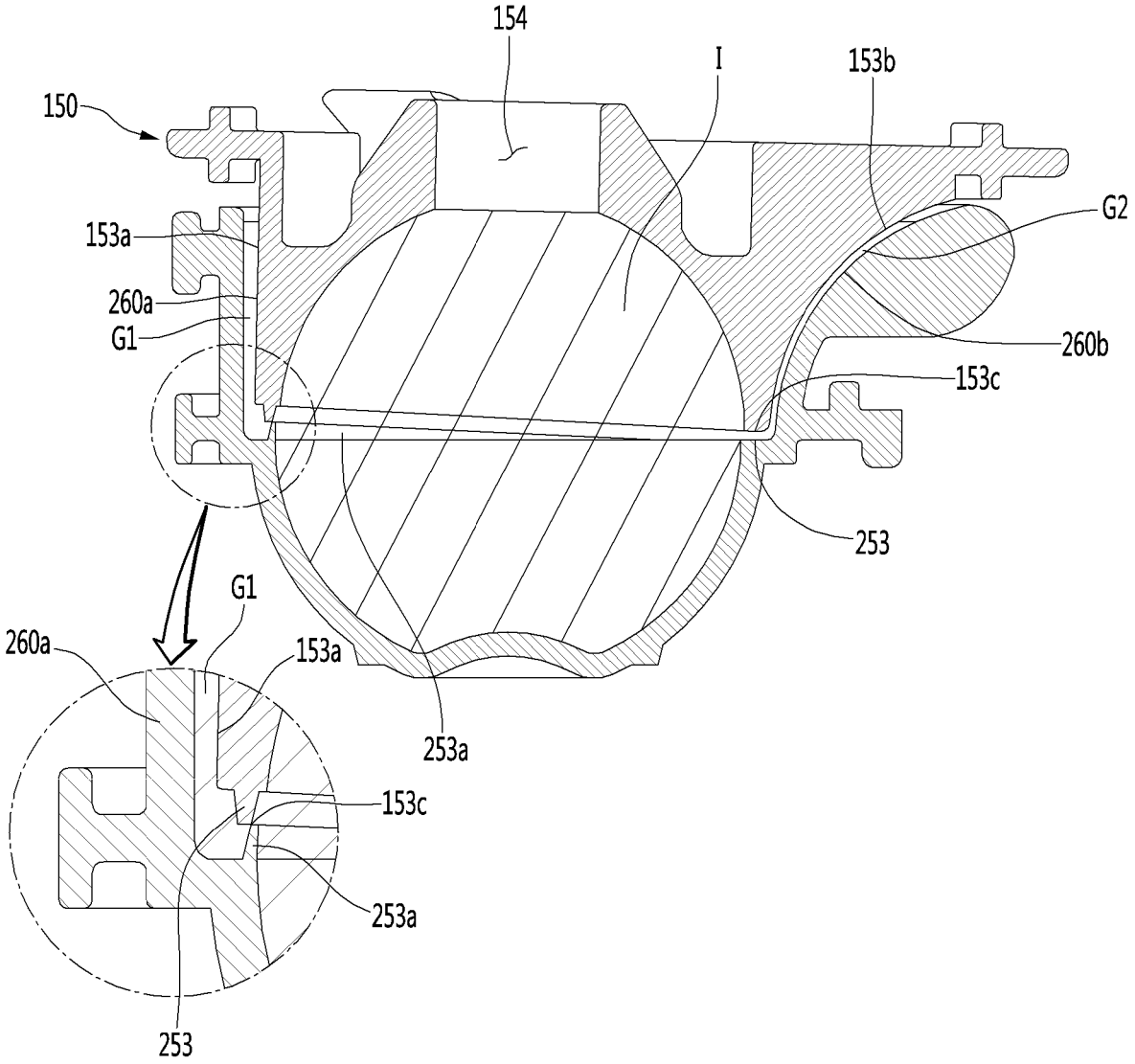
FIG. 40 shows states of upper and lower trays upon completion of ice-making.

FIG. 36 is a plan view of a lower tray. Further, FIG. 37 is a perspective view of a lower tray according to another embodiment of the present disclosure. Further, FIG. 38 is a cross-sectional view that sequentially illustrates a pivoting state of a lower tray. Further, FIG. 39 is a cross-sectional view showing states of an upper tray and a lower tray immediately before or during ice-making. Further, FIG. 40 shows states of upper and lower trays upon completion of ice-making.

Referring to FIGS. 36 to 40, the lower chamber 252 opened upwards may be defined in the lower tray 250. Further, the lower chamber 252 may include the first lower chamber 252*a*, the second lower chamber 252*b*, and the third lower chamber 252*c* arranged in series. Further, the side wall 260 may extend upward along the perimeter of the lower chamber 252.

In one example, the lower tray mounting face 253 may be formed along a perimeter of top of the lower chamber 252. The lower tray mounting face 253 forms a face that is in contact with the bottom face 153*c* of the upper tray 150 when the lower tray 250 is pivoted and closed.

The lower tray mounting face 253 may be formed in a planar shape, and may be formed to connect the tops of the lower chambers 252 with each other. Further, the side wall 260 may extend upwardly along the outer end of the lower tray mounting face 253.

A lower rib 253*a* may be formed on the lower tray mounting face 253. The lower rib 253*a* is for sealing between the upper tray 150 and the lower tray 250, which may extend upward along the perimeter of the lower chamber 252.

The lower rib 253*a* may be formed along the circumference of each of the lower chambers 252. Further, the lower rib 253*a* may be formed at a position to face away from the upper rib 153*d* in the vertical direction.

Further, the lower rib 253*a* may be formed in a shape corresponding to the upper rib 153*d*. That is, the lower rib 253*a* may extend starting from a position separated by a predetermined distance from one end of the lower chamber 252, which is close to the pivoting shaft of the lower tray 250. Further, a height of the lower tray 250 may increase in a direction farther away from the pivoting shaft of the lower tray 250.

The lower rib 253*a* may be in close contact with the inner face of the upper tray 150 in a state in which the lower tray 250 is completely closed. For this purpose, the lower rib 253*a* protrudes upwards from the top of the lower chamber 252, and may be flush with the inner face of the lower chamber 252. Thus, in a state in which the lower tray 250 closed, as shown in FIG. 39, an outer face of the lower rib 253*a* may come into contact with an inner face of the upper rib 153*d*, and the upper tray 150 and the lower tray 250 may be completely sealed with each other.

In this connection, due to the driving of the driver 180, the first pivoting arm 351 and the second pivoting arm 352 may be further pivoted, and the elastic member 360 may be tensioned to press the lower tray 250 toward the upper tray 150.

When the upper tray 150 and the lower tray 250 are further closed by the pressurization of the elastic member 360, the upper rib 153*d* and the lower rib 253*a* may be bent inward to allow the upper tray 150 and the lower tray 250 to be further sealed with each other.

In one example, before the ice-making, when the lower tray 250 is filled with water, and when the lower tray 250 is closed as shown in FIG. 39, the upper rib 153*d* and the lower rib 253*a* may overlap and sealed. In this connection, the top of the lower rib 253*a* may come into contact with an inner face of the bottom of the upper chamber 152 of the upper tray 150. Therefore, a step of a coupling portion inside the ice chamber 111 may be minimized to generate the ice.

In order to fill the water in all of the plurality of ice chambers 111, the water is supplied in a state in which the lower tray 250 is slightly open. Then, when the water supply is complete, the lower tray 250 is pivoted and closed as shown in FIG. 39. Accordingly, the water may flow into spaces G1 and G2 defined between the side wall 260 and the chamber wall 153 and be filled to a water level the same as that in the ice chamber 111. Further, the water in the spaces G1 and G2 between the side wall 260 and the chamber wall 153 may be frozen during the ice-making operation.

However, the ice chamber 111 and the spaces G1 and G2 may be completely separated from each other by the upper rib 153*d* and the lower rib 253*a*, and may maintain the separated state by the upper rib 153*d* and the lower rib 253*a* even when the ice-making is completed. Therefore, the ice strip may not be formed on the ice made in the ice chamber 111, and the ice may be removed in a state of being completely separated from ice debris in the spaces G1 and G2.

When viewing a state in which the ice-making is completed in the ice chamber 111 through FIG. 40, due to the expansion of the water resulted from the phase-change, the lower tray 250 is inevitably opened at a certain angle. However, the upper rib 153*d* and lower rib 253*a* may remain in contact with each other, and thus, the ice inside the ice chamber 111 will not be exposed into the space. That is, even when the lower tray 250 is slowly opened during the ice-making process, the upper tray 150 and the lower tray 250 may be maintained to be shielded by the upper rib 153*d* and the lower rib 253*a*, thereby forming the spherical ice.

In one example, as shown in FIG. 40, when the ice-making is completed and the lower tray 250 is opened at the maximum angle, the upper tray 150 and the lower tray 250 may be separated from each other by approximately 0.5 to 1 mm. Therefore, a length of the lower rib 253*a* is preferably approximately 0.3 mm. In another example, a height of the lower rib 253*a* is only an example, and the lengths of the upper rib 153*d* and the lower rib 253*a* may be appropriately selected depending on the distance between the upper tray 150 and the lower tray 250.

Further, when an area of the lower tray mounting face 253 is large enough, a pair of lower ribs 253*a* and 253*b* may be formed on the lower tray mounting face 253. The pair of lower ribs 253*a* and 253*b* may be formed in the same shape as the lower rib 253*a*, but may be composed of an inner rib 253*b* disposed close to the lower chamber 252 and an outer rib 253*a* outward of the inner rib 253*b*. The inner rib 253*b* and the outer rib 253*a* are spaced apart from each other to define a groove therebetween. Therefore, when the lower tray 250 is pivoted and closed, the upper rib 153*d* may be inserted into the groove between the inner rib 253*b* and the outer rib 253*a*.

Due to such double-rib structure, the upper rib 153*d* and the lower ribs 253*a* and 253*b* may be more sealed with each other. However, such a structure may be applicable when the lower tray mounting face 253 is provided with sufficient space for the inner rib 253*b* and outer rib 253*a* to be formed.

In one example, the lower tray 250 may be pivoted about the hinge bodies 281 and 282, and may be pivoted by an angle of about 140° such that the ice-removal may be achieved even when the ice is placed in the lower chamber 252. The lower tray 250 may be pivoted as shown in FIG. 38. Even during such pivoting, the side wall 260 and chamber wall 153 should not interfere with each other.

More specifically, the water supply is inevitably performed in a state in which the lower tray 250 is slightly open for supplying the water into the plurality of the lower chambers 252. In this situation, the side wall 260 of the lower tray 250 may extend upwards above a water-supply level in the ice chamber 111 to prevent water leakage.

Further, since the lower tray 250 opens and closes the ice chamber 111 by the pivoting, the spaces G1 and G2 are inevitably defined between the side wall 260 and the chamber wall 153. When the spaces G1 and G2 between the side wall 260 and the chamber wall 153 are too narrow, interference with the upper tray 150 may occur during the pivoting process of the lower tray 250. Further, when the spaces G1 and G2 between the side wall 260 and the chamber wall 153 are too wide, during the water supplying into the lower chamber 252, an excessive amount of water is flowed into the spaces G1 and G2 and lost, and thus, an excessive amount of ice debris is generated. Therefore, widths of the spaces G1 and G2 between the side wall 260 and the chamber wall 153 may be equal to or less than about 0.5 mm.

In one example, the curved wall 153*b* of the upper tray 150 and the curved wall 260*b* of the lower tray 250 of the side wall 260 and the chamber wall 153 may be formed to have the same curvature. Thus, as shown in FIG. 38, the curved wall 153*b* of the upper tray 150 and the curved wall 260*b* of the lower tray 250 do not interfere with each other in an entire region where the lower tray 250 is pivoted.

In this connection, a radius R2 of the curved wall 153*b* of the upper tray 150 is slightly larger than a radius R1 of the curved wall 260*b* of the lower tray 250, so that the upper tray 150 and lower tray 250 may have a water-supplyable structure without interfering with each other during the pivoting.

In one example, a center of pivoting C of the hinge bodies 281 and 282, which is the axis of pivoting of the lower tray 250, may be located somewhat lower than the top face 286 of the upper lower support 270 or the lower tray mounting face 253. The bottom face 153*c* of the upper tray 150 and the lower tray mounting face 253 are in contact with each other when the lower tray 250 is pivoted and closed.

The lower tray 250 may have a structure to be in close contact with the upper tray 150 in the closing process. Therefore, when the lower tray 250 is pivoted and closed, a portion of the upper tray 150 and a portion of the lower tray 250 may be engaged with each other at a position close to the pivoting shaft of the lower tray 250. In such a situation, even when the lower tray 250 is pivoted to be closed completely, ends of the upper tray 150 and the lower tray 250 at points far from the pivoting shaft may be separated from each other due to the interference in the engaged portion.

To solve such problem, the center of pivoting Cl of the hinge bodies 281 and 282, which is the pivoting shaft of the lower tray 250, is moved somewhat downward. For example, the center of pivoting Cl of the hinge bodies 281 and 282 may be located 0.3 mm below the top face of the lower support 270.

Thus, when the lower tray 250 is closed, the ends of the upper tray 150 and the lower tray 250 close to the pivoting shaft may not be engaged with each other first, but the lower tray mounting face 253 and the entirety of the bottom face 153*c* of the upper tray 150 may be in close contact with each other.

In particular, since the upper tray 150 and the lower tray 250 are made of an elastic material, tolerances may occur during the assembly, or coupling may be loosened or micro deformation may occur during the use. However, such structure may solve the problem of the ends of the upper tray 150 and the lower tray 250 engaging with each other first.

In one example, the pivoting shaft of the lower tray 250 may be substantially the same as the pivoting shaft of the lower support 270, and the hinge bodies 281 and 282 may also be formed on the lower support 270.

Hereinafter, the upper ejector 300 and the connector 350 connected to the upper ejector 300 will be described with reference to the drawings.

Figure 41:
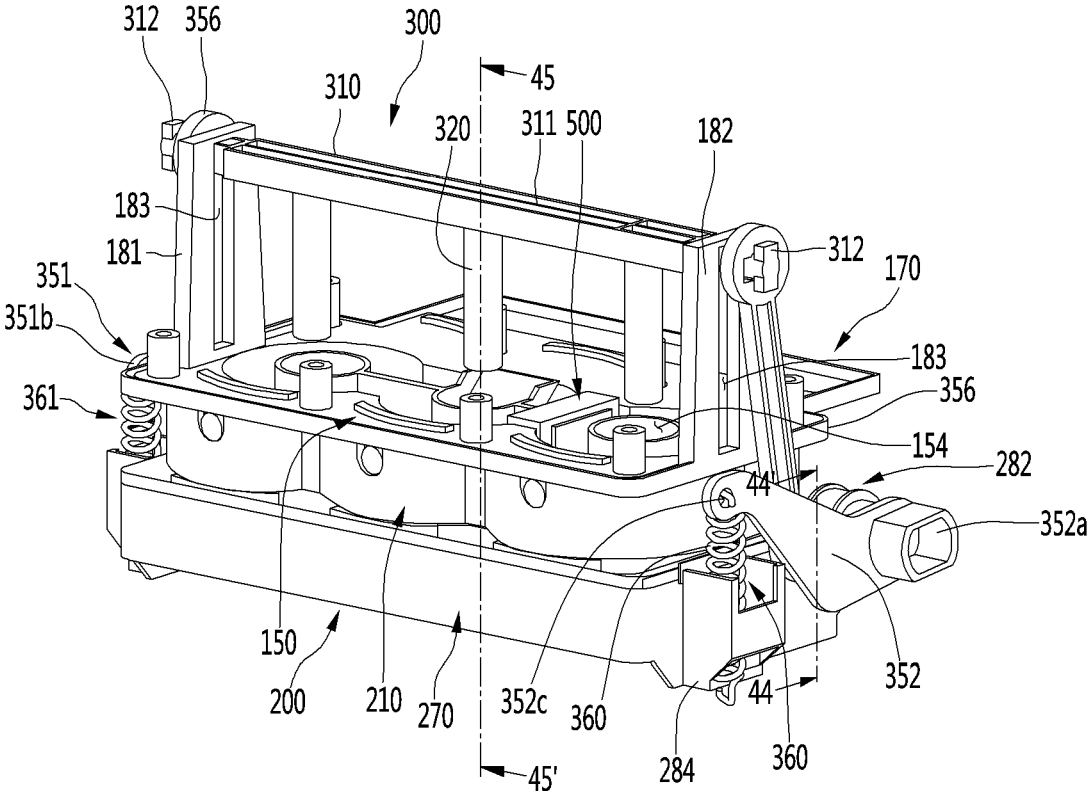
FIG. 41 is a perspective view showing a state in which an upper assembly and a lower assembly are closed, according to an embodiment of the present disclosure.
Figure 42:
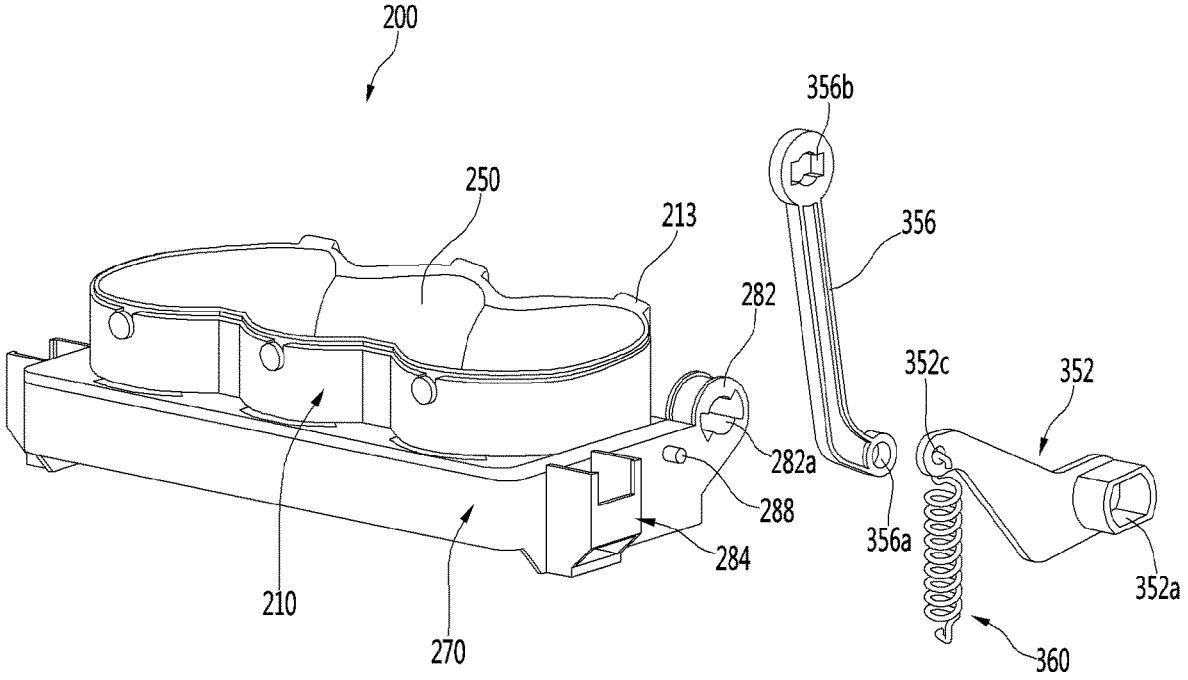
FIG. 42 is an exploded perspective view showing a coupling structure of a connector according to an embodiment of the present disclosure.
Figure 43:
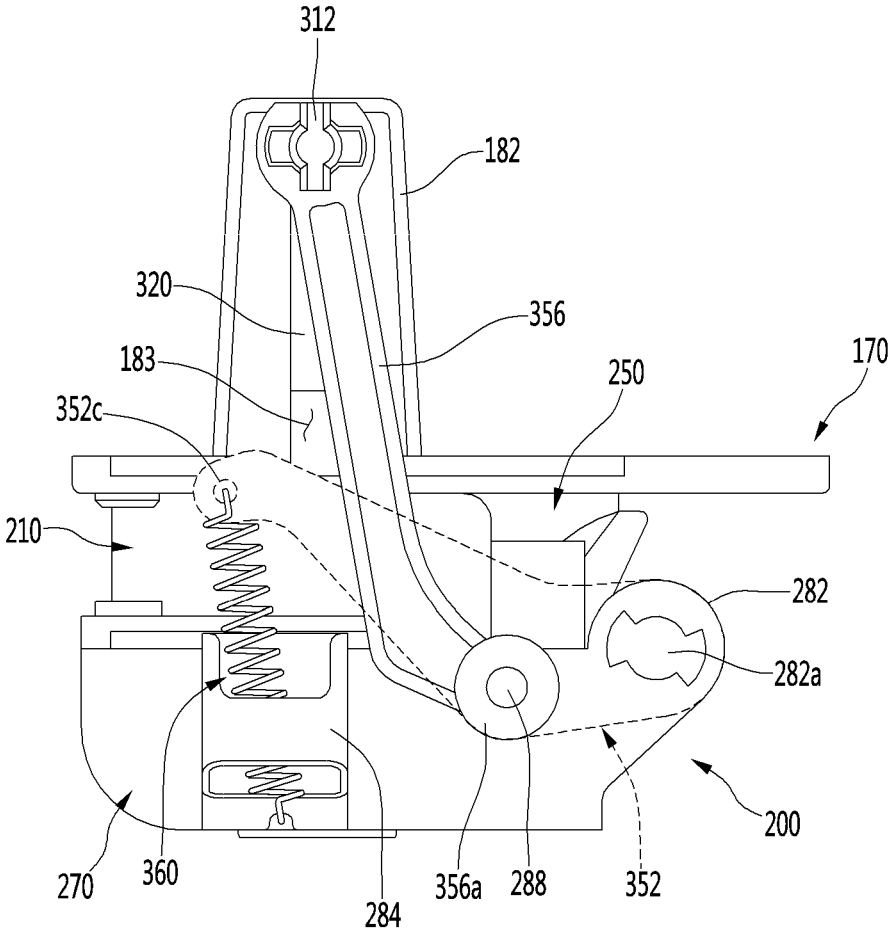
FIG. 43 is a side view showing a disposition of a connector.

FIG. 41 is a perspective view showing a state in which an upper assembly and a lower assembly are closed, according to an embodiment of the present disclosure. Further, FIG. 42 is an exploded perspective view showing a coupling structure of a connector according to an embodiment of the present disclosure. Further, FIG. 43 is a side view showing a disposition of a connector. Further, FIG. 44 is a cross-sectional view of FIG. 41 taken along a line 44-44'.

Figure 44:
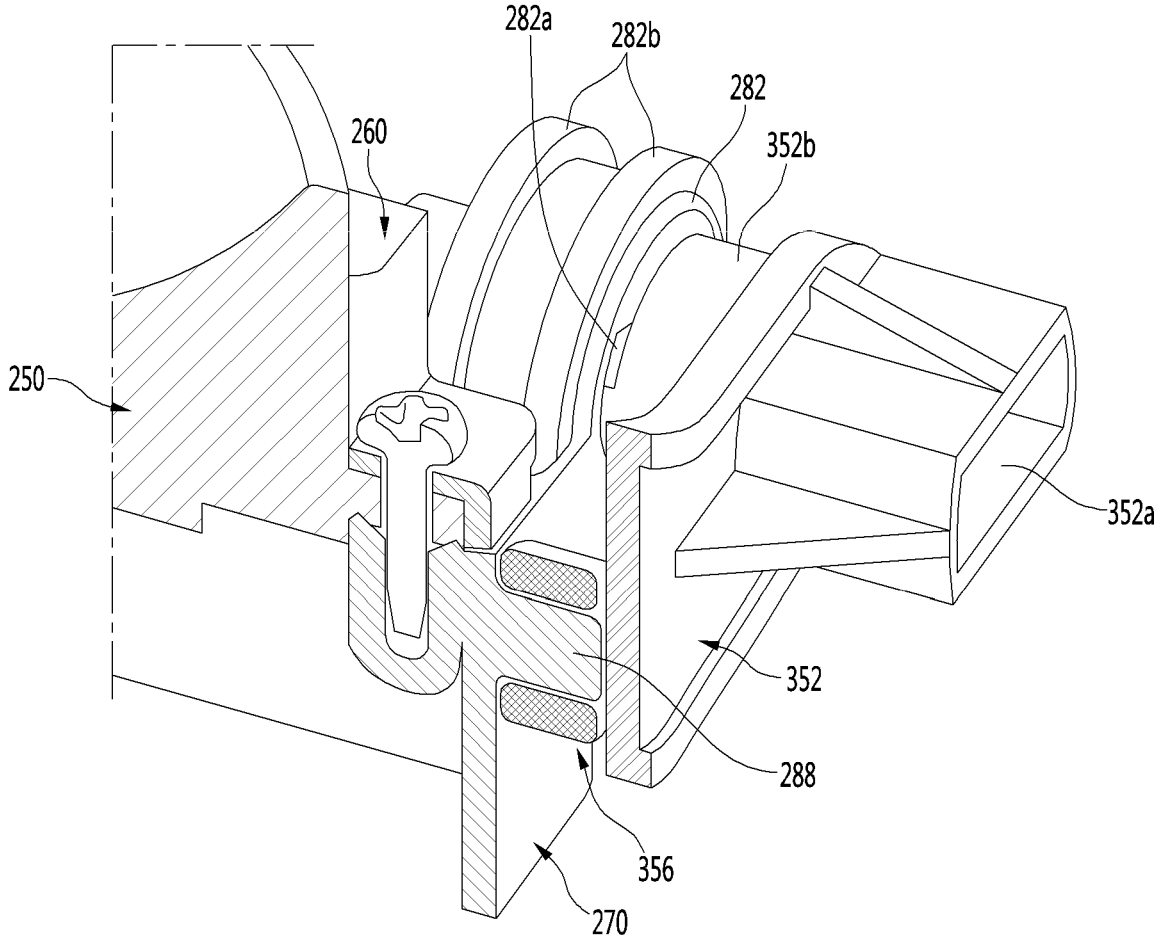
FIG. 44 is a cross-sectional view of FIG. 41 taken along a line 44-44'.

As shown in FIGS. 41 and 44, the upper ejector 300 is positioned at a topmost position when the lower assembly 200 and the upper assembly 110 are fully closed. Further, the connector 350 will remain stationary.

The connector 350 may be pivoted by the driver 180, and the connector 350 may be connected to the upper ejector 300 mounted on the upper support 170 and the lower support 270.

Therefore, when the lower assembly 200 is opened in the pivoting, the upper ejector 300 may be moved downward by the connector 350 and may remove the ice in the upper chamber 152.

The connector 350 may include a pivoting arm 352 for pivoting the lower support 270 under the power of the driver 180 and a link 356 connected to the lower support 270 to transfer a pivoting force of the lower support 270 to the upper ejector 300 when the lower support 270 pivots.

In detail, a pair of pivoting arms 351 and 352 may be disposed at both sides of the lower support 270, respectively. A second pivoting arm 352 of the pair of pivoting arms 351 and 352 may be connected to the driver 180, and a first pivoting arm 351 may be disposed opposite to the second pivoting arm 352. Further, the first pivoting arm 351 and the second pivoting arm 352 may be respectively connected to both ends of the connection shaft 370, which pass through the hinge bodies 281 and 282 at both sides, respectively. Therefore, the first pivoting arm 351 and the second pivoting arm 352 may be pivoted together when the driver 180 is operated.

To this end, the shaft connector 352*b* may protrude inwardly of each of the first pivoting arm 351 and the second pivoting arm 352. Further, the shaft connector 352*b* may be coupled to second hinge holes 282*a* of the hinge body 282 in both sides. The second hinge hole 282*a* and the shaft connector 352*b* may be formed in structures to be coupled with each other to allow the transmission of the power.

In one example, the second hinge hole 282*a* and the shaft connector 352*b* may have shapes corresponding to each other, but may be formed to have a predetermined play (FIG. 44) in the direction of pivoting. Thus, when the lower assembly 200 is closed in pivoting, the driver 180 may be rotated further by a set angle while the lower tray 250 is in contact with the upper tray 150, thereby further pivoting the pivoting arms 351 and 352. The lower tray 250 may be further pressed toward the upper tray 150 by an elastic force of the elastic member 360 generated at this time.

In one example, a power connector 352*ac* that is coupled to a rotation shaft of the driver 180 may be formed on an outer face of the second pivoting arm 352. The power connector 352*a* may be formed in a polygonal hole, and the rotation shaft of the driver 180 formed in the corresponding shape may be inserted into the power connector 352*a* to allow the transmission of the power.

In one example, the first pivoting arm 351 and second pivoting arm 352 may extend above the elastic member receiving portion 284. Further, the elastic member connectors 351*c* and 352*c* may be formed at the extended ends of the first pivoting arm 351 and the second pivoting arm 352, respectively. One end of the elastic member 360 may be connected to each of the elastic member connectors 351*c* and 352*c*. The elastic member 360 may be, for example, a coil spring.

The elastic member 360 may be located inside the elastic member receiving portion 284, and the other end of the elastic member 360 may be fixed to a locking portion 284*a* of the lower support 270. The elastic member 360 provides an elastic force to the lower support 270 to keep the upper tray 150 and the lower tray 250 in contact with each other in a pressed state.

The elastic member 360 may provide an elastic force that allows the lower assembly 200 to be in a close contact with the upper assembly 200 in a closed state. That is, when the lower assembly 200 pivots to close, the first pivoting arm 351 and the second pivoting arm 352 are also pivoted together until the lower assembly 200 is closed, as shown in FIG. 41.

Further, in a state in which the lower assembly 200 is pivoted to a set angle and in contact with the upper assembly 200, the first pivoting arm 351 and the second pivoting arm 352 may be further pivoted by the rotation of the driver 180. The pivoting of the first pivoting arm 351 and second pivoting arm 352 may cause the elastic member 360 to be tensioned. Further, the lower assembly 200 may be further pivoted in the closing direction by the elastic force provided by the elastic member 360.

When the elastic member 360 is not provided and the lower assembly 200 is further pivoted by the driver 180 to press the lower assembly to the upper assembly 110, an excessive load may be concentrated on the driver 180. Further, when the water is phase-changed and expands and the lower tray 250 pivots in the open direction, a reverse force is applied to the gear of the driver 180, so that the driver 180 may be damaged. Further, when the driver 180 is turned off, the lower tray 250 sags due to a play of the gears. However, all of these problems may be solved when the lower assembly 200 is pulled to be closed contacted by the elastic force provided by the elastic member 360.

That is, the lower assembly 200 may be provided with the elastic force through the elastic member 360 in a tensioned state without additional power from the driver 180, and may allow the lower assembly 200 to be closer to the upper assembly 110.

Further, even when the lower tray 250 is stopped by the driver 180 before being fully pressed against the upper tray 150, an elastic restoring force of the elastic member 360 allows the lower tray 250 to be pivoted further to be completely in contact with the upper tray 150. In particular, an entirety of the lower tray 250 may be in close contact with the upper tray 150 without a gap by the elastic members 360 arranged on both sides.

The elastic member 360 will continuously provide the elastic force to the lower assembly 200. Therefore, even when the ice is produced in the ice chamber 111 and expands, the elastic force is applied to the lower assembly 200, so that the lower assembly 200 may not be excessively opened.

In one example, the link 356 may link the lower tray 250 and the upper ejector 300 with each other. The link 356 is formed in a bent shape, so that the link 356 does not interfere with each of the hinge bodies 281 and 282 during the pivoting process of the lower tray 250.

A tray connector 356*a* may be formed at a bottom of the link 356, and the link shaft 288 may pass through the tray connector 356*a*. Thus, a bottom of the link 356 may be pivotably connected to the lower support 270, and may pivot together upon the pivoting of the lower support 270.

The link shaft 288 may be located between each of the hinge bodies 281 and 282 and the elastic member receiving portion 284. Further, the link shaft 288 may be located further below a center of pivoting of each of the hinge bodies 281 and 282. Therefore, the link shaft 288 may be positioned close to a vertical movement path of the upper ejector 300, so that the upper ejector 300 may be effectively moved vertically. Further, the upper face 300 may descend to a required position, and at the same time, the upper ejector 300 may not be moved to an excessively high position when the upper ejector 300 moves upward. Therefore, heights of the upper ejector 300 and the unit guides 181 and 182 that are exposed upwardly of the ice-maker 100 may be further lowered, so that an upper space lost when the ice-maker 100 is installed in the freezing compartment 4 may be minimized.

The link shaft 288 protrudes vertically outward from an outer face of the lower support 270. In this connection, the link shaft 288 may extend to pass through the tray connector 356*a*, but may be covered by the pivoting arms 351 and 352. Each of the pivoting arms 351 and 352 becomes very close to the link and the link shaft 288. Thus, the link 356 may be prevented from being separated from the link shaft 288 by each of the pivoting arms 351 and 352. Each of the pivoting arms 351 and 352 may shield the link shaft 288 at any point in the path of pivoting. Thus, the pivoting arms 351 and 352 may be formed to have a width enough to cover the link shaft 288.

An ejector connector 356*b* through which an end of the ejector body 310, that is, the stopper protrusion 312 passes may be formed on the top of the link 356. The ejector connector 356*b* may also be pivotably mounted with the end of the ejector body 310. Therefore, when the lower support 270 is pivoted, the upper ejector 300 may be moved together in the vertical direction.

Hereinafter, states of the upper ejector 300 and the connector 350 based on the operation of the lower assembly 200 will be described with reference to the drawings.

Figure 45:
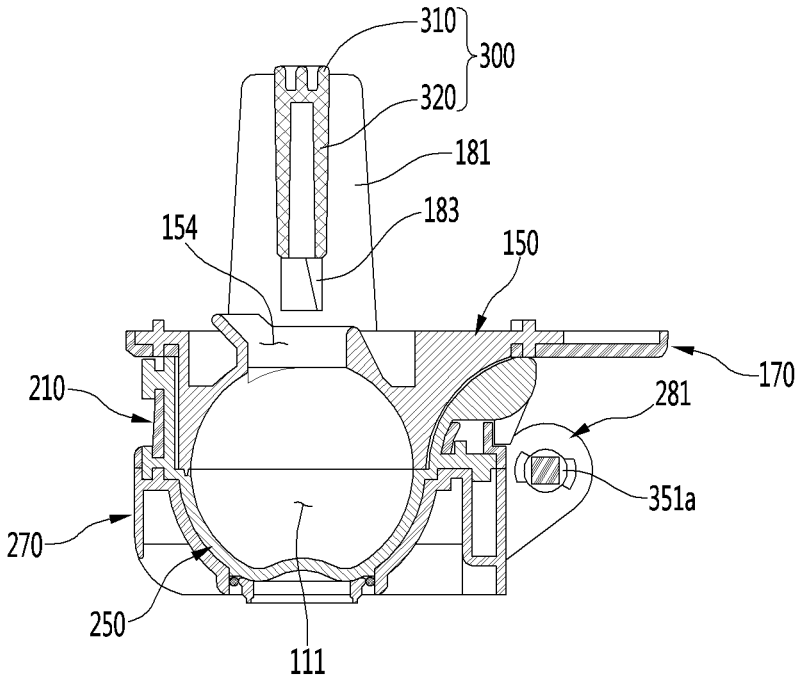
FIG. 45 is a cross-sectional view of FIG. 41 taken along a line 45-45'.
Figure 46:
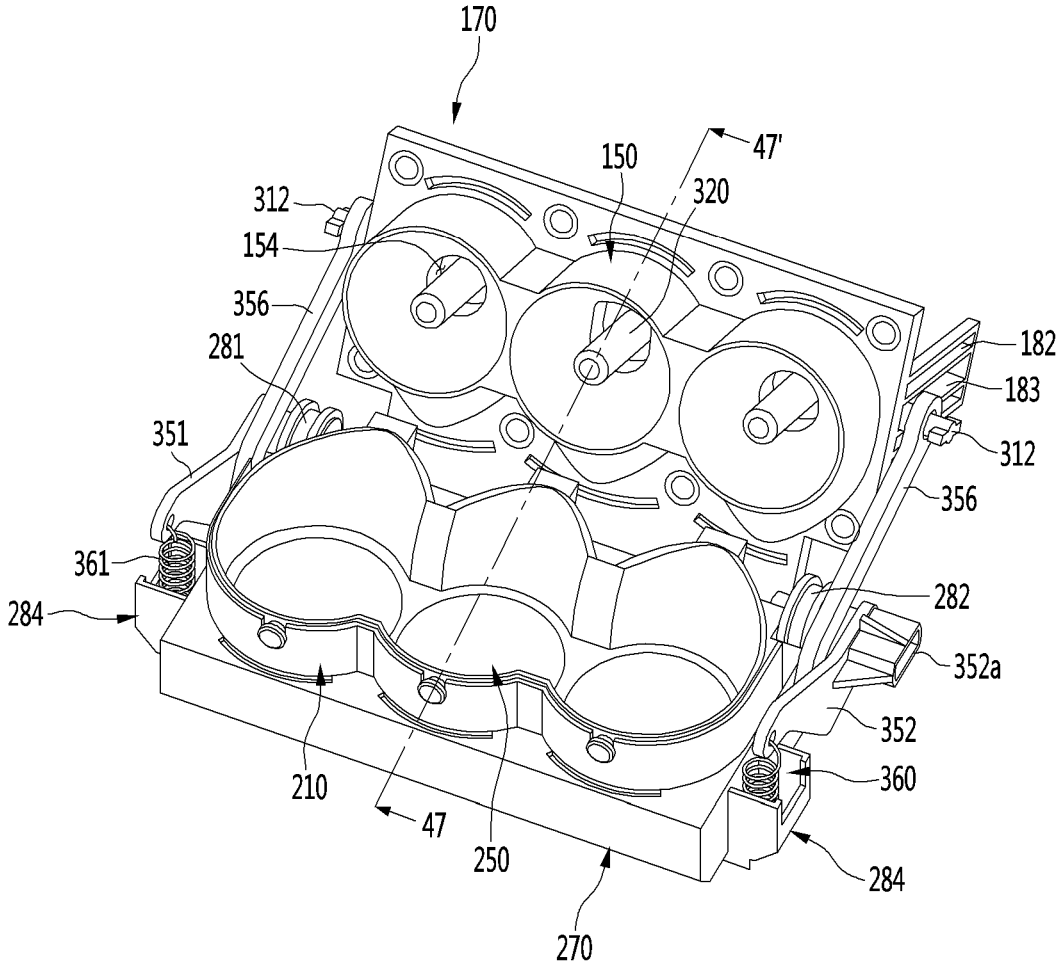
FIG. 46 is a perspective view showing a state in which upper and lower assemblies are open.
Figure 47:
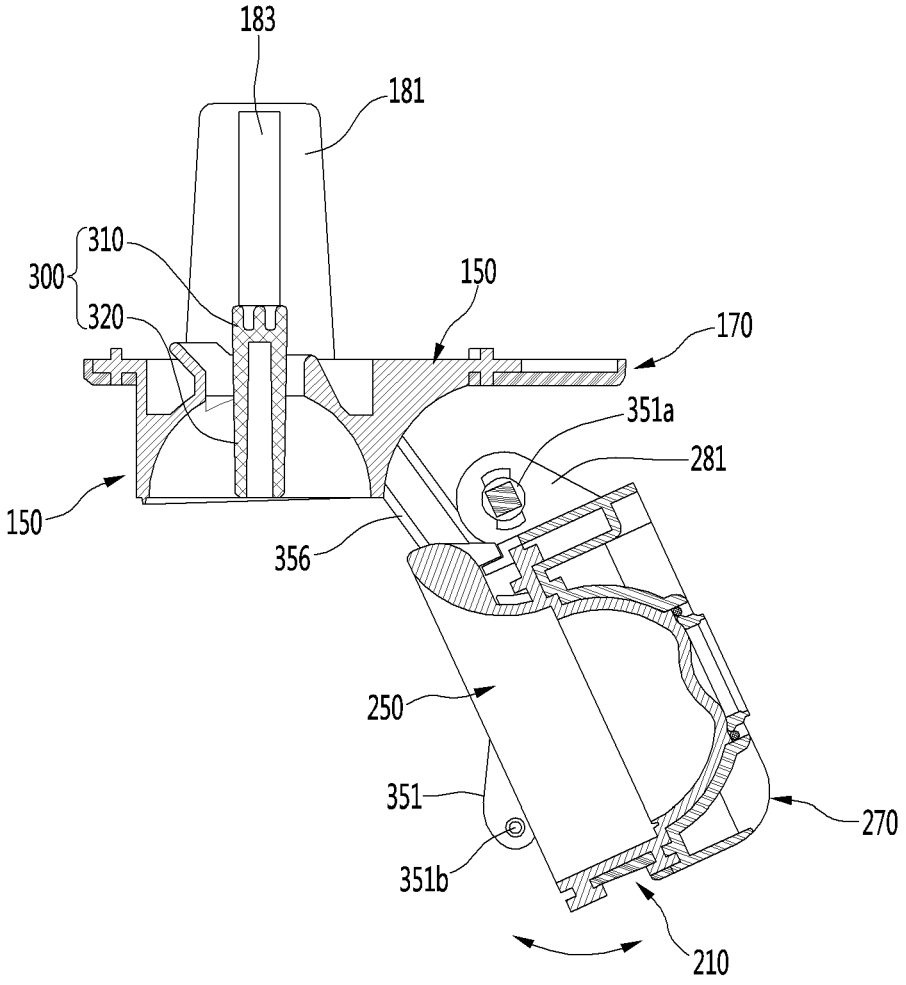
FIG. 47 is a cross-sectional view of FIG. 46 taken along a line 47-47'.

FIG. 45 is a cross-sectional view of FIG. 41 taken along a line 45-45'. Further, FIG. 46 is a perspective view showing a state in which upper and lower assemblies are open. Further, FIG. 47 is a cross-sectional view of FIG. 46 taken along a line 47-47'.

As shown in FIGS. 41 and 45, during the ice-making of the ice-maker 100, the lower assembly 200 may be closed.

In this state, the upper ejector 300 is located at the topmost position, and the ejecting pin 320 may be located outward of the ice chamber 111. Further, the upper tray 150 and the lower tray 250 may be completely in close contact with each other and sealed by the pivoting arms 351 and 352 and the elastic member 360.

In such state, the ice formation may proceed in the ice chamber 111.

During the ice-making operation, the upper heater 148 and the lower heater 296 are operated periodically, so that the ice formation proceeds from the upper portion of the ice chamber 111, thereby producing the transparent spherical ice. Further, when the ice formation is completed inside the ice chamber 111, the driver 180 is operated to pivot the lower assembly 200.

As shown in FIGS. 46 and 47, during the ice-removal of the ice-maker 100, the lower assembly 200 may be open. The lower assembly 200 may be fully opened by the operation of the driver 180.

When the lower assembly 200 opens in the open direction, the bottom of the link 356 pivots with the lower tray 250. Further, the top of the link 356 moves downward. The top of the link 356 may be connected to the ejector body 310 to move the upper ejector 300 downward, and may be moved downward without being guided by the unit guides 181 and 182.

When the lower assembly 200 is fully pivoted, the ejecting pin 320 of the upper ejector 300 may pass through the ejector-receiving opening 154 and move to the bottom of the upper chamber 152 or a position adjacent thereto to remove the ice from the upper chamber 152. In this connection, the link 356 is also pivoted to the maximum angle, but the link 356 has a bent shape, and at the same time, the link shaft 288 may be located forwards and downwards of each of the hinge bodies 281 and 282, so that interference of the link 356 with other components may be prevented.

In one example, the lower assembly 200 may partially sag while in a closed state. In detail, in the present embodiment, the driver 180 has a structure of being connected to the second pivoting arm 352 among the pivoting arms 351 and 352 on both sides, and the second pivoting arm 352 has a structure of being connected to the first pivoting arm 351 by the connection shaft 370. Therefore, the pivoting force is transmitted to the first pivoting arm 351 through the connection shaft 370, so that the first pivoting arm 351 and the second pivoting arm 352 may pivot simultaneously.

However, the first pivoting arm 351 has a structure of being connected to the connection shaft 370, Further, for the connection, a tolerance inevitably occurs at a connected portion. Such tolerance may cause slippage during the pivoting of the connection shaft 370.

In addition, since the lower assembly 200 extends in the direction of power transmission, a portion of the first pivoting arm 351 positioned at a relatively far may sag, and a torque may not be 100% transmitted thereto.

Because of such structure, when the first pivoting arm 351 pivots less than the second pivoting arm 352, the upper tray 150 and the lower tray 250 are not completely in contact with each other and sealed, and there is a region partially open between the upper tray 150 and the lower tray 250 at a side close to the first pivoting arm 351. Therefore, when the lower tray 250 sags or tilts, and thus, a water surface inside the ice chamber 111 is tilted, the spherical ice of a uniform size and shape may not be generated. Further, when water leaks through open portion, more serious problems may be caused.

To avoid such problem, a vertical level of the extended top of the first pivoting arm 351 may be different from that of the extended top of the second pivoting arm 352.

Figure 48:
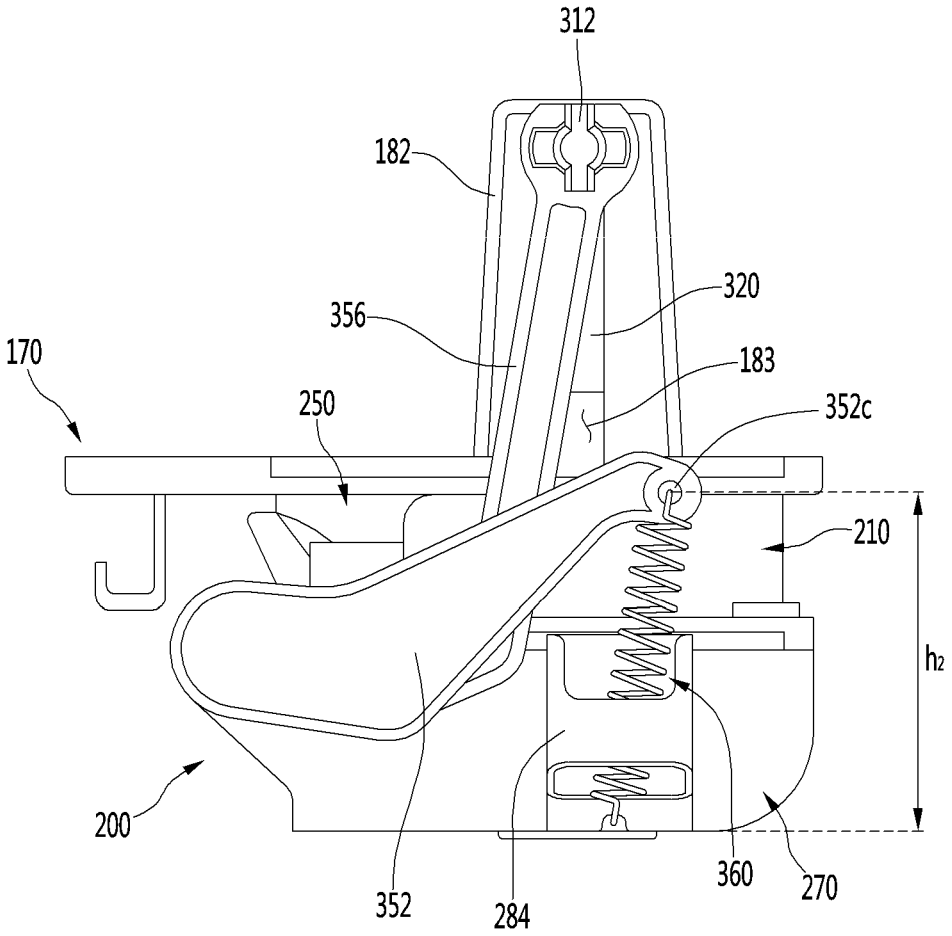
FIG. 48 is a side view showing a state of FIG. 41 viewed from one side.
Figure 49:
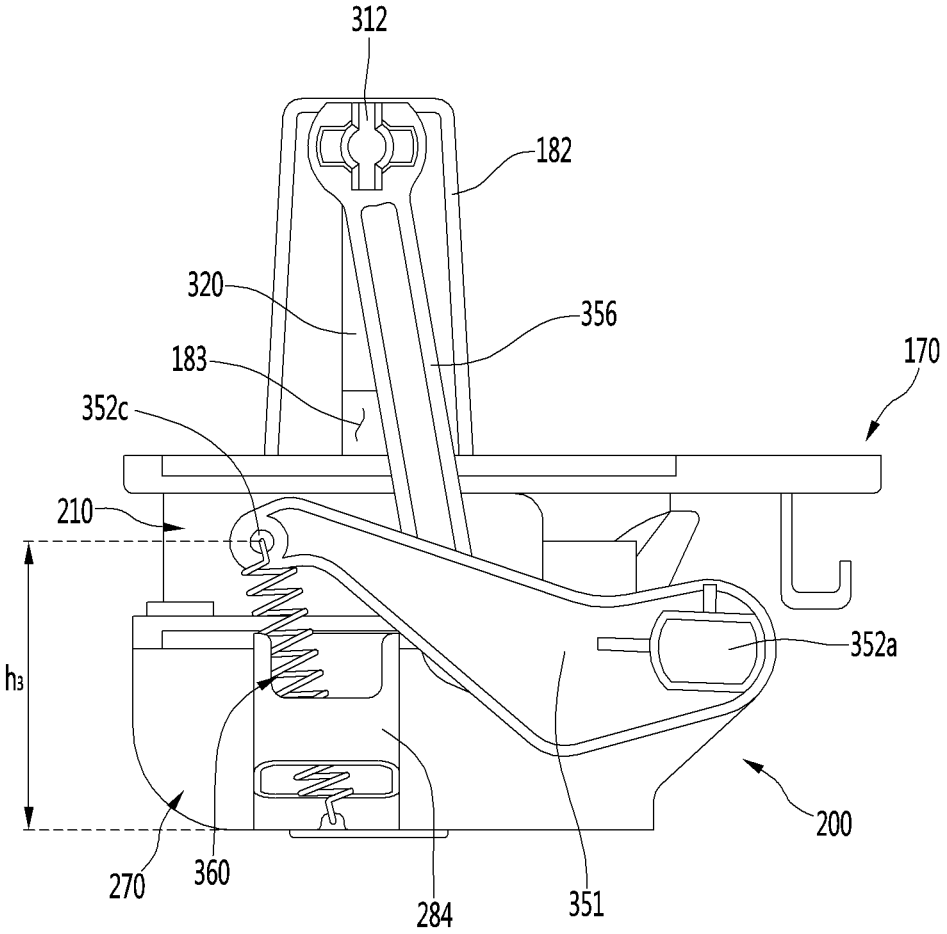
FIG. 49 is a side view showing a state of FIG. 41 viewed from the other side.
Figure 50:
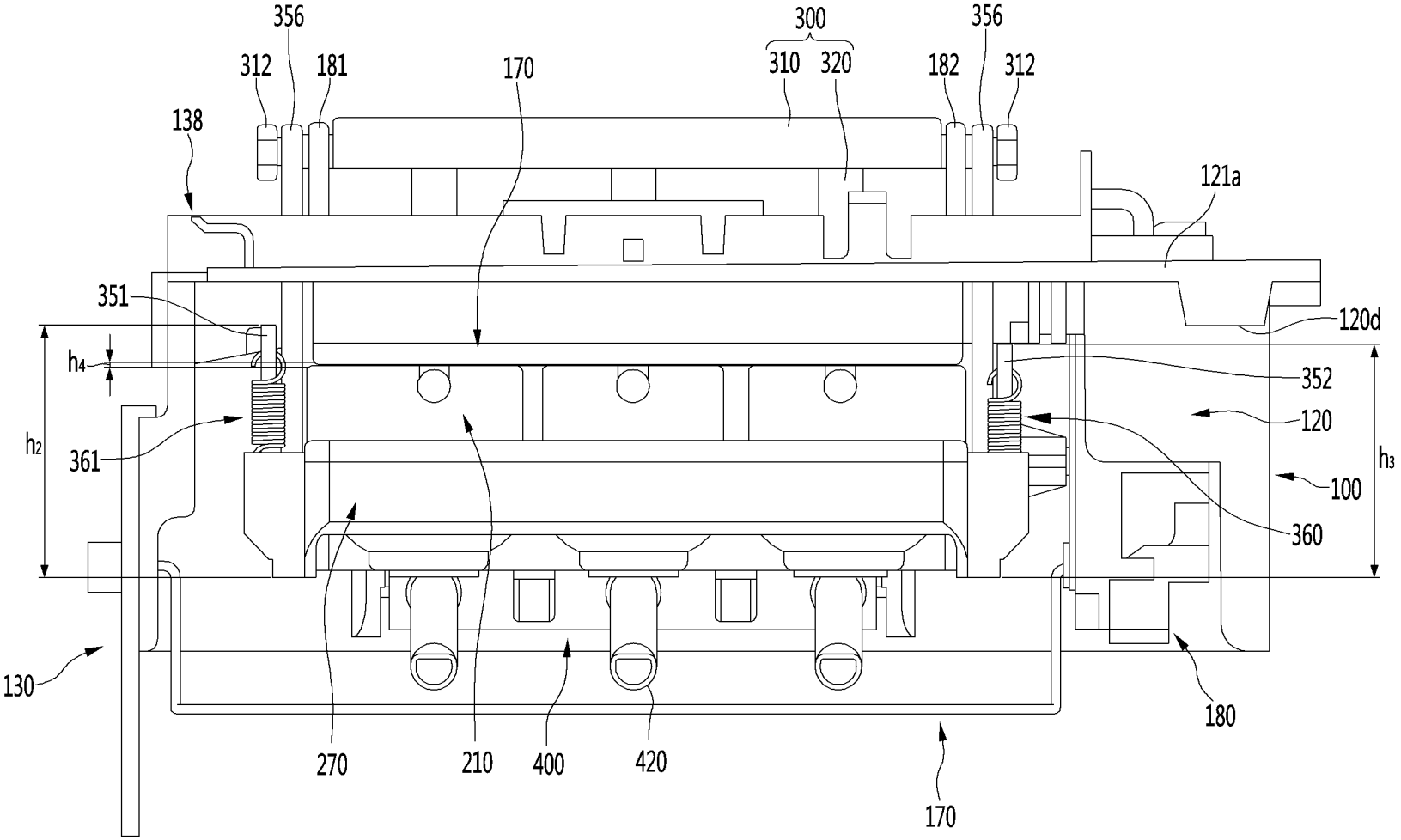
FIG. 50 is a front view of an ice-maker.

Referring to FIGS. 48, 49, and 50, a vertical level h2 from the bottom face of the lower assembly 200 to the elastic member connector 351*c* of the first pivoting arm 351 may be higher than a vertical level h3 from the bottom face of the lower assembly 200 to the elastic member connector 352*c* of the second pivoting arm 352.

Thus, when the lower assembly 200 pivots to be closed, the first pivoting arm 351 and second pivoting arm 352 pivot together. Further, because the vertical level of the first pivoting arm is high, when the lower tray 250 and the upper tray 150 begin to be in contact with each other, the elastic member 360 connected to the first pivoting arm 351 is further tensioned.

That is, in a state in which the lower tray 250 is completely in contact with the upper tray 150, the elastic force of the elastic member 360 of the first pivoting arm 351 becomes greater. This compensates for the sagging of the lower tray 250 at the first pivoting arm 351. Thus, the entirety of the top face of the lower tray 250 may be in close contact and sealed with the bottom face of the upper tray 150.

In particular, in a structure where the driver 180 is located on one side of the lower tray 250 and is directly connected only to the second pivoting arm 352, due to the tolerance occurred in the assembly of the connection shaft 370, the first pivoting arm 351 may be less pivoted. However, as in the embodiment of the present disclosure, the first pivoting arm 351 pivots the lower tray 250 with a force greater than that of the second pivoting arm 352, so that the lower tray 250 is prevented from sagging or less pivoting.

In another example, the first pivoting arm 351 and second pivoting arm 352 may be pivotably coupled both ends of the connection shaft 370 respectively to be alternated with each other by a set angle with respect to the connection shaft 370. Thus, the top of the first pivoting arm 351 may be positioned higher than the top of the second pivoting arm 352.

Further, in another example, shapes of the first pivoting arm 351 and the second pivoting arm 352 may be different from each other such that the first pivoting arm 351 extends longer than the second pivoting arm 352, and thus, a point where the first pivoting arm 351 is connected to the elastic member 360 becomes higher than a point where the second pivoting arm 352 is connected to the elastic member 360.

Further, in another example, an elastic modulus of the elastic member 360 connected to the first pivoting arm 351 may be made larger than an elastic modulus of the elastic member 360 connected to the second pivoting arm 352.

When the lower assembly 200 is completely closed, as shown in FIG. 50, the top of the lower casing 210 and the bottom of the upper support 170 may be spaced apart from each other by a predetermined distance h4. Further, a portion of the upper tray 150 may be exposed through the gap. In this connection, the space is defined between the upper casing 210 and the upper support 170, but the upper tray 150 and the lower tray 250 remain in close contact with each other.

In other words, even when the upper tray 150 and the lower tray 250 are completely in contact and sealed with each other, the top of the lower casing 210 and the bottom of the upper support 170 may be spaced apart from each other.

When the top of the lower casing 210 and the bottom of the upper support 170, which are injection-molded structures, are in contact with each other, an impact may strain and damage the driver 180.

Further, when the top of the lower casing 210 and the bottom of the upper support 170 are spaced apart from each other, a space where the upper tray 150 and the lower tray 250 may be pressed and deformed may be defined. Therefore, in order to ensure close contact between the upper tray 150 and the lower tray 250 in various situations, such as the assembly tolerance and the deformation on use, the top of the lower casing 210 and the bottom of the upper support 170 must be spaced apart from each other. To this end, the side wall 260 of the lower tray 250 may extend higher than the top of the upper casing 120.

Hereinafter, a structure of an upper ejector 300 will be described with reference to the drawings.

FIG. 50 is a front view of an ice-maker. Further, FIG. 51 is a partial cross-sectional view showing a coupling structure of an upper ejector.

Figure 51:
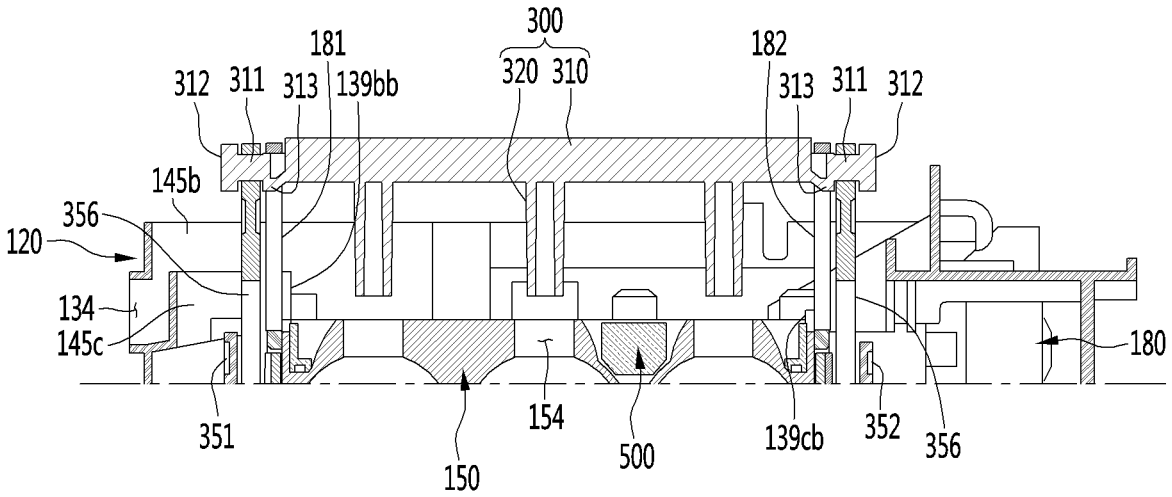
FIG. 51 is a partial cross-sectional view showing a coupling structure of an upper ejector.

As shown in FIGS. 50 and 51, the ejector body 310 has passing-through portions 311 at both ends thereof, and the passing-through portion 311 may pass through the guide slot 183 and the ejector connector 356*b*. Further, a pair of stopper protrusions 312 may protrude in opposite directions from both ends of the ejector body 310, that is, from respective ends of the passing-through portions 311, respectively. Thus, each of the both ends of the ejector body 310 may be prevented from being separated from the ejector connector 356*b*. Further, the stopper protrusion 312 abuts an outer face of the link 356 and extends vertically to prevent generation of the play between the stopper protrusion 312 and the link 356.

Further, a body protrusion 313 may be further formed on the ejector body 310. The body protrusion 313 may protrude downwardly at a position spaced apart from the stopper protrusion 312 and may extend to be in contact with an inner face of the link 356. The body protrusion 313 may be inserted into the guide slot 183, and may protrude by a predetermined length to be in contact with the inner face of the link 356.

In this connection, the stopper protrusion 312 and the body protrusion 313 may respectively abut both faces of the link 356, and may be arranged to face each other. Thus, the both face of the link may be supported by the stopper protrusion 312 and the body protrusion 313, thereby effectively preventing the link 356 from moving.

When the ejector body 310 moves in a horizontal direction, the position of the ejecting pin 320 may be moved in the horizontal direction. Thus, the ejecting pin 320 may press the upper tray 150 in a process of passing through the ejector-receiving opening 154, so that the upper tray 150 may be deformed or detached. Further, the ejecting pin 320 may get caught in the upper tray 150 and may not move.

Thus, in order to ensure that the ejecting pin 320 exactly passes through a center of the ejector-receiving opening 154 without moving, the stopper protrusion 312 and the body protrusion 313 may prevent the link 356 from moving, so that the ejecting pin 320 may move vertically a set position.

In addition, as shown in FIG. 15, a first stopper 139*ba* and a second stopper 189*bb* may be provided at the first through-opening 139*b* of the upper casing 120 through which the pair of the unit guides 181 and 182 are passed, and a third stopper 189*ca* and a fourth stopper 189*cb* are provided at the second through-opening 139*c*, so that the movement of the unit guides 181 and 182 that guide the vertical movement of the ejector body 310 may also be prevented.

Therefore, the present embodiment has a structure that prevents the movements of not only the ejector body 310 but also of the unit guides 181 and 182, and the ejecting pin 320, which moves a relatively long distance in the vertical direction, does not move and enters the ejector-receiving opening 154 along a set path, so that contact or interference with the upper tray 150 may be completely prevented.

Hereinafter, a mounting structure of the driver 180 will be described with reference to the drawings.

Figure 52:
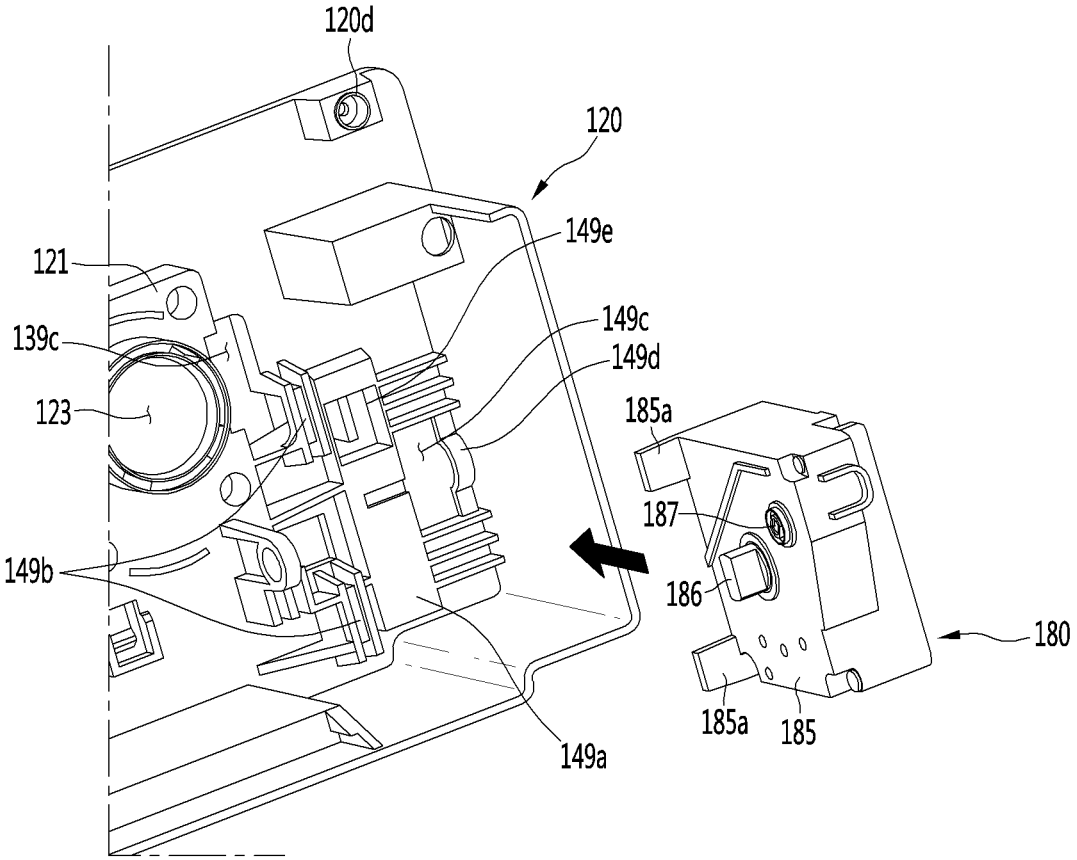
FIG. 52 is an exploded perspective view of a driver according to an embodiment of the present disclosure.
Figure 53:
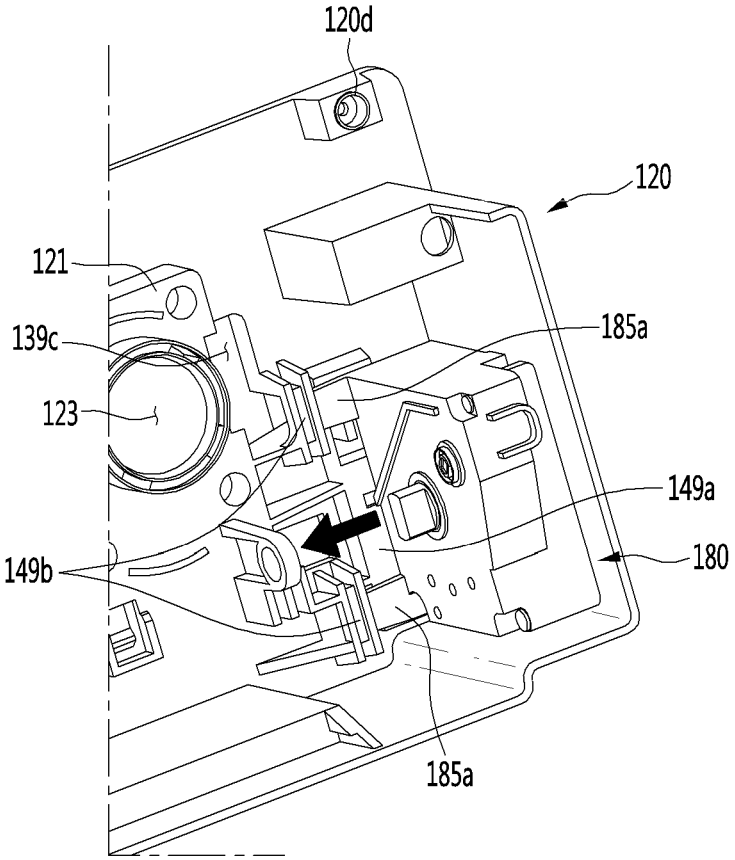
FIG. 53 is a partial perspective view showing a driver being moved for provisional fixing of a driver.
Figure 54:
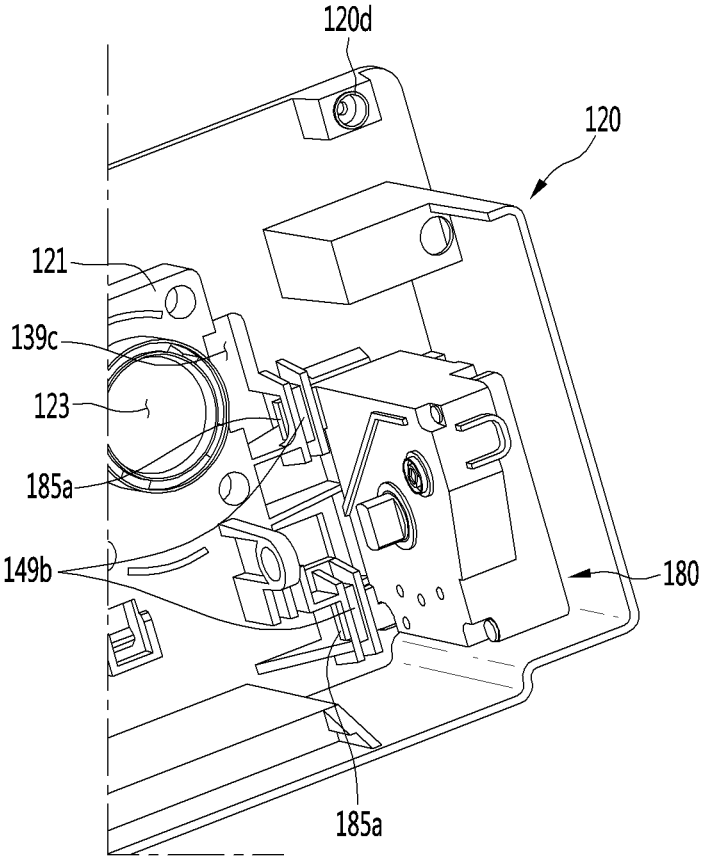
FIG. 54 is a partial perspective view of a driver, which has been provisionally-fixed.
Figure 55:
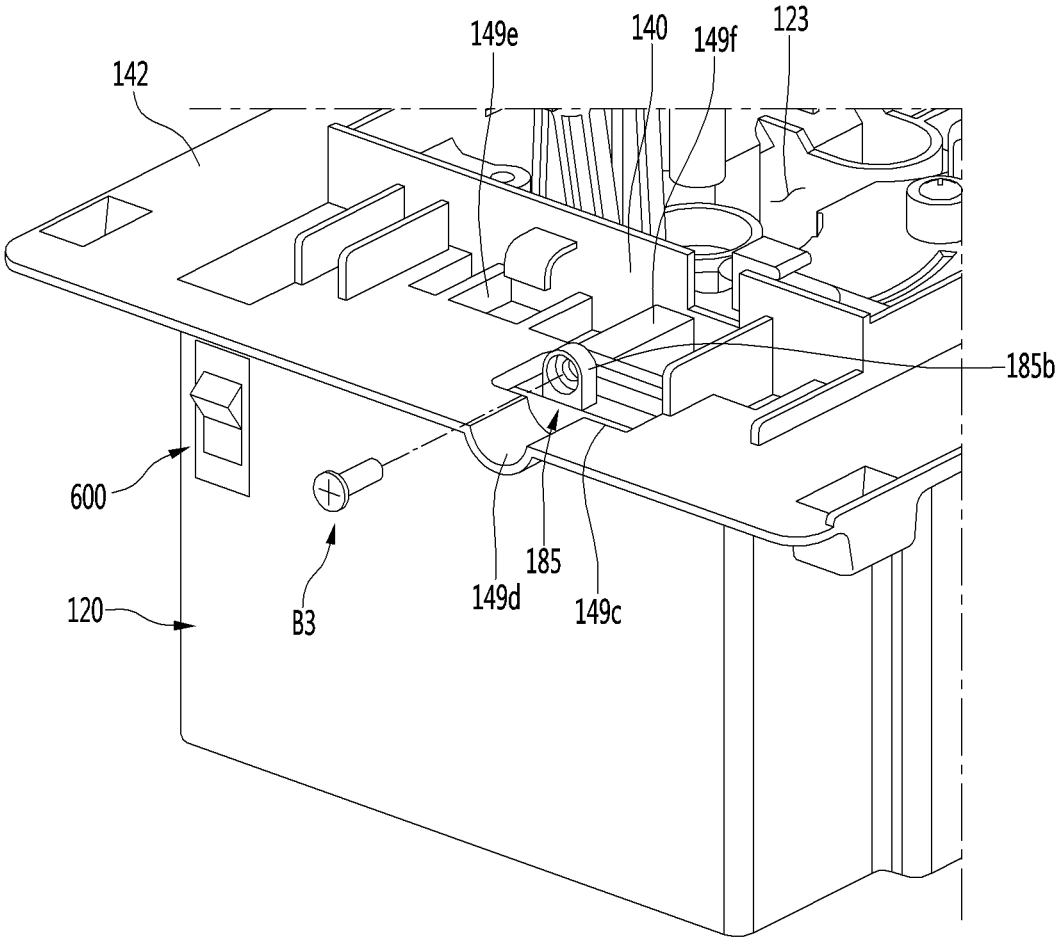
FIG. 55 is a partial perspective view for showing restraint and coupling of a driver.

FIG. 52 is an exploded perspective view of a driver according to an embodiment of the present disclosure. Further, FIG. 53 is a partial perspective view showing a driver being moved for provisional fixing of a driver. Further, FIG. 54 is a partial perspective view of a driver, which has been provisionally-fixed. Further, FIG. 55 is a partial perspective view for showing restraint and coupling of a driver.

As shown in FIGS. 52 to 55, the driver 180 may be mounted on an inner face of the upper casing 120. The driver 180 may be disposed adjacent to a side wall 143 far away from the cold-air hole 134, that is, the second side wall.

In one example, the driver 180 may have a pair of fixed protrusions 185*a* protruding from the top face. The fixed protrusion 185*a* may be formed in a plate shape. The fixed protrusion 185*a* may extend in a direction from the top face of the driver casing 185 to the cold-air hole 134.

Further, the rotation shaft 186 of the driver 180 may protrude in the protruding direction of the fixed protrusion 185*a*. Further, a lever connector 187 to which the ice-full state detection lever 700 is mounted may be formed on one side away from the rotation shaft 186. The top face of the driver casing 185 may further include a screw-receiving portion 185*b* formed thereon a through which a screw B3 for fixing the driver 180 penetrates.

An opening 149*c* may be defined in a bottom face of the upper plate 121 of the upper casing 120 in which the driver 180 is mounted. The opening 149*c* is defined such that the screw-receiving portion 185*b* may be passed therethrough. Further, a screw groove 149*d* may be defined at one side of the opening 149*c*.

Further, a driver mounted portion 149*a* on which the driver 180 is seated may be formed on the bottom face of the upper plate 121. The driver mounted portion 149*a* may be located closer to the cold-air hole 134 than the opening 149*c*, and the driver mounted portion 149*a* may further include an electrical-wire receiving hole 149*e* defined therein through which the electrical-wire connected to the driver 180 enters.

Further, the bottom face of the upper plate 121 may be formed with a fixed protruding confiner 149*b* into which the fixed protrusion 185*a* is inserted. The fixed protruding confiner 149*b* is positioned closer to the cold-air hole 134 than the driver mounted portion 149*a*. Further, the fixed protruding confiner 149*b* may have an insertion hole opening defined therein in a corresponding shape such that the fixed protrusion 185*a* may be inserted therein.

Hereinafter, a mounting process of the driver 180 having the structure as described above will be described.

As shown in the FIG. 52, the operator directs the top face of the driver 180 to the inner side of the upper casing 120, and insert the driver 180 into a mounting position of the driver 180.

Next, as shown in the FIG. 53, the operator moves the driver 180 horizontally toward the cold-air hole 134 in a state in which the fixed protrusion 185*a* is in close contact with the driver mounted portion 149*a*. The fixed protrusion 185*a* is inserted into the fixed protruding confiner 149*b* through such moving operation.

When the fixed protrusion 185*a* is fully inserted, as shown in FIG. 54, the fixed protrusion 185*a* is fixed inside the fixed protruding confiner 149*b*. Further, the top face of the driver casing 185 may be seated on the driver mounted portion 149*a*.

In this state, as shown in FIG. 55, the screw-receiving portion 185*b* may protrude upward and be exposed through the opening 149*c*. Further, the screw B3 is inserted and fastened into the screw-receiving portion 185*b* through the screw groove 149*d*. The driver 180 may be fixed to the upper casing 120 by the fastening of the screw B3.

In one example, the screw groove 149*d* may be defined at the end of the upper plate 121 corresponding to the screw-receiving portion 185*b*, thereby facilitating fastening and separating of the screw 83 to and from the screw-receiving portion 185*b*.

Hereinafter, the ice-full state detection lever 700 will be described with reference to the drawings.

Figure 56:
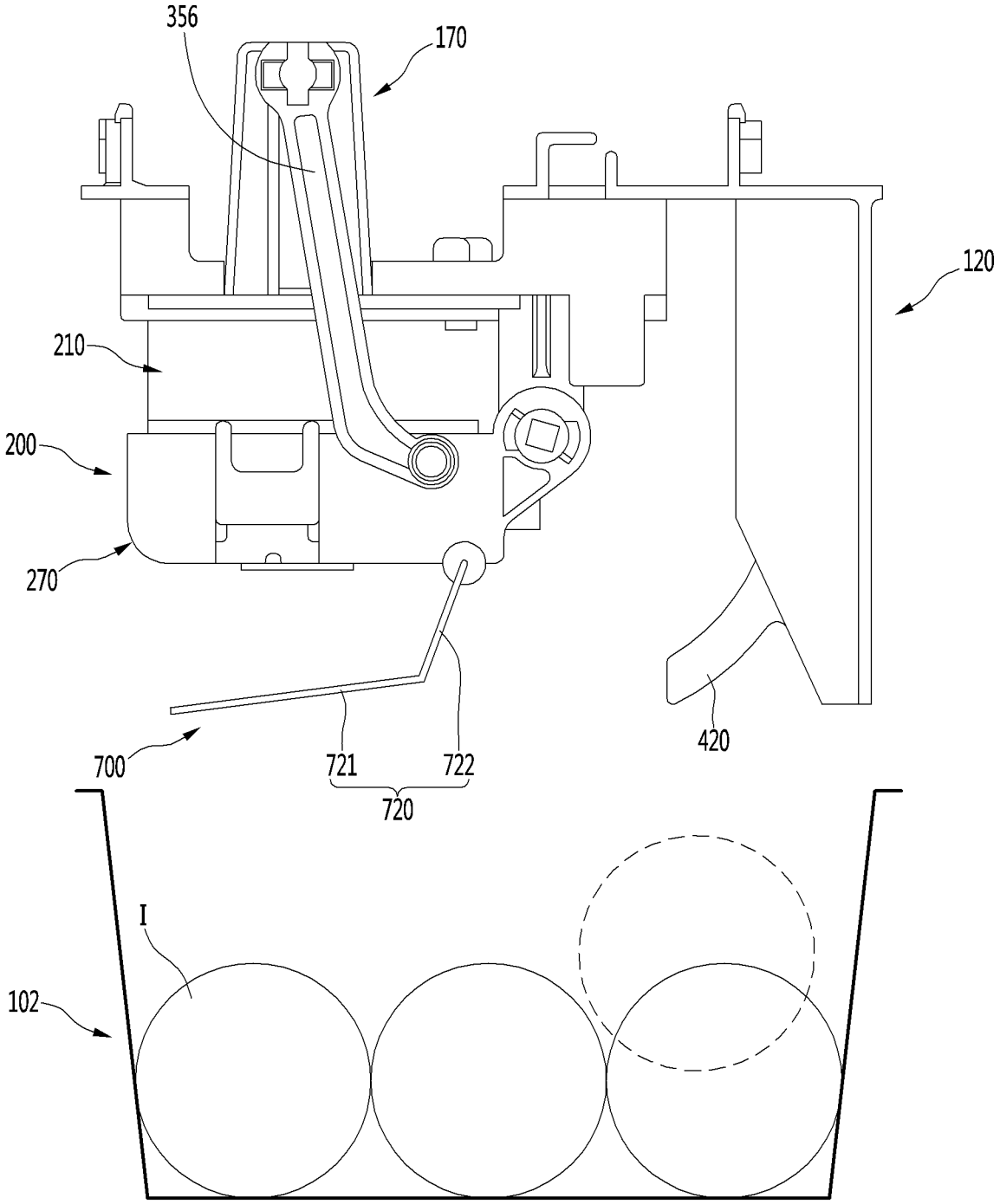
FIG. 56 is a side view of an ice-full state detection lever positioned at a topmost position, which is an initial position, according to an embodiment of the present disclosure.

FIG. 56 is a side view of an ice-full state detection lever positioned at a topmost position, which is an initial position, according to an embodiment of the present disclosure. Further, FIG. 57 is a side view of an ice-full state detection lever positioned at a bottommost position, which is a detection position.

Figure 57:
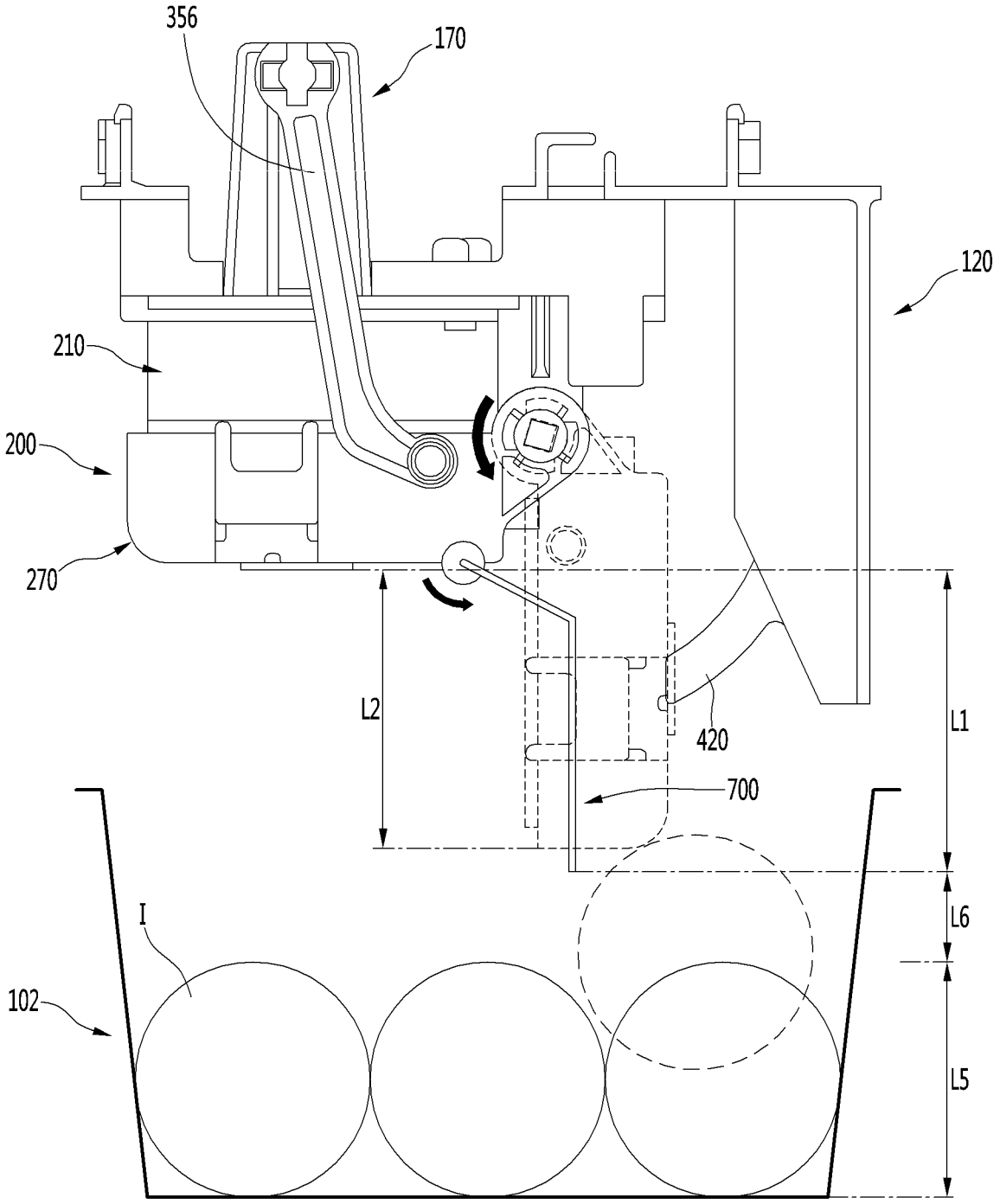
FIG. 57 is a side view of an ice-full state detection lever positioned at a bottommost position, which is a detection position.

As shown in FIG. 56 and FIG. 57, the ice-full state detection lever 700 may be connected to the driver 180 and may be pivoted by the driver 180. Further, the ice-full state detection lever 700 may pivot together when the lower assembly 200 pivots for the ice-removal to detect whether the ice bin 102 is in the ice-full state. In another example, the ice-full state detection lever 700 may be operated independently of the lower assembly 200 if necessary.

The ice-full state detection lever 700 has a shape bent in one direction (toward the left side of FIG. 56) due to the first bent portion 721 and the second bent portion 722. Therefore, even when the ice-full state detection lever 700 pivots as shown in FIG. 57 to detect the ice-full state, the ice-full state detection lever 700 may effectively detect whether the ice stored in the ice bin 102 has reached the predefined vertical level without interfering with other components. The lower assembly 200 and the ice-full state detection lever 700 may pivot counterclockwise at a degree greater than a degree as shown FIG. 57. In one example, the lower assembly 200 and the ice-full state detection lever 700 may pivot by about 140° for effective ice-removal.

A length L1 of the ice-full state detection lever 700 may be defined as the vertical distance from the pivoting shaft of the ice-full state detection lever 700 to the detection body 710. Further, the length of the ice-full state detection lever 700 may be larger than the distance L2 of the bottom branch of the lower assembly 200. If the length L1 of the ice-full state detection lever 700 is smaller than the distance L2 of the end branch of the lower assembly 200, the ice-full state detection lever 700 and the lower assembly 200 may interfere with each other in the process in which the ice-full state detection lever 700 and the lower assembly 200 pivot.

To the contrary, if the ice-full state detection lever 700 is too long and when the lever 799 extends to the location of the ice I placed at the bottom of the ice bin 102, there is a high probability of false detection. The ice made in this embodiment may be spherical and thus may roll and move inside the ice bin. Therefore, if the length of the ice-full state detection lever 700 is long enough to detect ice at the bottom of the ice bin 102, there is a possibility of misdetection of the ice-full state due to the detection of the rolling ice even though the ice bin is not in an actual ice-full state.

Therefore, the ice-full state detection lever 700 may extend to a position higher by the diameter of the ice so that the lever may not detect the ice laid in one layer on the bottom of the ice bin 102. In one example, the ice-full state detection lever 700 may extend to reach a position higher than the height L5 by the diameter of the ice I from the bottom of the ice bin 102 upon the ice-full state detection.

That is, the ice may be stored at the bottom face of the ice bin 102. Before the ice I entirely fills the first layer, the ice-full state detection lever 700 will not detect the ice-full state even when the lever pivots. When the refrigerator continues the ice-making and ice-removal processes, the ice spreads widely on the bottom face of the ice bin 102 instead of accumulating on the bottom of the ice bin 102 due to the characteristics of the spherical ice that is removed into the ice bin and thus sequentially forms an ice stack of multiple layers on the bottom face of the ice bin. Further, during the pivoting process of the lower assembly 200 or the movement process of the freezing compartment drawer 41, the first layer ice I inside the ice bin 102 rolls to fill an empty space therein.

Once the first layer on the bottom of the ice bin 102 is fully filled with the ice, the removed ice may be stacked on top of the ice I of the first layer. In this connection, the vertical dimension of the ice in the second layer is not twice the diameter of the ice, but may be a sum of the diameter of an single ice and about ½ to ¾ of the diameter of the ice. This is because the ice of the second layer is settled into a valley formed between the ices of the first layer.

In one example, when the ice-full state detection lever 700 detects the ice portion just above the height L5 of the ice I of the first layer, the detection may be erroneous when the ice height of the first layer is increased due to ice debris, etc. Thus, it would be desirable for the lever 700 to detect the ice portion higher than the height L5 of the ice I of the first layer by a predefined distance.

Thus, the ice-full state detection lever 700 may be formed to extend to any point which is higher than the height L5 by the diameter of the ice and is lower than the height L6 which is a sum of the ½ to ⅔ of the diameter of the single ice and the diameter of the single ice.

In one example, the ice-full state detection lever 700 is short as possible as as long as it does not interfere with the lower tray 250, thereby to secure the ice making amount. To prevent the erroneous detection due to the height difference caused by residual debris ices, the ice-full state detection lever 700 may have a length such that it extends to the top of the distance range L6. The top level of the vertical dimension L6 may be equal to a sum of the ½ to ⅔ of the diameter of the single ice and the diameter of the single ice.

In this embodiment, an example in which the lever 799 detects the ice of the second layer is described. In a refrigerator having the ice bin 102 being a large vertical dimension and having an large amounts of spherical ices stored in the ice bin 102, the lever 700 may detect the ice of the third layer or the ice of a higher layer. In this case, the ice-full state detection lever 700 may extend to a vertical level equal to a sum of the ½ to ⅔ of the diameter of the single ice and the diameters of the n ices from the bottom of the ice bin.

Hereinafter, the lower ejector 400 will be described with reference to the drawings.

Figure 58:
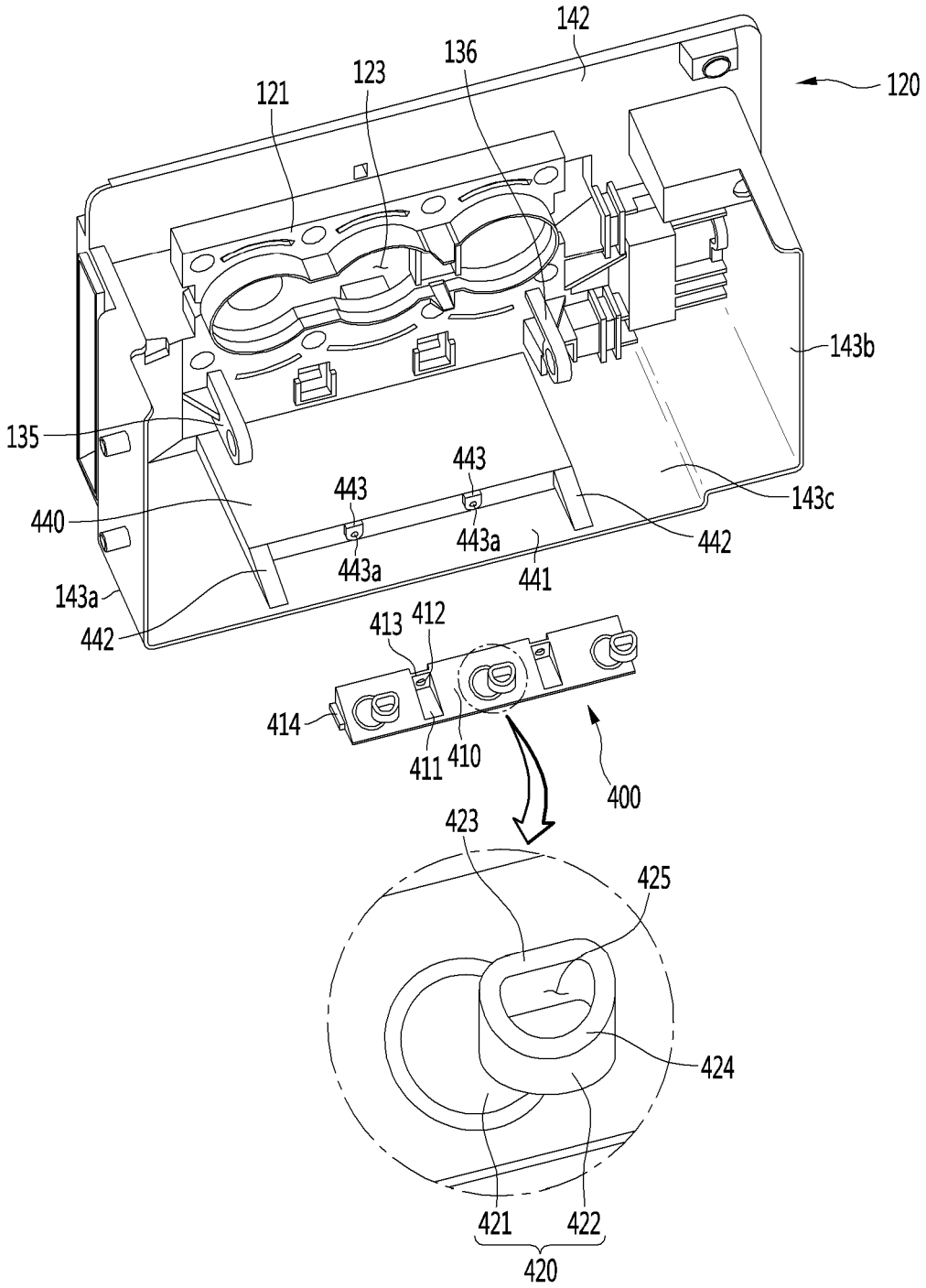
FIG. 58 is an exploded perspective view showing a coupling structure of an upper casing and a lower ejector according to an embodiment of the present disclosure.
Figure 59:
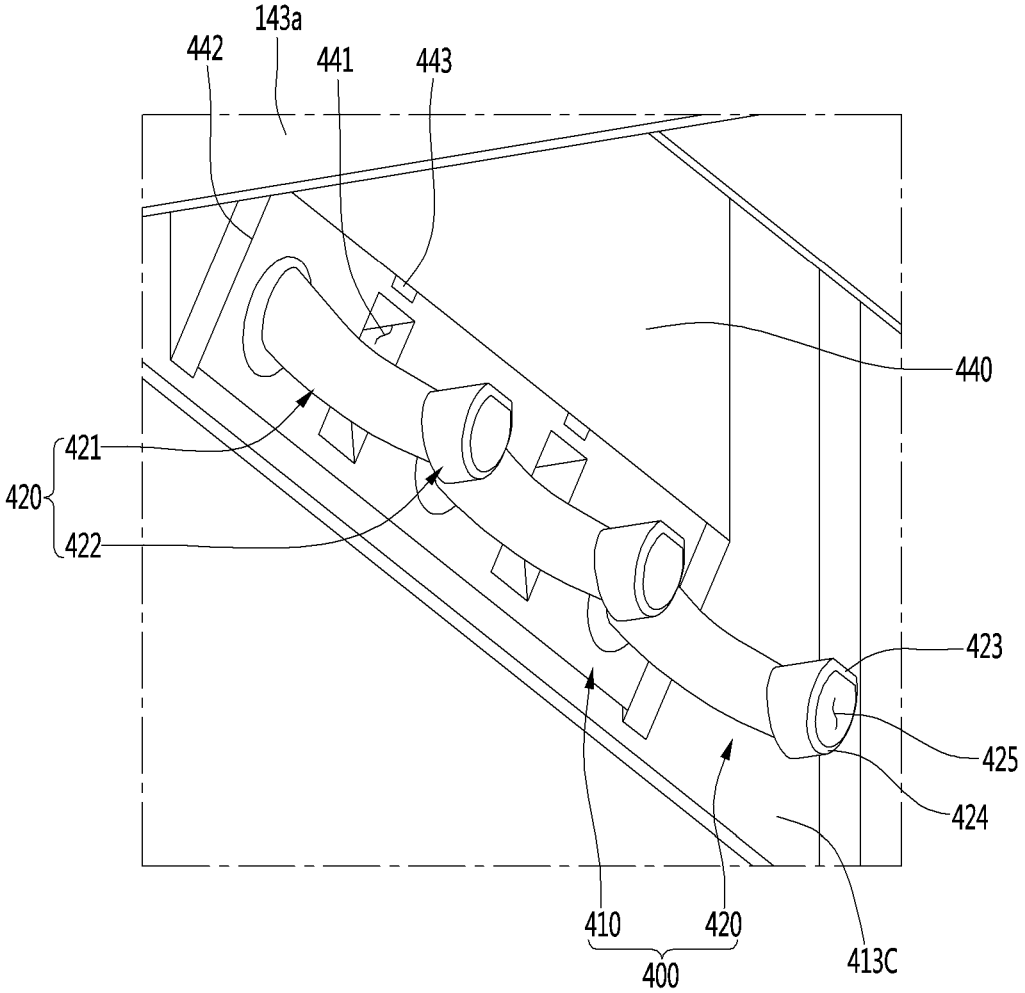
FIG. 59 is a partial perspective view showing a detailed structure of a lower ejector.
Figure 60:
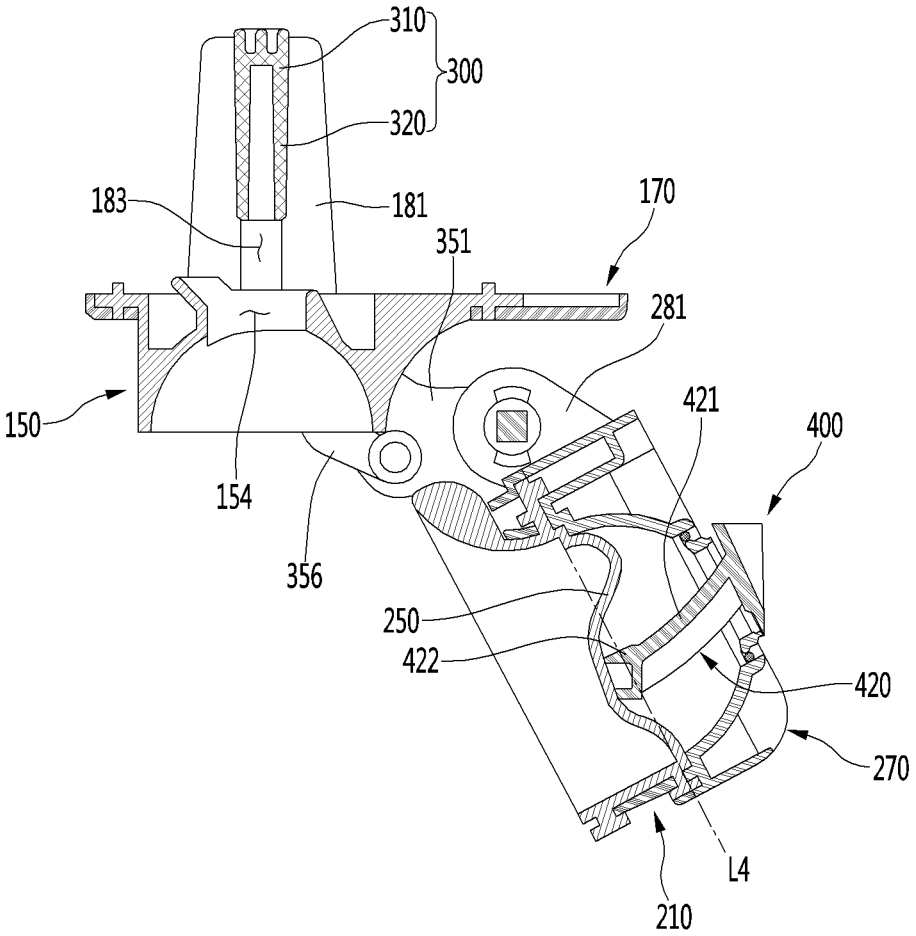
FIG. 60 shows a deformed state of a lower tray when the lower assembly is fully pivoted.
Figure 61:
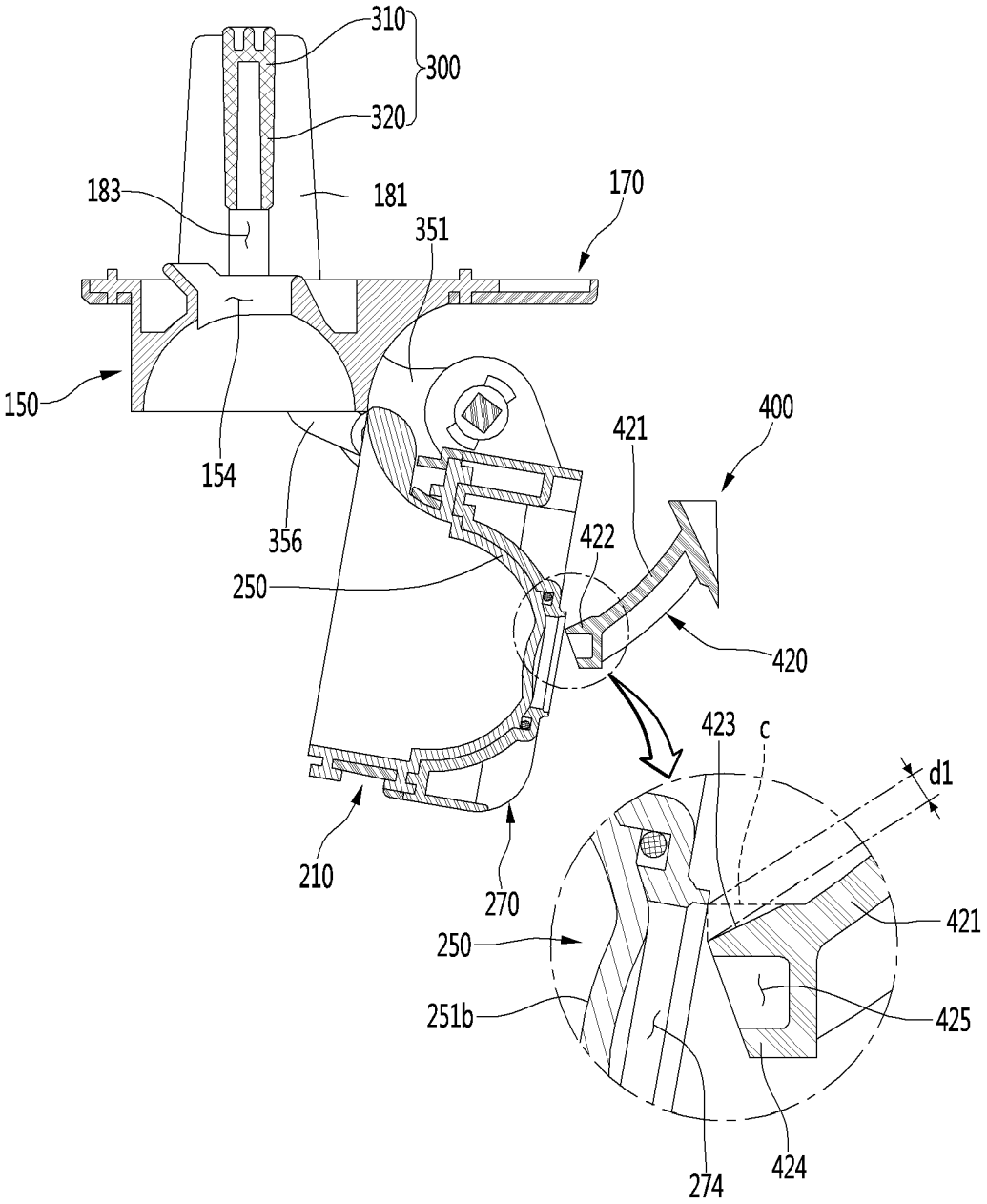
FIG. 61 shows a state just before a lower ejector passes through a lower tray.

FIG. 58 is an exploded perspective view showing a coupling structure of an upper casing and a lower ejector according to an embodiment of the present disclosure. Further, FIG. 59 is a partial perspective view showing a detailed structure of a lower ejector. Further, FIG. 60 shows a deformed state of a lower tray when the lower assembly fully pivots. Further, FIG. 61 shows a state just before a lower ejector passes through a lower tray.

As shown in FIG. 58 to FIG. 61, the lower ejector 400 may be mounted onto the side wall 143. An ejector mounted portion 441 may be formed at the bottom of the side wall 143. The ejector mounted portion 441 may be positioned to face the lower assembly 200 when the lower assembly 200 pivots. The ejector mounted portion 441 may be recessed into a shape corresponding to the shape of the lower ejector 400.

A pair of body fixing portions 443 may protrude from the top face of the ejector mounted portion 441. The body fixing portion 443 may have a hole 443*a* into which the screw is fastened. Further, the lateral portion 442 may be formed on each of both sides of the ejector mounted portion 441. The lateral portion 442 may have a groove defined therein for receiving each of both ends of the lower ejector 400 so that the lower ejector 400 may be inserted in a slidable manner.

The lower ejector 400 may include a lower ejector body 410 fixed to the ejector mounted portion 441, and a lower ejecting pin 420 protruding from the lower ejector body 410. The lower ejector body 410 may be formed into a shape corresponding to a shape of the ejector mounted portion 441. The face defined by the lower ejecting pin 420 may be inclined so that the lower ejecting pin 420 faces toward the lower opening 274 when the lower assembly 200 pivots.

The top face of the lower ejector body 410 may have a body groove 413 defined therein for receiving the body fixing portion 443. In the body groove 413, a hole 412 to which the screw is fastened may be defined. Further, an inclined groove 411 may be recessed in the inclined face of the lower ejector body 410 corresponding to the hole 412 to facilitate the fastening and detachment of the screw.

Further, a guide rib 414 may protrude on each of the both sides of the lower ejector body 410. The guide rib 414 may be inserted into the lateral portion 442 of the ejector mounted portion 441 upon mounting of the lower ejector 400.

In one example, the lower ejecting pin 420 may be formed on the inclined face of the ejector body 310. The number of the lower ejecting pins 420 may be equal to the number of the lower chambers 252. The lower ejecting pins 420 may push the lower chambers 252 respectively for ice removal.

The lower ejecting pin 420 may include a rod 421 and a head 422. The rod 421 may support the head 422. Further, the rod 421 may be formed to have a predetermined length and slope or roundness such that the lower ejecting pin 420 extends to the lower opening 274. The head 422 is formed at the extended end of the rod 421 and pushes the curved outer surface of the lower chamber 252 for the ice-removal.

In detail, the rod 421 may be formed to have a predetermined length. In one example, the rod 421 may extend such that the end of the head 422 meets an extension L4 of the top of the lower chamber 252 when the lower assembly 200 fully pivots for the ice-removal. That is, the rod 421 may extend to a sufficient length so that when the head 422 pushes the lower tray 250 for the removal of the ice from the lower chamber 252, the ice is pushed by the head 422 until the ice may deviate from at least the hemisphere area so that ice may be separated from the lower chamber 252.

If the rod 421 is further longer, interference may occur between the lower opening 274 and the rod 421 when the lower assembly 200 pivots. If the rod 421 is too short, the removal the of ice from the lower tray 250 may not be carried out smoothly.

The rod 421 protrudes from the inclined surface of the lower ejector body 410 and has a predetermined inclination or roundness. The rod 421 may be configured to naturally pass through the lower opening 274 when the lower assembly 200 pivots. That is, the rod 421 may extend along the pivoting path of the lower opening 274.

In one example, the head 422 may protrude from the end of the rod 421. The head 422 may have a hollow 425 formed therein. Thus, the area of contact thereof with the ice surface may be increased such that the head 422 may push the ice effectively.

The head 422 may include an upper head 423 and a lower head 424 formed along the perimeter of the head 422. The upper head 423 may protrude more than the lower head 424. Therefore, the head 422 may effectively push the curved surface of the lower chamber 252 where the ice is accommodated, that is, push the convex portion 251*b*. When the head 422 pushes the convex portion 251*b*, both the upper head 423 and the lower head 424 are in contact with the curved face, thereby to push more reliably the ice for the ice-removal.

Thus, the spherical ice may be removed more effectively from the lower tray 250. In one example, when the upper head 423 of the head 422 protrudes more than the lower head 424, the lower opening 274 and the end of the upper head 423 may interfere with each other in the pivoting process of the lower assembly 200.

In order to prevent the interference, the protruding length of the upper head 423 may be maintained, but the top face of the upper head 423 may be formed in an obliquely cut off shape. That is, the upper head 423 may have the top face as inclined. In this connection, the inclination of the upper head 423 may be configured such that the vertical level may gradually be lower toward the extended end of the upper head 423. In order to form the cutoff portion of the upper head 423, the top face portion of the upper head 423 may be partially cut off by an area where interference thereof with the lower opening occurs, that is, by approximately C.

Thus, as shown in FIG. 61, the upper head 423 may extend to a sufficient length to effectively contact the curved surface, but may not interfere with the perimeter of the lower opening 274 due to the presence of the cut off portion. That is, the rod 421 may have a sufficient length while the head 422 may be constructed to improve the contact ability with the curved surface and at the same time prevent the interference with the lower opening 274, so that the ice-removal from the lower chamber 252 may be facilitated efficiently.

Hereinafter, the operation of the ice-maker 100 will be described with reference to the drawings.

Figure 62:
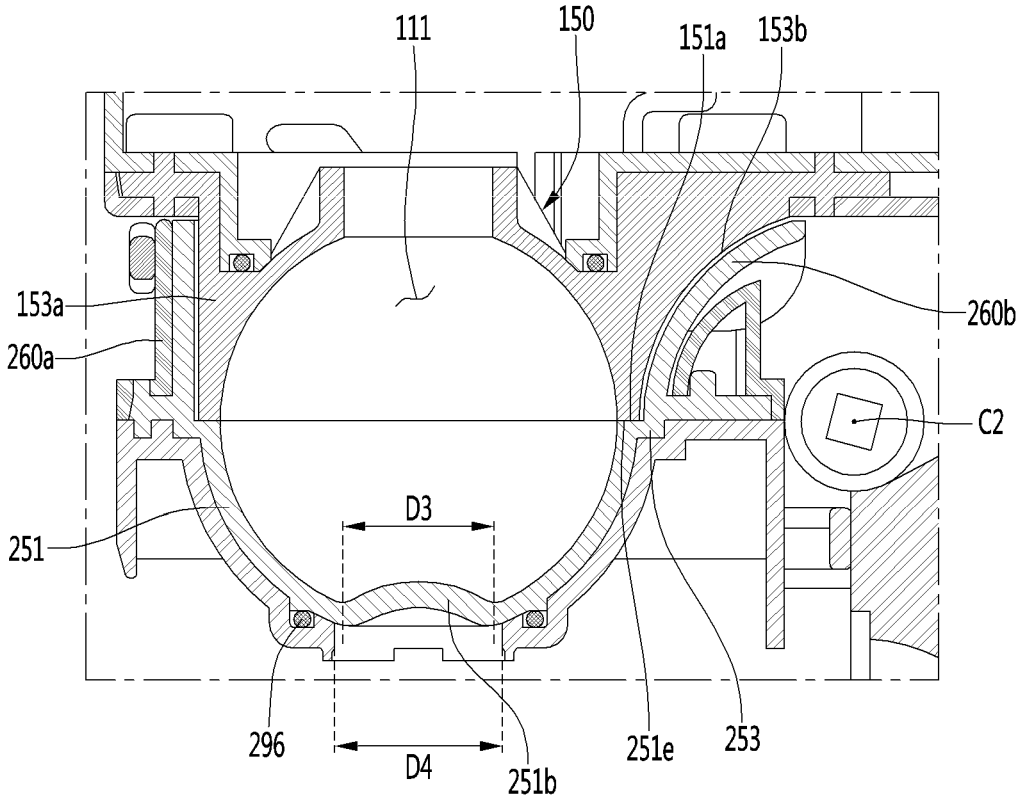
FIG. 62 is a cutaway view taken along a line 62-62' of FIG. 8.
Figure 63:
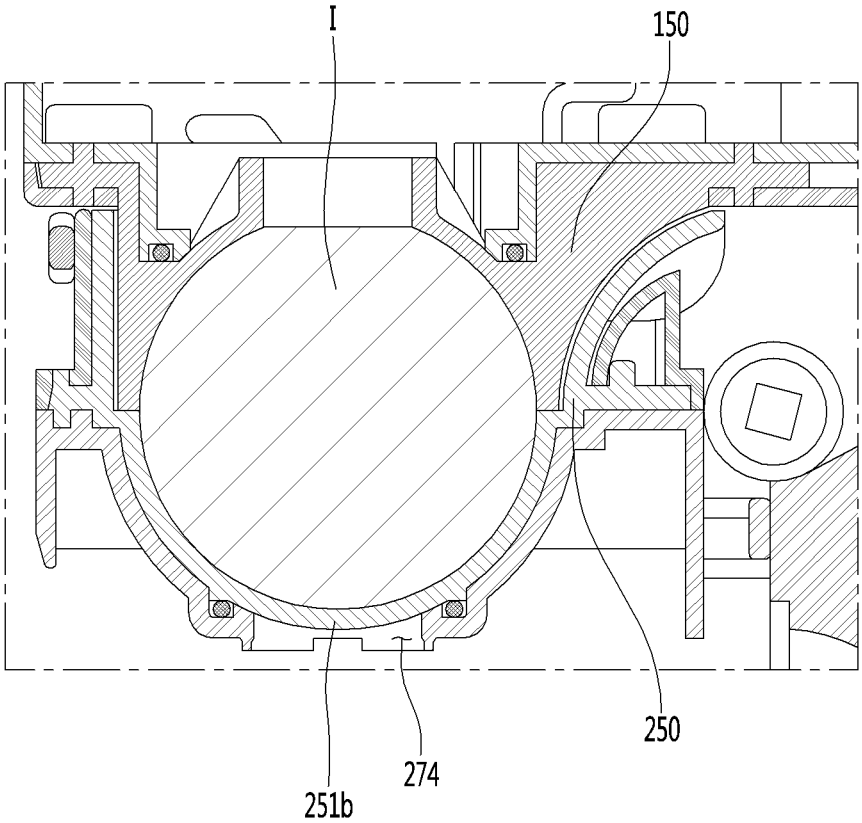
FIG. 63 is a view showing a state in which the ice generation is completed in FIG. 62.

FIG. 62 is a cutaway view taken along a line 62-62' of FIG. 8. FIG. 63 is a view showing a state in which the ice generation is completed in FIG. 62.

Referring to FIG. 62 and FIG. 63, the lower support 270 may be equipped with a lower heater 296.

The lower heater 296 applies heat to the ice chamber 111 in the ice-making process, causing a top portion of water in the ice chamber 111 to be first frozen. Further, as the lower heater 296 periodically turns on and off in the ice-making process to generate heat. Thus, in the ice-making process, bubbles in the ice chamber 111 are moved downward. Thus, when the ice-making process is completed, a portion of the spherical ice except for the lowest portion may become transparent. That is, according to this embodiment, a substantially transparent spherical ice may be produced. In the present embodiment, the substantially transparent sphere shaped ice is not perfectly transparent but has a degree of transparency at which the ice may be commonly referred to as transparent ice. The substantially sphere shape is not a perfect sphere, but means a roughly spherically shape.

In one example, the lower heater 296 may be a wire type heater. The lower heater 296 may be a DC heater, like the upper heater 148. The lower heater 296 may be configured to have a lower output than that of the upper heater 148. In one example, the upper heater 148 may have a heat capacity of 9.5 W, while the lower heater 296 may have a 6.0 W heat capacity. Thus, the upper heater 148 and lower heater 296 may maintain the condition at which the transparent ice is made by heating the upper tray 150 and the lower tray 250 periodically at low heat capacity.

The lower heater 296 may contact the lower tray 250 to apply heat to the lower chamber 252. In one example, the lower heater 296 may be in contact with the lower tray body 251.

In one example, the ice chamber 111 is defined as the upper tray 150 and the lower tray 250 are arranged vertically and contact each other. Further, a top face 251*e* of the lower tray body 251 is in contact with a bottom face 151*a* of the upper tray body 151.

In this connection, while the top face of the lower tray body 251 and the bottom face of the upper tray body 151 are in contact with each other, the elastic force of the elastic member 360 is exerted to the lower support 270. The elastic force of the elastic member 360 is then applied to the lower tray 250 via the lower support 270 such that the top face 251*e* of the lower tray body 251 presses the bottom face 151*a* of the upper tray body 151. Thus, while the top face of the lower tray body 251 is in contact with the bottom face of the upper tray body 151, the both faces are pressed against each other, thereby improving adhesion therebetween.

Thus, when the adhesion between the top face of the lower tray body 251 and the bottom face of the upper tray body 151 is increased, there may be no gap between the two faces to prevent formation of a thin strip shaped burr around the spherical ice after the completion of the ice-making process. Further, as in FIGS. 39 and 40, the upper rib 153*d* and the lower rib 253*a* may prevent the gap formation until the ice-making process is completed.

The lower tray body 251 may further include the convex portion 251*b* in which the lower portion of the body 251 is convex upward. That is, the convex portion 251*b* may be configured to be convex toward the inside of the ice chamber 111.

A convex shaped recess 251*c* may be formed below and in a corresponding manner to the convex portion 251*b* such that a thickness of the convex portion 251*b* is substantially equal to a thickness of the remaining portion of the lower tray body 251.

As used herein, the phrase "substantially equal" may mean being exactly equal to each other or being equal to each other within a tolerable difference.

The convex portion 251*b* may be configured to face the lower opening 274 of the lower support 270 in the vertical direction.

Further, the lower opening 274 may be located vertically below the lower chamber 252. That is, the lower opening 274 may be located vertically below the convex portion 251*b*.

As shown in FIG. 62, a diameter D3 of the convex portion 251*b* may be smaller than a diameter D4 of the lower opening 274.

When cold-air is supplied to the ice chamber 111 while water has been supplied to the ice chamber 111, the liquid water changes to solid ice. In this connection, the water expands in a process in which the water changes to the ice, such that a water expansion force is applied to each of the upper tray body 151 and the lower tray body 25.

In this embodiment, while a portion (hereinafter, referred to as a corresponding portion) corresponding to the lower opening 274 of the support body 271 is not surrounded by the support body 271, a remaining portion of the lower tray body 251 is surrounded by the support body 271.

When the lower tray body 251 is formed in a perfect hemispherical shape, and when the expansion force of the water is applied to the corresponding portion of the lower tray body 251 corresponding to the lower opening 274, the corresponding portion of the lower tray body 251 is deformed toward the lower opening 274.

In this case, before the ice is produced, the water supplied to the ice chamber 111 is in a form of a sphere. However, after the ice has been produced, the deformation of the corresponding portion of the lower tray body 251 may allow an additional ice portion in a form of a protrusion to be formed to occupy a space created by the deformation of the corresponding portion.

Therefore, in this embodiment, the convex portion 251*b* may be formed in the lower tray body 251 in consideration of the deformation of the lower tray body 251 such that the shape of the finally created ice is identical as possible as with the perfect sphere.

In this embodiment, the water supplied to the ice chamber 111 does not have a spherical shape until the ice is formed. However, after the ice generation is completed, the convex portion 251*b* of the lower tray body 251 is deformed toward the lower opening 274 such that the spherical ice may be generated.

In the present embodiment, since the diameter D1 of the convex portion 251*b* is smaller than the diameter D2 of the lower opening 274, the convex portion 251*b* may be deformed and invade inside the lower opening 274.

Figure 64:
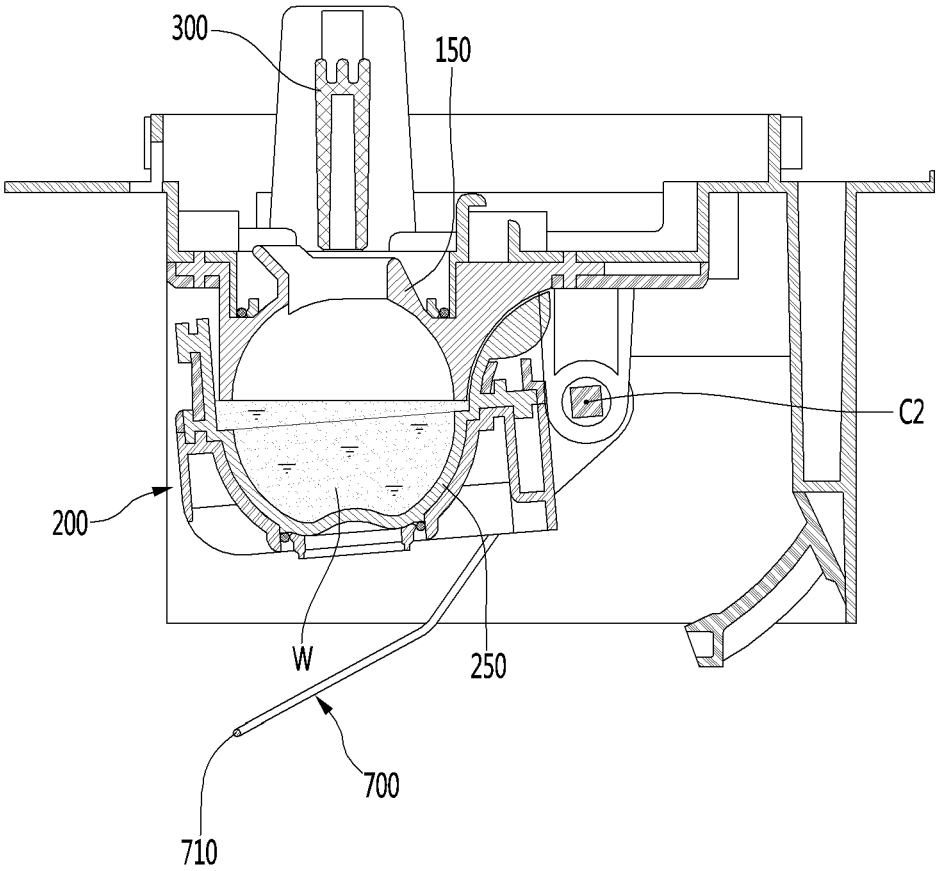
FIG. 64 is a cross-sectional view taken along a line 62-62' of FIG. 8 in a water-supplied state.
Figure 65:
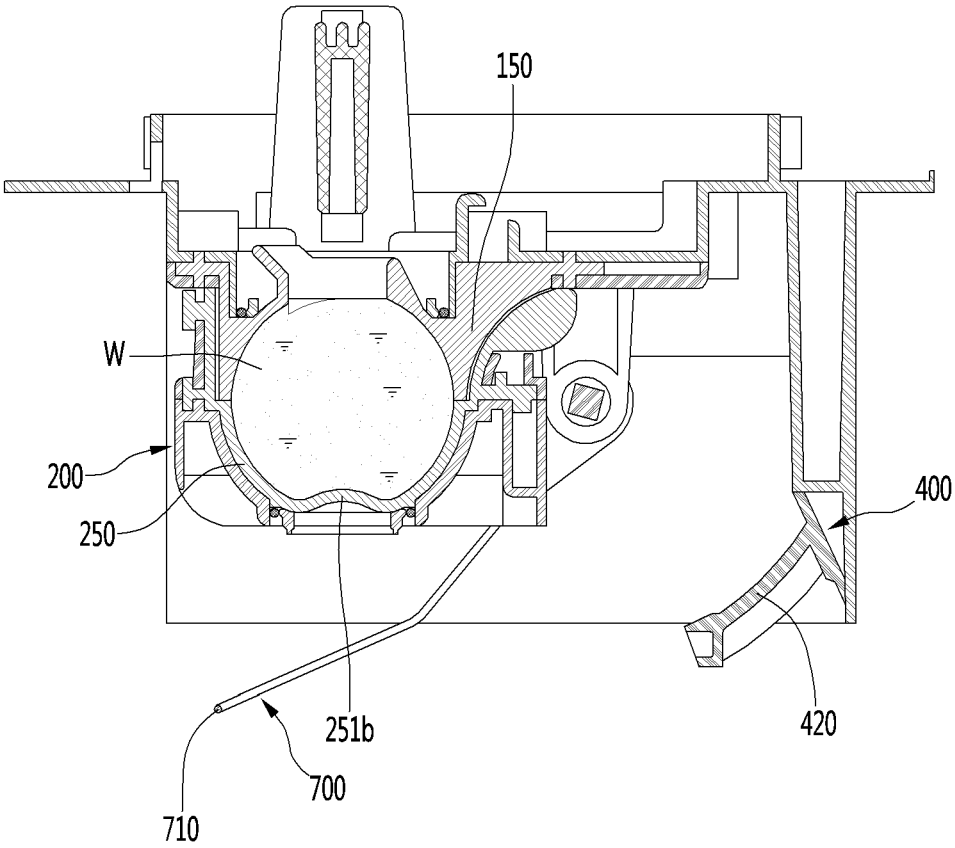
FIG. 65 is a cross-sectional view taken along a line 62-62' of FIG. 8 in an ice-making process.
Figure 66:
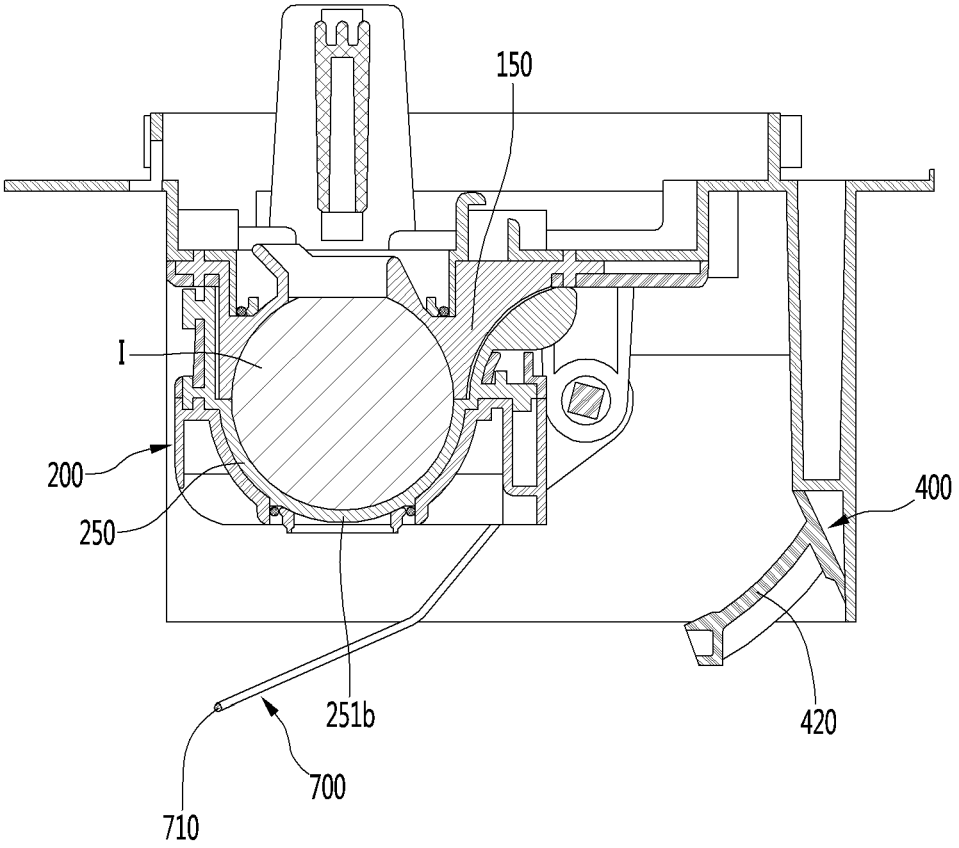
FIG. 66 is a cross-sectional view taken along a line 62-62' of FIG. 8 in a state in which the ice-making process is completed.
Figure 67:
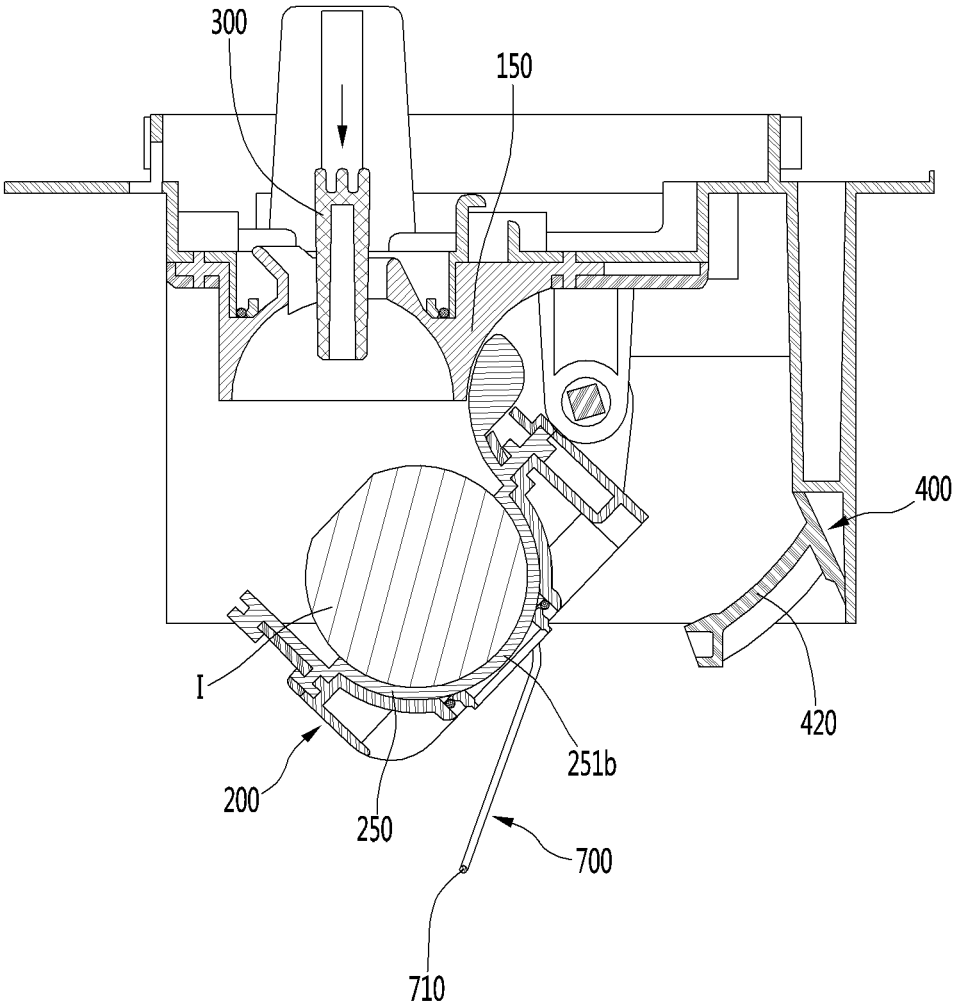
FIG. 67 is a cross-sectional view taken along a line 62-62' of FIG. 8 at an initial ice-removal state.
Figure 68:
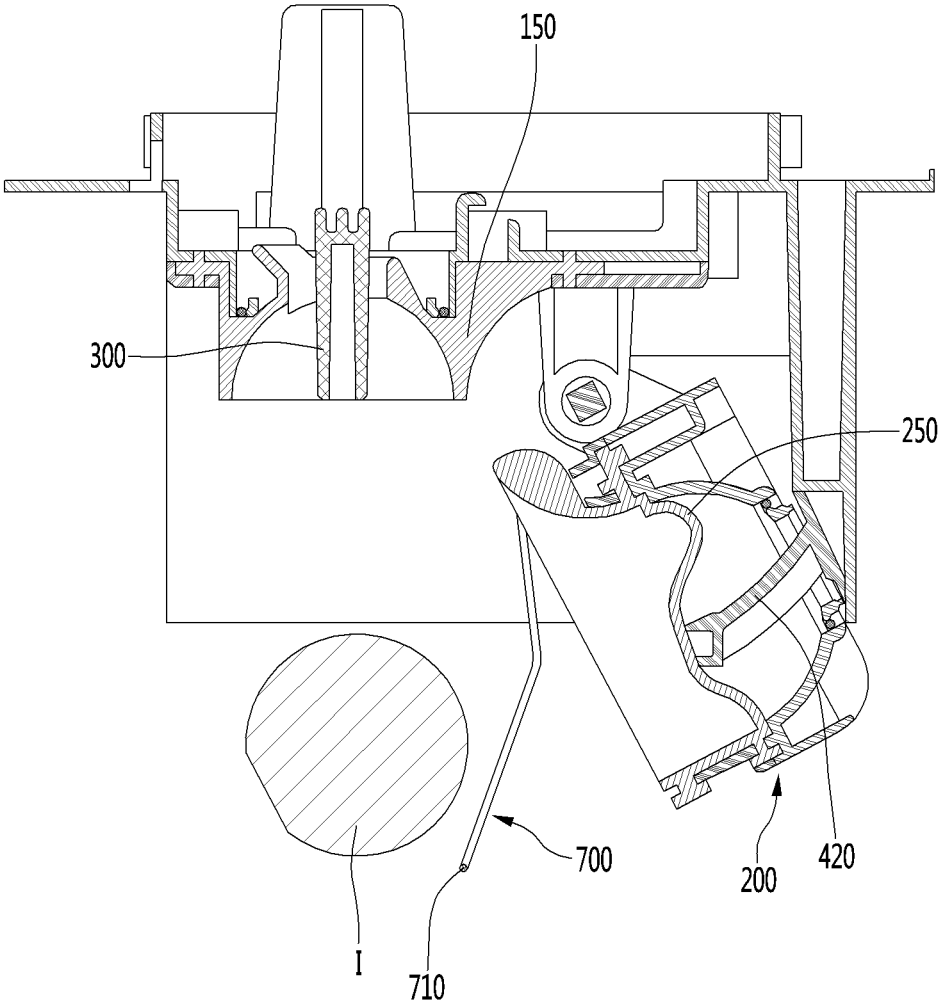
FIG. 68 is a cross-sectional view taken along a line 62-62' of FIG. 8 in a state in which an ice-removal process is completed.

Hereinafter, an ice manufacturing process by an ice-maker according to an embodiment of the present disclosure will be described. FIG. 64 is a cross-sectional view taken along a line 62-62' of FIG. 8 in a water-supplied state. Further, FIG. 65 is a cross-sectional view taken along a line 62-62' of FIG. 8 in an ice-making process. Further, FIG. 66 is a cross-sectional view taken along a line 62-62' of FIG. 8 in a state in which the ice-making process is completed. Further, FIG. 67 is a cross-sectional view taken along a line 62-62' of FIG. 8 at an initial ice-removal state. Further, FIG. 68 is a cross-sectional view taken along a line 62-62' of FIG. 8 in a state in which an ice-removal process is completed.

Referring to FIG. 64 to FIG. 68, first, the lower assembly 200 is moved to the water-supplied position.

In the water-supplied position of the lower assembly 200, the top face 251*e* of the lower tray 250 is spaced apart from at least a portion of the bottom face 151*e* of the upper tray 150. In the present embodiment, a direction in which the lower assembly 200 pivots for the ice-removal is referred to as a forward direction (a counterclockwise direction in the drawing), while a direction opposite to the forward direction is referred to as a reverse direction (a clockwise direction in the drawing).

In one example, an angle between the top face 251*e* of the lower tray 250 and the bottom face 151*e* of the upper tray 150 in the water-suppled position of the lower assembly 200 may be approximately 8°. However, the present disclosure may not be limited thereto.

In the water-supply position of the lower assembly 200, the detection body 710 is located below the lower assembly 200.

In this state, water is supplied by the water supply 190 to the ice chamber 111. In this connection, water is supplied to the ice chamber 111 through one ejector-receiving opening of the plurality of ejector-receiving openings 154 of the upper tray 150.

When the water supply is completed, a portion of the water as supplied may fill an entirety of the lower chamber 252, while a remaining portion of the water as supplied may fill a space between the upper tray 150 and the lower tray 250.

In one example, a volume of the upper chamber 151 and a volume of the space between the upper tray 150 and the lower tray 250 may be equal to each other. Then, water between the upper tray 150 and the lower tray 250 may fill an entirety of the upper tray 150. Alternatively, the volume of the space between the upper tray 150 and the lower tray 250 may be smaller than the volume of the upper chamber 151. In this case, the water may be present in the upper chamber 151.

In the present embodiment, there is no channel for mutual communication between the three lower chambers 252 in the lower tray 250.

Even when there is no channel for water movement in the lower tray 250, a following result may be achieved because the lower tray 250 and the upper tray 150 are spaced apart from each other in the water-supply step as shown in FIG. 64: in the water-supply process, when a specific lower chamber 252 is fully filled with water, the water may move to neighboring lower chambers 252 to fill all of the lower chambers 252. Thus, each of the plurality of lower chambers 252 of the lower tray 250 may be fully filled with water.

Further, in this embodiment, since there is no channel for communication between the lower chambers 252 in the lower tray 250, the presence of the additional ice portion in the form of the protrusion around the ice after the ice has been created may be suppressed.

When the water-supply is completed, the lower assembly 200 pivots in the reverse direction as shown in FIG. 30. When the lower assembly 200 pivots in the reverse direction, the top face 251*e* of the lower tray 250 is brought to be close to the bottom face 151*e* of the upper tray 150.

Then, water between the top face 251*e* of the lower tray 250 and the bottom face 151*e* of the upper tray 150 is divided into portions which in turn are distributed into the plurality of upper chambers 152 respectively. Further, when the top face 251*e* of the lower tray 250 and the bottom face 151*e* of the upper tray 150 come into a close contact state with each other, the upper chambers 152 may be filled with water.

In one example, when the lower assembly is in a closed state such that the upper tray 150 and lower tray 250 are in close contact with each other, the chamber wall 153 of the upper tray body 151 may be accommodated in the interior space of the side wall 260 of the lower tray 250.

In this connection, the vertical wall 153*a* of the upper tray 150 may face the vertical wall 260*a* of the lower tray 250, while the curved wall 153*b* of the upper tray 150 may face the curved wall 260*b* of the lower tray 250.

The outer face of the chamber wall 153 of the upper tray body 151 is spaced apart from the inner face of the side wall 260 of the lower tray 250. That is, a space (G2 in FIG. 39) is formed between the outer face of the chamber wall 153 of the upper tray body 151 and the inner face of the side wall 260 of the lower tray 250.

The water supplied from the water supply 180 may be supplied while the lower assembly 200 pivots at a predetermined angle to be open such that the water fill the entire ice chamber 111. Thus, the water as supplied will fill the lower chamber 252 and fill an entirety of the inner space defined with the side wall 260, thereby to fill the neighboring lower chambers 252. In this state, when the water supply to the predefined level is completed, the lower assembly 200 pivots to be closed so that the water level in the ice chamber 111 becomes the predefined level. In this connection, the space (G1, G2) between the inner faces of the side wall 260 of the lower tray 250 is inevitably filled with water.

In one example, when more than a predefined amount of water in the water-supply process or ice-making process is supplied to the ice chamber 111, the water from the ice chamber 111 may flow into the ejector-receiving opening 154, that is, into the buffer. Thus, even when more than the predefined amount of water is present in the ice chamber 111, the water may be prevented from overflowing the ice-maker 100.

For this reason, while the top face of the lower tray body 251 contacts the bottom face of the upper tray body 151 such that the lower assembly is in a closed state, the top of the side wall 260 may be positioned at a higher level than the bottom of the ejector-receiving opening 154 of the upper tray 150 or the top of the upper chamber 152.

The position of the lower assembly 200 while the top face 251*e* of the lower tray 250 and the bottom face 151*e* of the upper tray 150 contact each other may be referred to as the ice-making position. In the ice-making position of the lower assembly 200, the detection body 710 is positioned below the lower assembly 200.

Then, the ice-making process begins while the lower assembly 200 has moved to the ice-making position.

During the ice-making process, the pressure of the water is lower than the force for deforming the convex portion 251*b* of the lower tray 250, so that the convex portion 251*b* remains undeformed.

When the ice-making process begins, the lower heater 296 may be turned on. When the lower heater 296 is turned on, heat from the lower heater 296 is transferred to the lower tray 250.

Thus, when the ice-making is performed while the lower heater 296 is turned on, a top portion of the water the ice chamber 111 is first frozen.

In this embodiment, a mass or volume the water in the ice chamber 111 may vary or may not vary along a height of the ice chamber depending on the shape of the ice chamber 111.

For example, when the ice chamber 111 has a cuboid shape, the mass or volume of the water in the ice chamber 111 may not vary along the height thereof.

To the contrary, when the ice chamber 111 has a sphere, an inverted triangle or a crescent shape, the mass or volume may vary along the height thereof.

When the temperature of the cold-air and the amount of the cold-air supplied to the freezing compartment 4 are constant, and when the output of the lower heater 296 is constant, a rate at which the ice is produced may vary along the height when the ice chamber 111 has a sphere, an inverted triangle or a crescent shape such that the mass or volume may vary along the height thereof.

For example, when the mass per unit height of water is small, ice formation rate is high, whereas when the mass per unit height of water is large, ice formation rate is low.

As a result, the rate at which ice is generated along the height of the ice chamber is not constant, such that the transparency of the ice may vary along the height. In particular, when ice is generated at a high rate, bubbles may not move from the ice to the water, such that ice may contain bubbles, thereby lowering the ice transparency.

Therefore, in this embodiment, the output of the lower heater 296 may be controlled based on the mass per unit height of water of the ice chamber 111.

When the ice chamber 111 is formed into a spherical shape, as shown in this embodiment, the mass per unit height of water in the ice chamber 111 increases in a range from a top to a middle level and then decreases in a range from the middle level to the bottom.

Thus, after the lower heater 296 turns on, the output of the lower heater 430 decreases gradually and then the output is minimal at the middle level of the chamber. Then, the output of the lower heater 296 may increase gradually from the middle level to the top of the chamber.

Thus, since the top portion of the water in the ice chamber 111 is first frozen, bubbles in the ice chamber 111 move downwards. In the process where ice is generated in a downward direction in the ice chamber 111, the ice comes into contact with the top face of the convex portion 251*b* of the lower tray 250.

When the ice is continuously generated in this state, the convex portion 251*b* is deformed by the ice pressing the convex portion as shown in FIG. 31. When the ice-making process is completed, the spherical ice may be generated.

A controller (not shown) may determine whether the ice-making is completed based on the temperature detected by the temperature sensor 500.

The lower heater 296 may be turned off when the ice-making is completed or before ice-making is completed.

When the ice-making process is completed, the upper heater 148 may first be turned on for ice-removal of the ice. When the upper heater 148 is turned on, the heat from the upper heater 148 is transferred to the upper tray 150, thereby to cause the ice to be separated from the inner face of the upper tray 150.

After the upper heater 148 is activated for a predefined time, the upper heater 148 is turned off. Then, the driver 180 may be activated to pivot the lower assembly 200 in the forward direction.

As the lower assembly 200 pivot in a forward direction, as shown in FIG. 66, the lower tray 250 is spaced apart from the upper tray 150.

Further, the pivoting force of the lower assembly 200 is transmitted to the upper ejector 300 via the connector 350. Then, the upper ejector 300 is lowered by the unit guides 181 and 182, such that the ejecting pin 320 is inserted into the upper chamber 152 through the ejector-receiving opening 154.

In the ice-removal process, the ice may be removed from the upper tray 250 before the ejecting pin 320 presses the ice. That is, the ice may be separated from the surface of the upper tray 150 due to the heat of the upper heater 148.

In this case, the ice may be moved together with the lower assembly 200 while the ice is supported by the lower tray 250.

Alternatively, the ice does not separate from the surface of the upper tray 150 even though the heat of the upper heater 148 is applied to the upper tray 150.

Thus, when the lower assembly 200 pivots in a forward direction, the ice may be separated from the lower tray 250 while the ice is in close contact with the upper tray 150.

In this state, in the pivoting process of the lower assembly 200, the ice may be released from the upper tray 150 when the ejecting pin 320 passes through the ejector-receiving opening 154 and then presses the ice as is in close contact to the upper tray 150. The ice removed from the upper tray 150 may again be supported by the lower tray 250.

When the ice moves together with the lower assembly 200 while the ice is supported by the lower tray 250, the ice may be separated from the lower tray 250 by its own weight even when no external force is applied to the lower tray 250.

In the forward pivoting process of the lower assembly 200, the ice-full state detection lever 700 may move to the ice-full state detection position, as shown in FIG. 67. In this connection, when the ice bin 102 is in the ice-full state, the ice-full state detection lever 700 may move to the ice-full state detection position.

While the ice-full state detection lever 700 has moved to the ice-full state detection position, the detection body 700 is located below the lower assembly 200.

When, in the pivoting process of the lower assembly 200, the ice is not separated, via the weight thereof, from the lower tray 250, the ice may be removed from the lower tray 250 when the lower tray 250 is pressed by the lower ejector 400 as shown in FIG. 68.

Specifically, in the process in which the lower assembly 200 pivots, the lower tray 250 comes into contact with the lower ejecting pin 420.

Further, as the lower assembly 200 continues to pivot in the forward direction, the lower ejecting pin 420 will pressurize the lower tray 250, thereby deforming the lower tray 250. Thus, the pressing force of the lower ejecting pin 420 may be transferred to the ice, thereby causing the ice to be separated from the surface of the lower tray 250. Then, the ice separated from the surface of the lower tray 250 may fall downward and be stored in the ice bin 102.

After the ice is removed from the lower tray 250, the lower assembly 200 may pivot in the reverse direction by the driver 180.

When the lower ejecting pin 420 is spaced apart from the lower tray 250 in the process in which the lower assembly 200 pivots in the reverse direction, the deformed lower tray may be restored to its original form.

Further, in the reverse pivoting process of the lower assembly 200, the pivoting force is transmitted to the upper ejector 300 via the connector 350, thereby causing the upper ejector 300 to rise up. Then, the ejecting pin 320 is released from the upper chamber 152.

Further, the driver 180 will stop when the lower assembly 200 reaches the water-supplied position, and then the water supply begins again.

As described above, the present disclosure is described with reference to the drawings. However, the present disclosure is not limited by the embodiments and drawings disclosed in the present specification. It will be apparent that various modifications may be made thereto by those skilled in the art within the scope of the present disclosure. Furthermore, although the effect resulting from the features of the present disclosure has not been explicitly described in the description of the embodiments of the present disclosure, it is obvious that a predictable effect resulting from the features of the present disclosure should be recognized.

What is claimed is:

1. A refrigerator comprising:

a cabinet defining a freezing compartment therein;

an ice maker mounted in the freezing compartment, the ice maker being configured to make spherical ice and release the made spherical ice in a downward direction;

an ice bin disposed below the ice maker and configured to receive the ice released from the ice maker, the ice bin being configured to be withdrawn from and retracted into the freezing compartment along a front and rear direction, respectively; and a cover plate extending downward from a rear face of the ice maker, wherein a lower portion of the ice maker is configured, based on the ice bin being retracted into the freezing compartment, to be positioned at least partially within the ice bin, wherein a bin opening is defined at a rear face of the ice bin and configured to allow the ice maker to pass therethrough based on the ice bin being withdrawn and retracted, and wherein the cover plate is configured, based on the ice bin being retracted into the freezing compartment, to shield the bin opening to thereby restrict the ice in the ice bin from falling out of the ice bin.

2. The refrigerator of claim 1, wherein the ice maker is mounted at a top face of the freezing compartment.

3. The refrigerator of claim 1, wherein a top face of the freezing compartment defines a recessed space that is recessed upward, and wherein at least a portion of an upper portion of the ice maker is accommodated in the recessed space.

4. The refrigerator of claim 1, wherein the bin opening is recessed downward from a top of the ice bin, and wherein the bin opening extends vertically downward to a vertical level that is higher than a bottom of the bin by at least a diameter of the spherical ice.

5. The refrigerator of claim 1, wherein the ice maker includes an ice-full state detection lever that pivots to detect an ice-full state of the ice bin, and wherein width and height of the bin opening are greater than a pivot radius of the ice-full state detection lever.

6. The refrigerator of claim 1, wherein the ice maker includes an upper casing that defines an outer shape of the ice maker, and wherein the cover plate is mounted on a rear face of the upper casing.

7. The refrigerator of claim 6, wherein the upper casing has a plate seat protruding therefrom, wherein an upper portion and a lower portion of the upper casing are stepped by the plate seat, and wherein a plate bent portion is provided at a top of the cover plate such that the cover plate is seated on the plate seat.

8. The refrigerator of claim 7, wherein a pair of bosses protrude from a rear face of the upper casing, and wherein a pair of boss-receiving portions for respectively receiving the pair of bosses therein are provided on the cover plate at locations corresponding to the pair of bosses, wherein a screw is fastened to each of the pair of boss-receiving portions.

9. The refrigerator of claim 1, wherein the ice maker includes an upper casing defining an outer shape of the ice maker, and wherein a portion of the upper casing extends downward to form the cover plate.

10. The refrigerator of claim 1, wherein a cold-air outlet is provided at a rear of the ice maker to discharge cold-air toward the ice maker, and wherein a cold-air hole is defined at a rear face of the ice maker above the cover plate such that cold-air discharged from the cold-air outlet flows into the ice maker through the cold-air hole in a front direction.

11. The refrigerator of claim 10, wherein a ventilation hole is defined in the cover plate, the ventilation hole penetrating the cover plate such that the cold-air discharged from the cold-air outlet flows into the ice bin.

12. The refrigerator of claim 1, wherein a plate rib protrudes along a perimeter of the cover plate to reinforce the cover plate.

13. The refrigerator of claim 1, wherein the freezing compartment includes a freezing compartment drawer configured to be withdrawn from and retracted into the freezing compartment along the front and rear direction, and wherein the ice bin is seated in the drawer to be withdrawn and retracted together with the freezing compartment drawer.

14. The refrigerator of claim 13, wherein the lower portion of the ice maker is configured, based on the freezing compartment drawer being retracted into the freezing compartment, to be positioned at least partially within the freezing compartment drawer, and wherein a drawer opening is defined at a rear face of the freezing compartment drawer at a position corresponding to the bin opening.

15. The refrigerator of claim 14, wherein a bin opening guide extends rearwardly along a perimeter of the bin opening.

16. The refrigerator of claim 14, wherein a plurality of bin mounting guides protrude upward from a bottom face of the freezing compartment drawer, each of the plurality of bin mounting guides being configured to receive a corner portion of the ice bin to guide a mounting position of the ice bin and maintain a coupled state of the ice bin.

17. The refrigerator of claim 14, wherein a range of movement of the freezing compartment drawer includes a region between a front end and a rear end of the ice maker.

18. The refrigerator of claim 1, wherein, based on the ice bin being retracted into the freezing compartment, the cover plate is positioned rearward of the ice bin.

19. The refrigerator of claim 1, wherein the cover plate has a flat shape.

20. The refrigerator of claim 1, wherein the cover plate has a rectangular plate shape.

* * * * *